US012637812B2

(12) United States Patent
Hamilton et al.

(10) Patent No.: US 12,637,812 B2
(45) **Date of Patent: *May 26, 2026**

(54) ADAPTIVE RAILWAY FASTENER AND ANCHOR INSTALLATION SYSTEM

(71) Applicant: MOW Equipment Solutions, Inc., Linwood, KS (US)

(72) Inventors: William Michael Hamilton, Linwood, KS (US); Ryan Jay Koci, Stilwell, KS (US); Justin Wynne Tomac, Bonner Springs, KS (US)

(73) Assignee: MOW Equipment Solutions, Inc., Linwood, KS (US)

( * ) Notice: Subject to any disclaimer, the term of this patent is extended or adjusted under 35 U.S.C. 154(b) by 1045 days.

This patent is subject to a terminal disclaimer.

(21) Appl. No.: 17/677,338

(22) Filed: Feb. 22, 2022

(65) Prior Publication Data

US 2022/0170214 A1 Jun. 2, 2022

Related U.S. Application Data

(63) Continuation of application No. 16/230,476, filed on Dec. 21, 2018, now Pat. No. 11,268,247.

(Continued)

(51) Int. Cl.

| | |
|---|---|
| ***E01B 29/26*** | (2006.01) |
| ***E01B 29/32*** | (2006.01) |
| ***E01B 35/10*** | (2006.01) |

(52) U.S. Cl.

CPC ..... *E01B 29/26* (2013.01); *E01B 29/32* (2013.01); *E01B 35/10* (2013.01); *E01B 2201/04* (2013.01)

(58) Field of Classification Search

CPC ..... E01B 29/32; E01B 29/24; E01B 29/26; E01B 2201/04

(Continued)

(56) References Cited

U.S. PATENT DOCUMENTS 308,421 A 11/1884 Meyenberg
3,117,531 A * 1/1964 Miller ..... E01B 29/32 104/17.2

(Continued)

FOREIGN PATENT DOCUMENTS

JP H09136287 A 5/1997

OTHER PUBLICATIONS

U.S. Appl. No. 17/115,886, Non-Final Office Action, Mailed on Mar. 3, 2023, 28 pages.

(Continued)

*Primary Examiner* — Zachary L Kuhfuss

(74) *Attorney, Agent, or Firm* — Kilpatrick Townsend & Stockton LLP

(57) ABSTRACT

Systems, methods, and machine-readable media to facilitate installation and adjustment of railway components are disclosed. Aligning of a railway anchor manipulator and a railway fastener installer with respect to a railway tie may be caused. The railway anchor manipulator may be slidably coupled with a frame assembly of a railway workhead, and may include anchor tools. The railway fastener installer may be slidably coupled with the main shaft structure, may include a hammer assembly, and may be operable to install railway fasteners through holes of a railway tie plate. The railway fastener installer may be caused to install the railway fasteners. The railway anchor manipulator may be lowered to a deployed position, and railway anchors may be adjusted with the anchor tools.

18 Claims, 32 Drawing Sheets

Related U.S. Application Data

(60) Provisional application No. 62/610,467, filed on Dec. 26, 2017.

(58) Field of Classification Search
USPC ..... 104/2, 16, 17.1, 17.2
See application file for complete search history.

(56) References Cited

U.S. PATENT DOCUMENTS

| | | | | |
|---|---|---|---|---|
| 4,457,060 | A | 7/1984 | Parks et al. | |
| 4,534,297 | A | 8/1985 | Johnson | |
| 4,890,558 | A | 1/1990 | Quella et al. | |
| 4,903,611 | A | 2/1990 | Holley | |
| 5,074,219 | A | 12/1991 | Theurer et al. | |
| 5,117,760 | A | 6/1992 | Almaraz et al. | |
| 5,277,122 | A * | 1/1994 | Almaraz | E01B 29/32 104/17.2 |
| 5,331,899 | A | 7/1994 | Holley | |
| 5,438,931 | A | 8/1995 | Becker et al. | |
| 5,577,447 | A | 11/1996 | Weber et al. | |
| 5,586,502 | A | 12/1996 | Weber | |
| 5,694,856 | A * | 12/1997 | Theurer | E01B 29/32 104/17.2 |
| 5,730,060 | A | 3/1998 | Straub et al. | |
| 5,915,744 | A | 6/1999 | Cotsford | |
| 6,138,573 | A | 10/2000 | Brenny et al. | |
| 6,324,659 | B1 | 11/2001 | Pierro | |
| 6,662,729 | B1 | 12/2003 | Madison | |
| 7,104,200 | B2 | 9/2006 | Hosking et al. | |
| 7,353,757 | B2 | 4/2008 | Eldridge | |
| 7,574,961 | B2 | 8/2009 | Barezzani et al. | |
| 7,677,177 | B2 | 3/2010 | Ganz | |
| 8,485,103 | B2 | 7/2013 | Miller et al. | |
| 8,522,688 | B2 | 9/2013 | Pritzl | |
| 8,739,704 | B2 | 6/2014 | Wickman et al. | |
| 9,841,287 | B1 | 12/2017 | Hayward | |
| 10,190,264 | B2 | 1/2019 | Hamilton et al. | |
| 10,526,753 | B2 | 1/2020 | Hamilton et al. | |
| 10,781,559 | B2 | 9/2020 | Hamilton et al. | |
| 10,781,560 | B2 | 9/2020 | Hamilton et al. | |
| 11,268,247 | B2 * | 3/2022 | Hamilton | E01B 29/26 |
| 2004/0006413 | A1 | 1/2004 | Kane et al. | |
| 2005/0067381 | A1 | 3/2005 | Coomer | |
| 2007/0156311 | A1 | 7/2007 | Elcock et al. | |
| 2011/0072998 | A1 | 3/2011 | Noll et al. | |
| 2011/0308421 | A1 * | 12/2011 | Pritzl | E01B 29/32 104/17.2 |
| 2012/0199037 | A1 * | 8/2012 | Miller | E01B 29/32 104/2 |
| 2012/0296562 | A1 | 11/2012 | Carlson et al. | |
| 2013/0276278 | A1 | 10/2013 | Barezzani et al. | |
| 2013/0300551 | A1 | 11/2013 | Weber et al. | |
| 2015/0053449 | A1 * | 2/2015 | Henke | E01B 29/26 173/128 |
| 2016/0153151 | A1 | 6/2016 | Irion | |
| 2016/0159380 | A1 | 6/2016 | Le-Corre et al. | |
| 2016/0289899 | A1 * | 10/2016 | Hamilton | E01B 29/32 |
| 2016/0298299 | A1 | 10/2016 | Hamilton et al. | |
| 2018/0223482 | A1 | 8/2018 | Hamilton et al. | |
| 2018/0223483 | A1 | 8/2018 | Hamilton et al. | |
| 2019/0130669 | A1 | 5/2019 | Boggio | |
| 2019/0154453 | A1 | 5/2019 | Leone et al. | |
| 2019/0194878 | A1 | 6/2019 | Hamilton et al. | |
| 2022/0122004 | A1 | 4/2022 | Takahara et al. | |

OTHER PUBLICATIONS

Application No. CA2994132, Notice of Allowance, Mailed on Mar. 20, 2023, 4 pages.
"English Translation of JP H09136287 A", May 27, 1997, 28 pages.
U.S. Appl. No. 17/115,886, Final Office Action, Mailed on Sep. 8, 2023, 32 pages.
U.S. Appl. No. 17/025,841, Notice of Allowance, Mailed on Feb. 7, 2024, 5 pages.
Application No. CA3,028,637, Office Action, Mailed on Oct. 20, 2023, 4 pages.
U.S. Appl. No. 15/090,428 received a Non-Final Office Action, mailed on Jul. 2, 2018, 7 pages.
U.S. Appl. No. 15/090,428 received a Notice of Allowance, mailed on Sep. 14, 2018, 5 pages.
U.S. Appl. No. 15/886,957 received a Non-Final Office Action, mailed on n Mar. 10, 2020, 7 pages.
U.S. Appl. No. 15/886,957 received a Notice of Allowance, mailed on May 19, 2020, 7 pages.
U.S. Appl. No. 15/886,987 received a Non-Final Office Action, mailed on Mar. 10, 2020, 7 pages.
U.S. Appl. No. 15/889,562 received a, Notice of Allowance, mailed on May 20, 2020, 10 pages.
U.S. Appl. No. 16/219,150 received a Notice of Allowance, mailed on Sep. 5, 2019, 9 pages.
U.S. Appl. No. 16/230,476 received a Non-Final Office Action, mailed on Jul. 13, 2021, 13 pages.
U.S. Appl. No. 16/230,476 received a Notice of Allowance, mailed on Oct. 27, 2021, 12 pages.

* cited by examiner

100

ADAPTIVE RAILWAY FASTENER AND ANCHOR INSTALLATION SYSTEM

CROSS-REFERENCES TO RELATED APPLICATIONS

This application is a continuation of U.S. patent application Ser. No. 16/230,476, filed on Dec. 21, 2018, which claims the benefit of, and priority to, U.S. Provisional Application No. 62/610,467, filed on Dec. 26, 2017, the entire disclosures of each of which are incorporated by reference herein for all purposes.

BACKGROUND

Disclosed embodiments of the present disclosure relate generally to railways, and in particular to maintenance of way with systems, apparatuses, and methods for railway component installation.

With the hundreds of thousands of miles of railroad track traversing the United States alone, in addition to the great lengths throughout other countries of the world, maintenance of way is a tremendous and important effort. One aspect of maintenance of way is railway tie maintenance. Railway ties are typically made of wood or other materials that age and deteriorate over time due to railway use and environmental conditions. As a result, railway ties eventually require replacement with new railway ties.

There are multiple steps in a process of railway tie replacement. Rails of railroad tracks are typically fastened to railway ties with a combination of railway spikes, tie plates fastened to the railway ties with the railway spikes, and railway anchors attached to undersides of the rails to anchor the rails to sides of the railway ties. Under current work practices, a typical tie replacement gang comprises several unique machines, in some cases 20 and more, forming a long line and arranged in the necessary order to perform sequential tasks for removing an old, worn railway tie and replacing it with a new railway tie. The work window is often 8-12 hours long and typically includes 2,000-5,000 ties that are replaced per day. Several issues are presented by the process, including issues redounding in inefficiencies, costs, and risks for personal injury. The trend is toward shorter and shorter work windows, with a desire for more productivity. So, more productive equipment is needed. Also, at the end of an allotted time of a work window, due to the sheer number of machines in a work gang that must get off the main track onto the side track in order to allow normal rail traffic to pass, the process of moving all machines onto the side track can take several minutes.

Thus, there is a need to solve these problems and provide for systems, apparatuses, and methods for railway component installation. These and other needs are addressed by the present disclosure.

BRIEF SUMMARY

Certain embodiments of the present disclosure relate generally to railways, and in particular to maintenance of way with systems, apparatuses, and methods for railway component installation.

In one aspect, a railway component handling system to install and adjust railway components is disclosed. The railway component handling system may include one or a combination of a frame assembly of a railway workhead, a railway anchor manipulator slidably coupled with the frame assembly, a linkage system attached to a main shaft structure, and a railway fastener installer slidably coupled with the main shaft structure. The railway anchor manipulator may include a pair of anchor tools in an opposing arrangement. The linkage system may be operable to selectively raise or lower the railway anchor manipulator. The railway fastener installer may include a hammer assembly and may be operable to install a plurality of railway fasteners through holes of a railway tie plate and into a railway tie. The railway anchor manipulator may be operable to lower to a deployed position by way of the linkage system, engage a pair of railway anchors attached to a rail with the pair of anchor tools, and adjust the pair of railway anchors using the pair of anchor tools.

Various embodiments of the system may further include a pair of railway fastener installers that includes said railway fastener installer. Each of the railway fastener installers may include a respective hammer assembly. In various embodiments, each hammer assembly may be slidably coupled with a dual-shaft assembly so that the hammer assembly is disposed in line between two pairs of shafts of the dual-shaft assembly. In various embodiments, the railway anchor manipulator and the railway fastener installers may be each selectively operable so that respective centerlines of the railway anchor manipulator and the railway fastener installers coincide. In various embodiments, each railway fastener installer may be slidably and pivotably coupled with the main shaft structure, and the railway fastener installers may be opposingly arranged with respect to the main shaft structure so that the railway anchor manipulator is between the railway fastener installers. In various embodiments, the frame assembly may include a first leg and a second leg, and the railway anchor manipulator may be slidably coupled with the first leg and the second leg so that the railway anchor manipulator is operable to lower to the deployed position in part by sliding along the first leg and the second leg of the frame assembly.

Various embodiments of the system may further include a self-centering assembly that includes the pair of anchor tools and that is slidably coupled with a dual-beam support framework. Various embodiments of the system may further include a floating cylinder coupled with the pair of anchor tools and operable to cause sliding movement of the pair of anchor tools with respect to the dual-beam support framework. In various embodiments, the linkage system may include one or more cylinders attached to a main shaft structure and attached to the self-centering assembly so that the self-centering assembly is disposed below the main shaft structure. In various embodiments, the main shaft structure may be slidably coupled with a main shaft, and the railway component handling system may further include a main shaft cylinder attached to the main shaft structure and operable to selectively slide the main shaft structure along the main shaft.

Various embodiments of the system may further include a system controller configured to facilitate alignment of the railway anchor manipulator and the railway fastener installers with respect to the railway tie so that the railway anchor manipulator and the railway fastener installers are disposed in an aligned position with respect to the railway tie. In various embodiments, the system controller may be further configured to, when the railway fastener installers are in the aligned position, control the railway fastener installers to install the plurality of railway fasteners through the holes of the railway tie plate and into the railway tie. In various embodiments, the controlling the railway fastener installers to install the plurality of railway fasteners through the holes of the railway tie plate and into the railway tie may be based at least in part on a recorded pattern indicative of positions of the holes of the railway tie plate.

Various embodiments of the system may further include a plurality of sensors configured to transmit sensor data to the system controller, where the controlling the railway fastener installers to install the plurality of railway fasteners through the holes of the railway tie plate and into the railway tie is based at least in part on the sensor data. In various embodiments, the system controller may be further configured to, when the railway anchor manipulator is in the aligned position and without adjusting the alignment, control the railway anchor manipulator to cause: the lowering to the deployed position, the engaging of the pair of railway anchors attached to the rail with the pair of anchor tools via actuation of a floating cylinder, and the adjusting of the pair of railway anchors. In various embodiments, one or both of the engaging and the adjusting the pair of railway anchors may be based at least in part on the sensor data.

In another aspect, a method of installing and adjusting railway components is disclosed. The method may include one or a combination of the following. Aligning of a railway anchor manipulator and a railway fastener installer with respect to a railway tie may be caused so that the railway anchor manipulator and the railway fastener installer are disposed in an aligned position with respect to the railway tie, where: the railway anchor manipulator may be slidably coupled with a frame assembly of a railway workhead, and may include a pair of anchor tools in an opposing arrangement; and the railway fastener installer may be slidably coupled with the main shaft structure, may include a hammer assembly, and may be operable to install a plurality of railway fasteners through holes of a railway tie plate and into the railway tie. When the railway fastener installer is in the aligned position, the railway fastener installer may be caused to install the plurality of railway fasteners through the holes of the railway tie plate and into the railway tie. When the railway anchor manipulator is in the aligned position and without adjusting the alignment, one or a combination of the following may be caused. The railway anchor manipulator may be lowered to a deployed position by way of a linkage system, where the linkage system is attached to a main shaft structure and is operable to selectively raise or lower the railway anchor manipulator. A pair of railway anchors attached to a rail may be engaged with the pair of anchor tools. The pair of railway anchors may be adjusted using the pair of anchor tools. In various embodiments, the causing the railway fastener installers to install the plurality of railway fasteners through the holes of the railway tie plate and into the railway tie may be based at least in part on an indicated pattern of positions of the holes of the railway tie plate.

In yet another aspect, one or more non-transitory, machine-readable media having machine-readable instructions thereon which, when executed by one or more computers or other processing devices, cause the one or more computers or other processing devices to perform one or a combination of the following. Aligning of a railway anchor manipulator and a railway fastener installer with respect to a railway tie may be caused so that the railway anchor manipulator and the railway fastener installer are disposed in an aligned position with respect to the railway tie, where: the railway anchor manipulator may be slidably coupled with a frame assembly of a railway workhead, and may include a pair of anchor tools in an opposing arrangement; and the railway fastener installer is slidably coupled with the main shaft structure, may include a hammer assembly, and may be operable to install a plurality of railway fasteners through holes of a railway tie plate and into the railway tie. When the railway fastener installer is in the aligned position, the railway fastener installer may be caused to install the plurality of railway fasteners through the holes of the railway tie plate and into the railway tie. When the railway anchor manipulator is in the aligned position and without adjusting the alignment, one or a combination of the following may be caused. The railway anchor manipulator may be lowered to a deployed position by way of a linkage system, where the linkage system is attached to a main shaft structure and is operable to selectively raise or lower the railway anchor manipulator. A pair of railway anchors attached to a rail may be engaged with the pair of anchor tools. The pair of railway anchors may be adjusted using the pair of anchor tools. In various embodiments, the causing the railway fastener installers to install the plurality of railway fasteners through the holes of the railway tie plate and into the railway tie may be based at least in part on an indicated pattern of positions of the holes of the railway tie plate.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the following appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability, or configuration of the disclosure. Rather, the ensuing description of the preferred exemplary embodiment(s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Various embodiments will now be discussed in greater detail with reference to the accompanying figures, beginning with FIG. 1A.

Figure 1A:
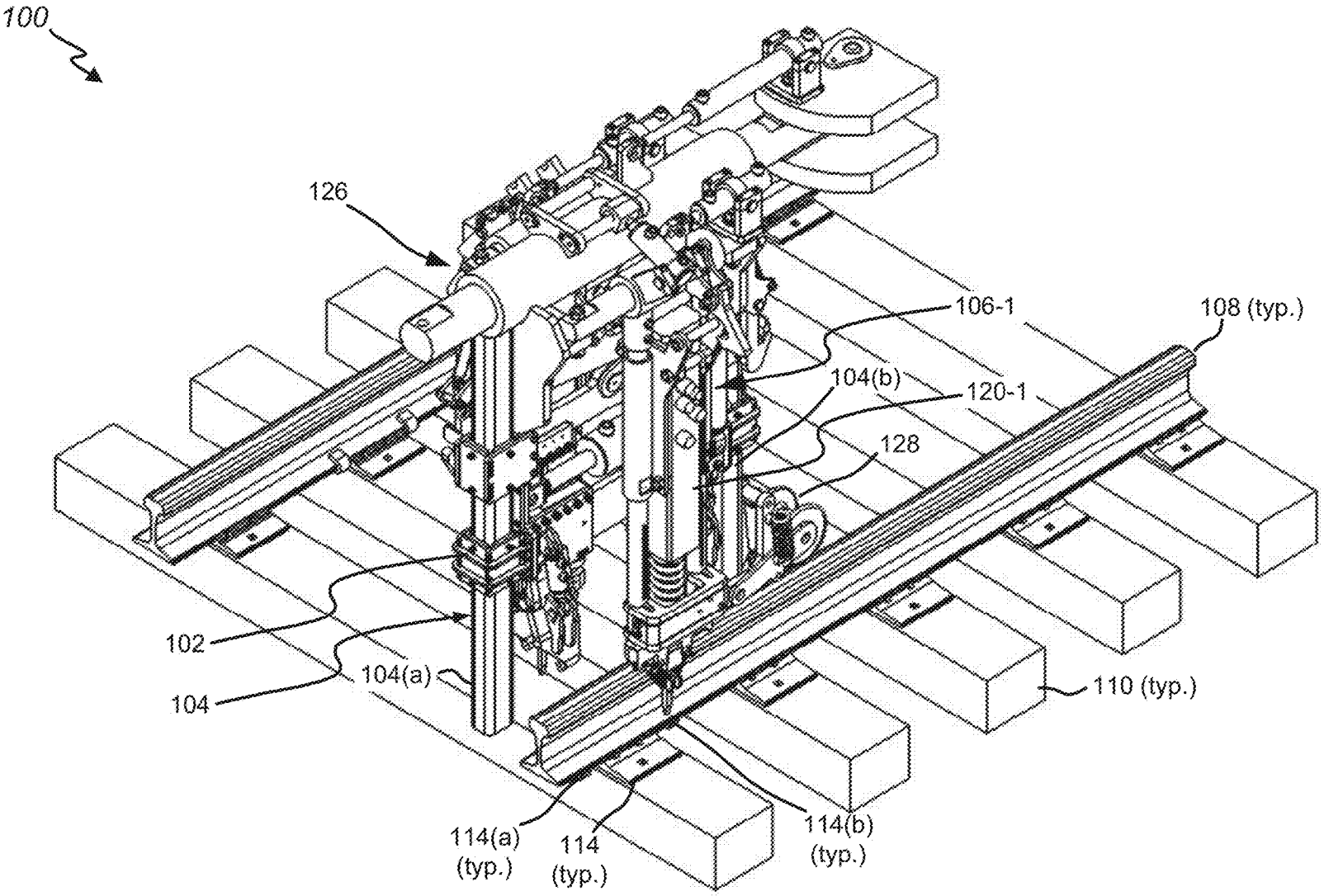
FIGS. 1A, 1B, and 1C depict perspectives views of a portion of a single-plane, multifunctional railway component handling system from a field side of a rail, in accordance with disclosed embodiments of the present disclosure.
Figure 1B:
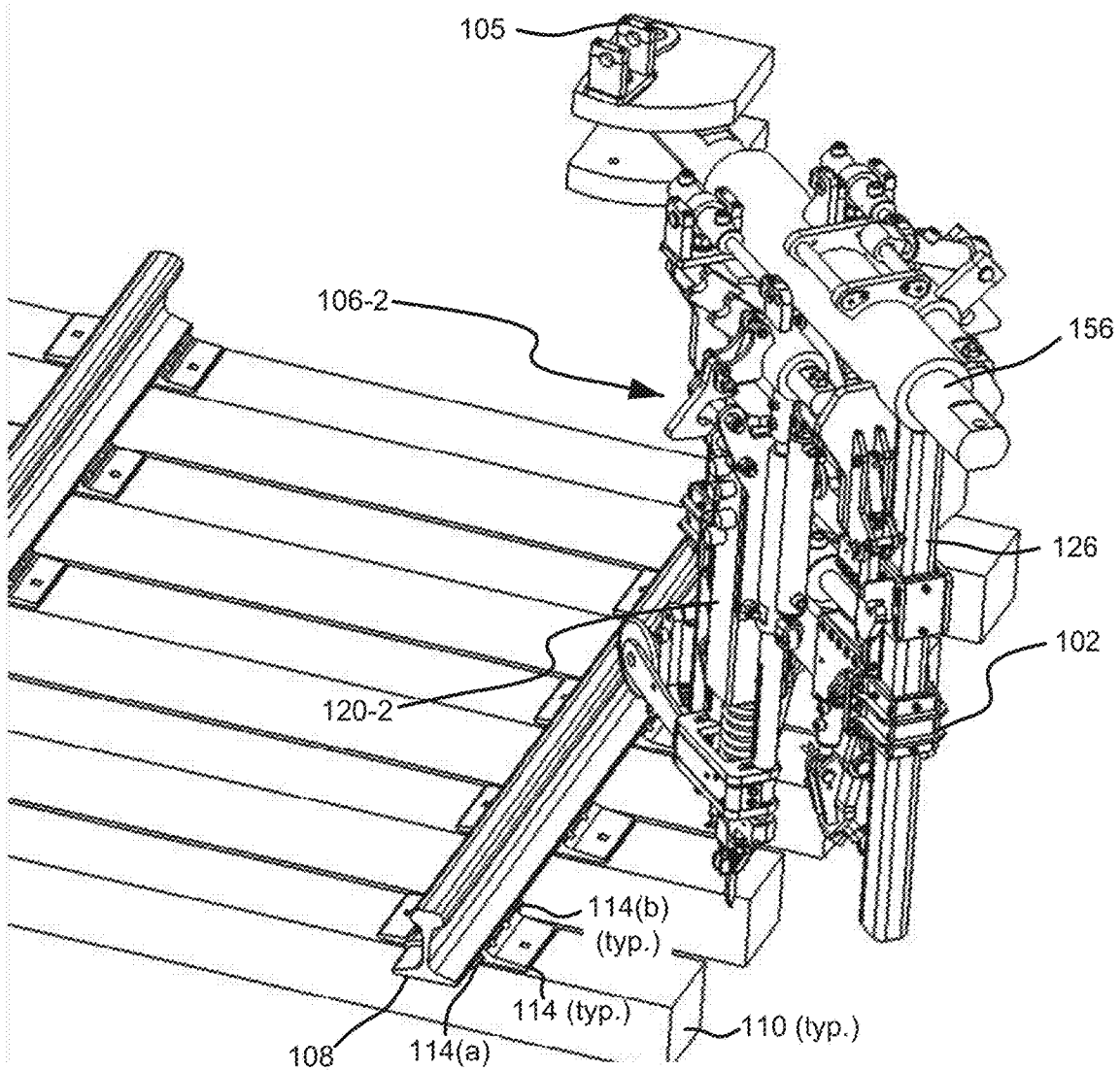
Figure 1C:
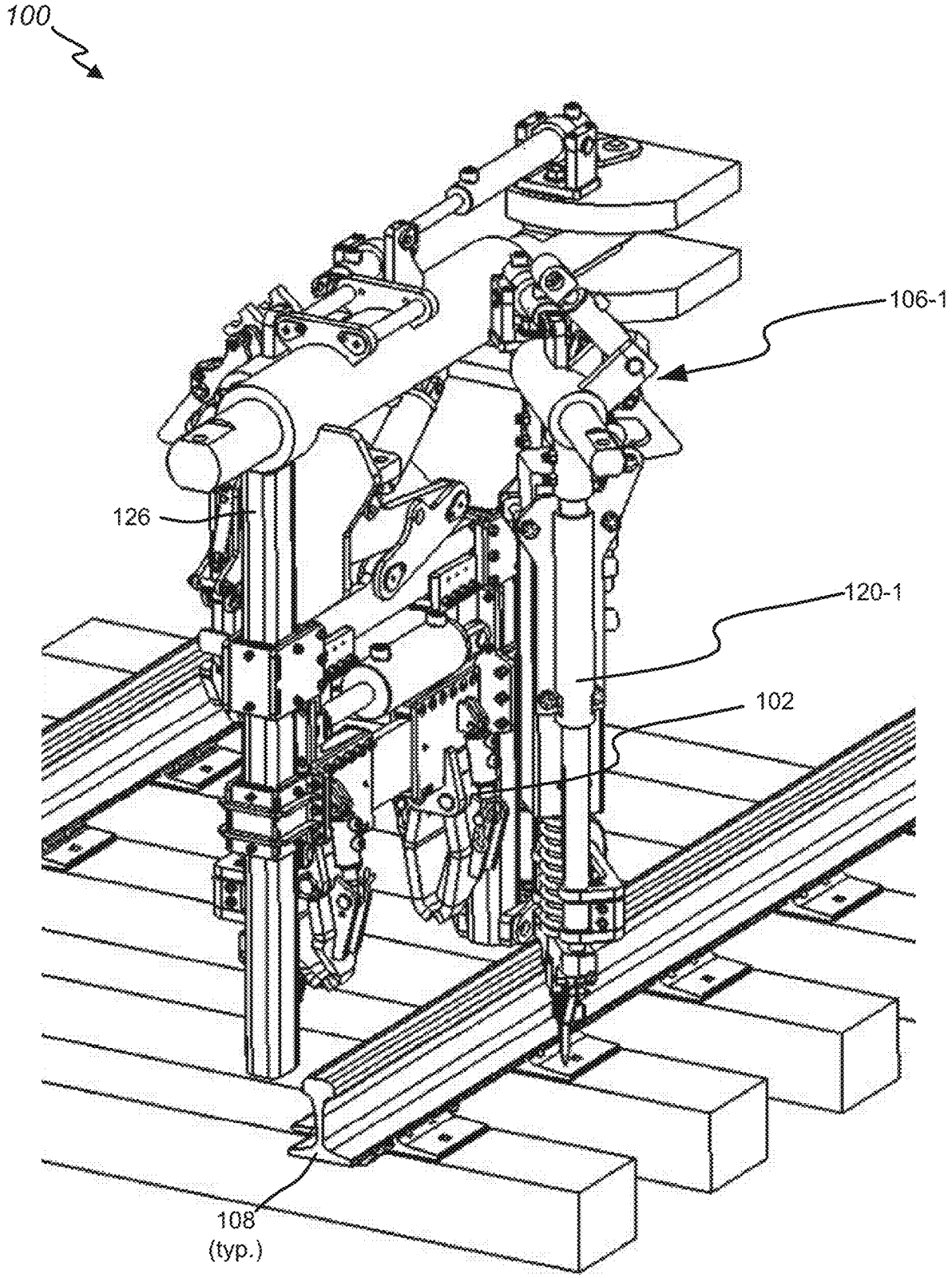

FIGS. 1A, 1B, and 1C depict perspective views of a portion of a single-plane, multifunctional railway component handling system 100 from a field side of a rail 108, in accordance with disclosed embodiments of the present disclosure. In FIG. 1A, the single-plane, multifunctional railway component handling system 100 (variously referenced herein as the component handling system 100 or the system 100) is shown in a ready position where the component handling system 100 is aligned with the rail 108. In FIG. 1B, the component handling system 100 is shown in a pivoted position where the component handling system 100 is pivoted away from the rail 108.

The railway, as is typical, comprises a pair of (though only one rail 108 is depicted in various views herein) supported by a plurality of railway ties 110. As used herein, the term "gage side" or "gauge side" is used to indicate an association with a space between the pair of rails 108 and/or a side of a rail 108 or other component exposed to, facing, and/or oriented toward the space between the pair of rails 108. The term "field side" is used to indicate an association with a space external to the pair of rails 108 and/or a side of a rail 108 or other component exposed to, facing, and/or oriented toward the space external to the pair of rails 108.

The component handling system 100 may be coupled to a motorized railway maintenance vehicle (not shown). The railway maintenance vehicle may include an engine, a chassis, wheels for traversing along one or more of the rails 108, and other suitable components known to a person of ordinary skill in the art. Accordingly, the railway maintenance vehicle may include an operator cab, station, or other area with control elements of a control system 201 that allow for control of the railway maintenance vehicle. The railway maintenance vehicle may be any suitable vehicle adapted for coupling to the component handling system 100.

The component handling system 100 may include an over-under workhead that includes multifunctional subsystems in an over-under configuration. The workhead may include an anchor manipulation subsystem 102 (sometimes referenced herein as anchor manipulator 102) and a fastener-installing subsystem 106 (sometimes referenced herein as fastener installer 106). The over-under workhead, with its various features (including compactness, self-alignment, direct load bearing, independent tool articulation, among other features disclosed herein) combined to yield a synergy with several advantages and technical solutions to technical problems.

As one example, the entire workhead can pivot away from the rest of the equipment (e.g., a maintenance vehicle). This pivoting ability is illustrated in FIG. 1B. As depicted, the component handling system 100 may be configured to pivot about a pivot point of a hinge assembly 105. The hinge assembly 105 may include a hinge built into the main shaft 156 to allow the pivoting action of the workhead. The hinge assembly 105 may be attached to other equipment not shown (e.g., a maintenance vehicle). The other end of the main shaft 156 may be fastened to other equipment not shown with one or more fasteners that can easily be removed to allow the pivoting action. The ability to pivot the workhead away from other equipment may allow for ease of access, and a greater extent of access, to various components such as the gage side hammer assembly of the fastener installer 106 and the gage side of the anchor manipulation sub system 102.

In FIG. 1C, the component handling system 100 is shown in a pivoted position where part of the fastener installer 106 is pivoted away from the rail 108. This likewise may allow for ease of access, and a greater extent of access, to various components of the fastener installer 106. Additional details regarding this are disclosed further herein.

The rails 108 may be fastened to the railway ties 110 with a combination of railway fasteners 116 (shown in other figures discussed below), tie plates 114 fastened to the railway ties 110 with the railway fasteners 116 driven through fastener holes of the tie plates 114, and railway anchors 114(*a*), 114(*b*) attached to undersides of the rails 108 to anchor the rails to sides the railway ties 110. In some instances, a railway fastener 116 may be a railway spike. In other instances, a railway fastener 116 may be a lag screw or another type of fastener. The depicted examples herein show the railway fastener 116 as a railway spike.

Figure 1D:
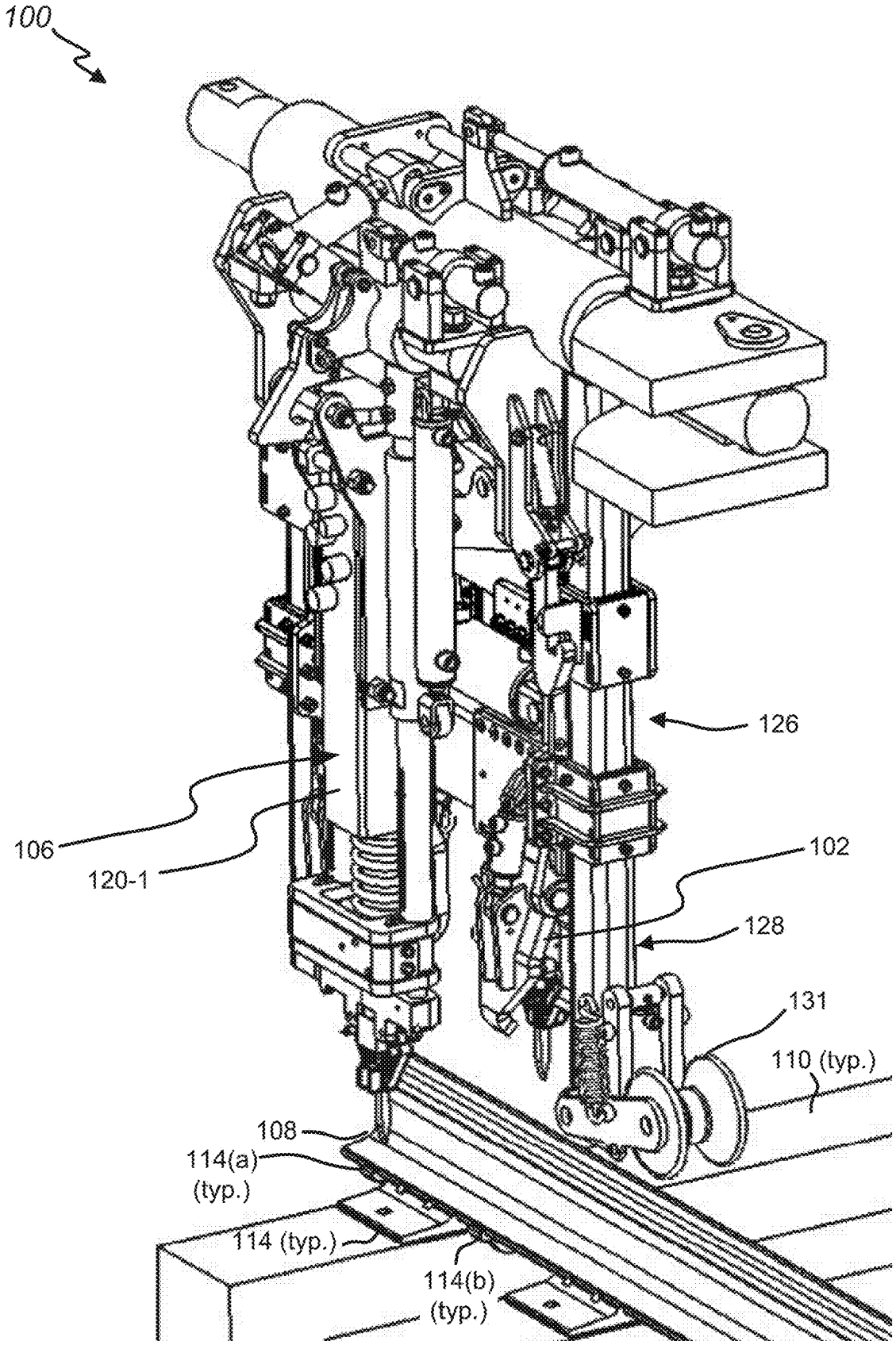
FIG. 1D depicts a close-up perspective view of the portion of the single-plane, multifunctional railway component handling system from the field side of the rail, in accordance with disclosed embodiments of the present disclosure.
Figure 1E:
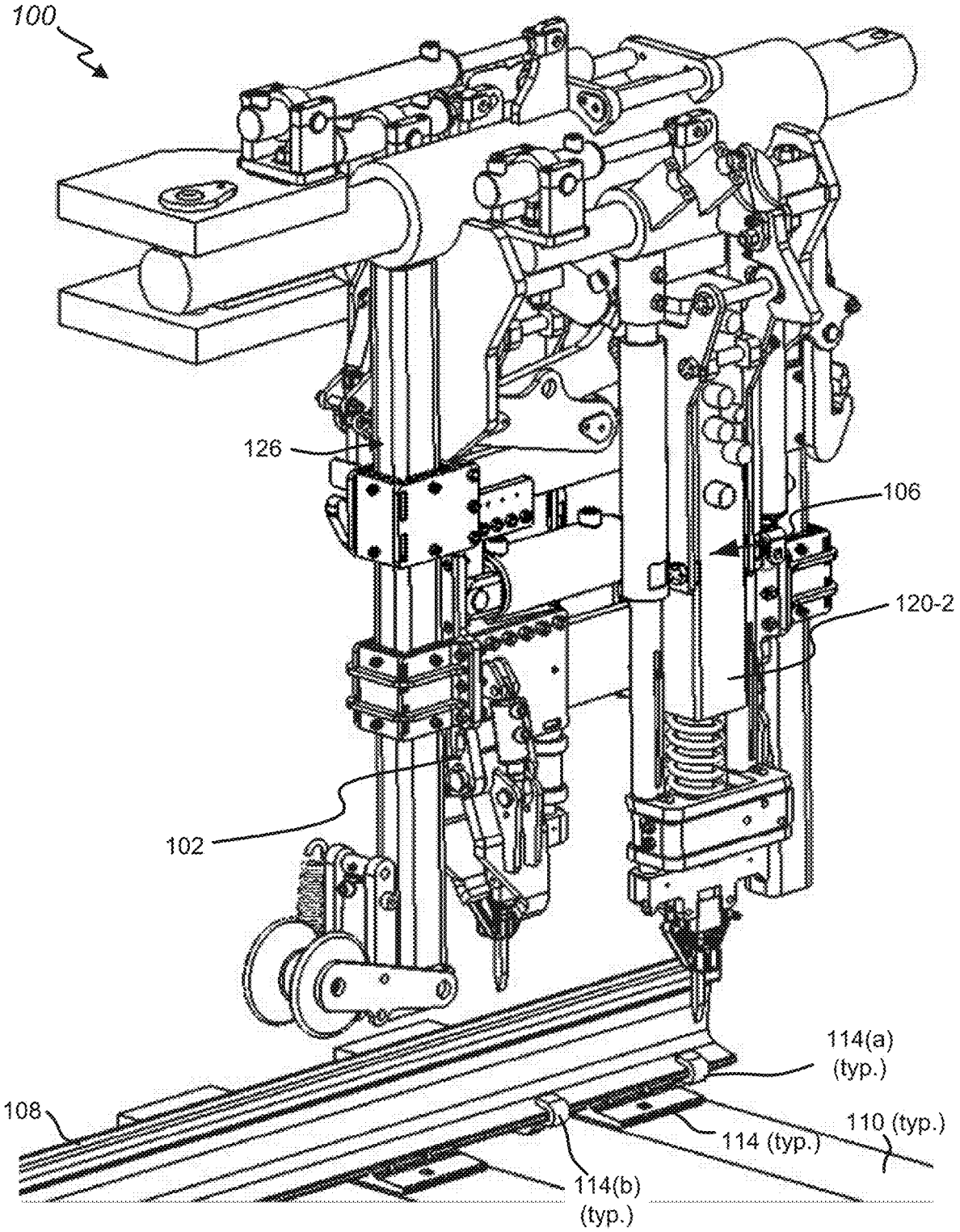
FIG. 1E depicts a close-up perspective view of the portion of the single-plane, multifunctional railway component handling system from the gage side of the rail, in accordance with disclosed embodiments of the present disclosure.
Figure 1F:
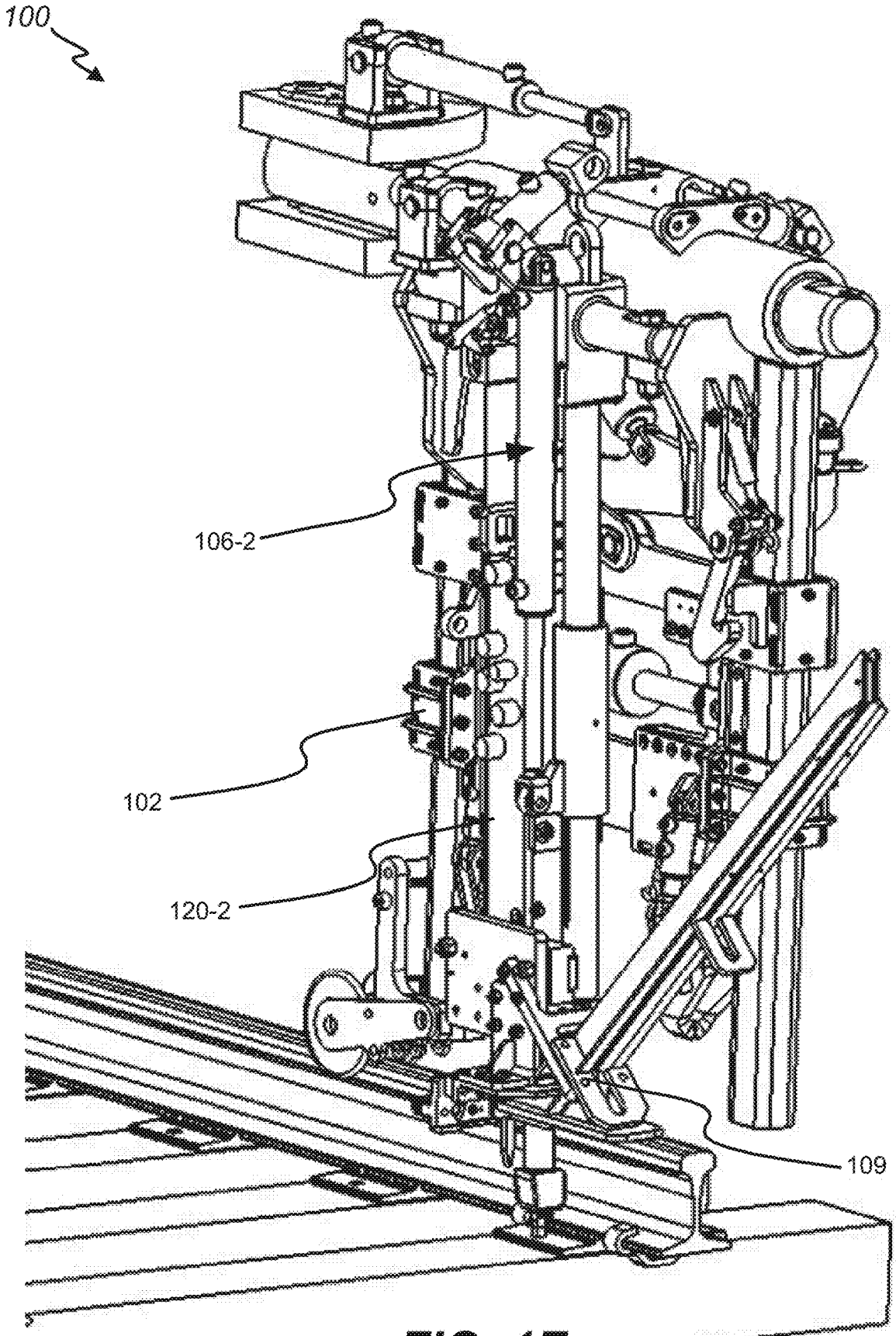
FIG. 1F depicts a close-up perspective view of a portion of the single-plane, multifunctional railway component handling system from the gage side of the rail where the portion includes a feed subsystem, in accordance with disclosed embodiments of the present disclosure.

FIG. 1D depicts a close-up perspective view of the portion of the single-plane, multifunctional railway component handling system 100 from the field side of the rail 108, in accordance with disclosed embodiments of the present disclosure. FIG. 1E depicts a close-up perspective view of the portion of the single-plane, multifunctional railway component handling system 100 from the gage side of the rail 108, in accordance with disclosed embodiments of the present disclosure. FIG. 1F depicts a close-up perspective view of a portion of the single-plane, multifunctional railway component handling system 100 from the gage side of the rail 108 where the portion includes a feed subsystem 109, in accordance with disclosed embodiments of the present disclosure.

The anchor manipulation subsystem 102 and the fastener-installing subsystem 106 may be configured in an over-under arrangement such that the anchor manipulation subsystem 102 is disposed generally under the fastener-installing subsystem 106. This configuration may allow tandem operation of the anchor manipulation subsystem 102 and the pair of fastener installers 106. As such, the anchor manipulation subsystem 102 and the fastener installer subsystem 106 may operate in a single plane such that the anchor manipulation subsystem 102 and the fastener-installing subsystem 106 may have the same or substantially the same centerline.

In operation, the component handling system 100, once positioned over a given railway tie 110, may utilize the anchor manipulator 102 to manipulate the tie plate 114. The operation of the anchor manipulator 102 to manipulate the tie plate 114 may be directed by an operator and/or may be directed by the control system 201 based at least in part on the sensor feedback described herein. Then, without any repositioning or without significant repositioning along the rail 108—and with minimal transition time—the component handling system 100 may utilize the fastener installer subsystem 106 to install one or more railway fasteners 116 through holes of the tie plate 114 and into the railway tie 110. Specifically, the anchor manipulator 102 may be lowered to engage the tie plate 114 by direction of an operator and/or by direction of the control system 201 based at least in part on the sensor feedback described herein. Further, the anchor manipulator 102 may then adjust the railway anchors 114(*a*), 114(*b*)—again, without any repositioning or without significant repositioning along the rail 108 and with minimal transition time to perform the adjustment operations. In addition, prior to adjusting the railway anchors 114(*a*), 114(*b*), the anchor manipulator 102 may adjust the tie plate 114 on top of the tie 110 so that one edge of the tie plate 114 is not hanging over an edge of the tie 110 prior to driving one or more railway fasteners 116 through holes of the tie plate 114. Such adjustment operations with respect to the railway anchors 114(*a*), 114(*b*) and/or the tie plate 114 may be directed by an operator and/or by the control system 201 based at least in part on the sensor feedback described herein. Accordingly, the anchor manipulator 102 may center tie plates 114 on top of railway ties 110 as part of the fastener installation processes, in addition to adjusting the railway anchors 114(*a*), 114(*b*).

Materials for various structural components of the component handling system 100 may be selected such that the structural components can generate necessary forces to move a railway components in accordance with various embodiments disclosed herein, while safely withstands stresses imparted to the structural elements of the system from those aforementioned forces. Said materials may include structural quality alloy steels with medium to high carbon content and may involve certain heat treatment and tempering to produce components with the necessary strength.

While disclosed embodiments of the component handling system 100 are illustrated as an example, the component handling system 100 may include other types of railway machinery and workheads not shown. Other embodiments, for example, may include spike-extracting workheads, railway anchor spreading and/or removing workheads, and/or any other suitable type of railway installation and/or maintenance machinery. In various embodiments, the component handling system 100 may be adapted for conjunction with a variety of railway workheads.

The component handling system 100 may include a rigid, metal frame 104. As depicted, the frame 104 may be an assembly of components. Other frame configurations may be included in other embodiments. The component handling system 100, including the frame 104, its forward leg 104(*a*), rear leg 104(*b*), and linkages, may be fabricated to possess material strength and overall structural strength to generate and accommodate the forces involved to adjust railway anchors 114(*a*), 114(*b*) and to install railway fasteners 116 through holes of tie plates 114 and into the railway ties 110.

The anchor manipulator 102 may be slidably coupled to the frame 104. As in the depicted example, the frame 104 may include a forward leg 104(*a*) and a rear leg 104(*b*) that follows the forward leg 104(*a*) along one direction of travel. The references to rear are with respect to one direction of travel of the component handling system 100 along the rail 108, however the component handling system 100 is moveable in the reverse direction. Thus, the frame 104, including the forward leg 104(*a*) and the rear leg 104(*b*) may provide a rigid guide structure for the anchor manipulator 102 to slide vertically for various operations and for coupling with the roller which allows the frame 104 to roll along the top of the rail head of the rail 108 during use. One purpose of the roller may be to ensure that the workhead remains (follows) centered on top of the rail head 108 at all times. This may help with accurate/precise dynamic positioning of fastener installers 106 and railway fasteners 116 over the holes in tie plates 114 as well as the general proximity of the anchor adjusting tools to the rail 108 since they have only limited movement toward and away from the rail 108. This may ensure that the tools can always make contact with the foot of the rail 108 on both sides with the amount of articulating movement they are allowed.

The rear leg 104(*b*) may include a roller assembly 131 that is disposed in a rear position. The roller assembly 131 may include a roller to contact the rail 108 and facilitate movement of the component handling system 100 along the rail 108. The roller may be formed with a particular shape and contour in order to allow for even contact with faces of the rail head. In some embodiments, the different shape and angles of the roller address the cant of the rail 108. The rails of a railway are typically designed and installed to have a slight tilt (e.g., approximately 1.4°) toward the gage side. In various embodiments, the roller assembly 131 may include one or more cylinders and/or spring components to extend and/or retract the roller respectively toward and/or away from the rail head of the rail 108.

In addition to the roller assembly cylinders, various embodiments of the component handling system 100 may include a plurality of cylinders/actuators as illustrated and as described herein. The cylinders/actuators in various embodiments may correspond to any one or combination of hydraulic actuators, pneumatic actuators, electric actuators, and/or the like to extend and retract in accordance with disclosed embodiments, and may be referenced herein as power cylinders, cylinder, or actuators. The cylinders may each include control ports for connection to control lines (hydraulic, pneumatic, electrical, etc., in various embodiments) and connection to the control system 201 disclosed further herein. The cylinders may each include control ports for connection to control lines (hydraulic, pneumatic, electrical, etc., in various embodiments) and connection to the control system 201. Some embodiments may include control valves with solenoids and electrical connections to one or more main processors of the control system 201 that may be located at the operator's stations or at any suitable place.

Figure 2A:
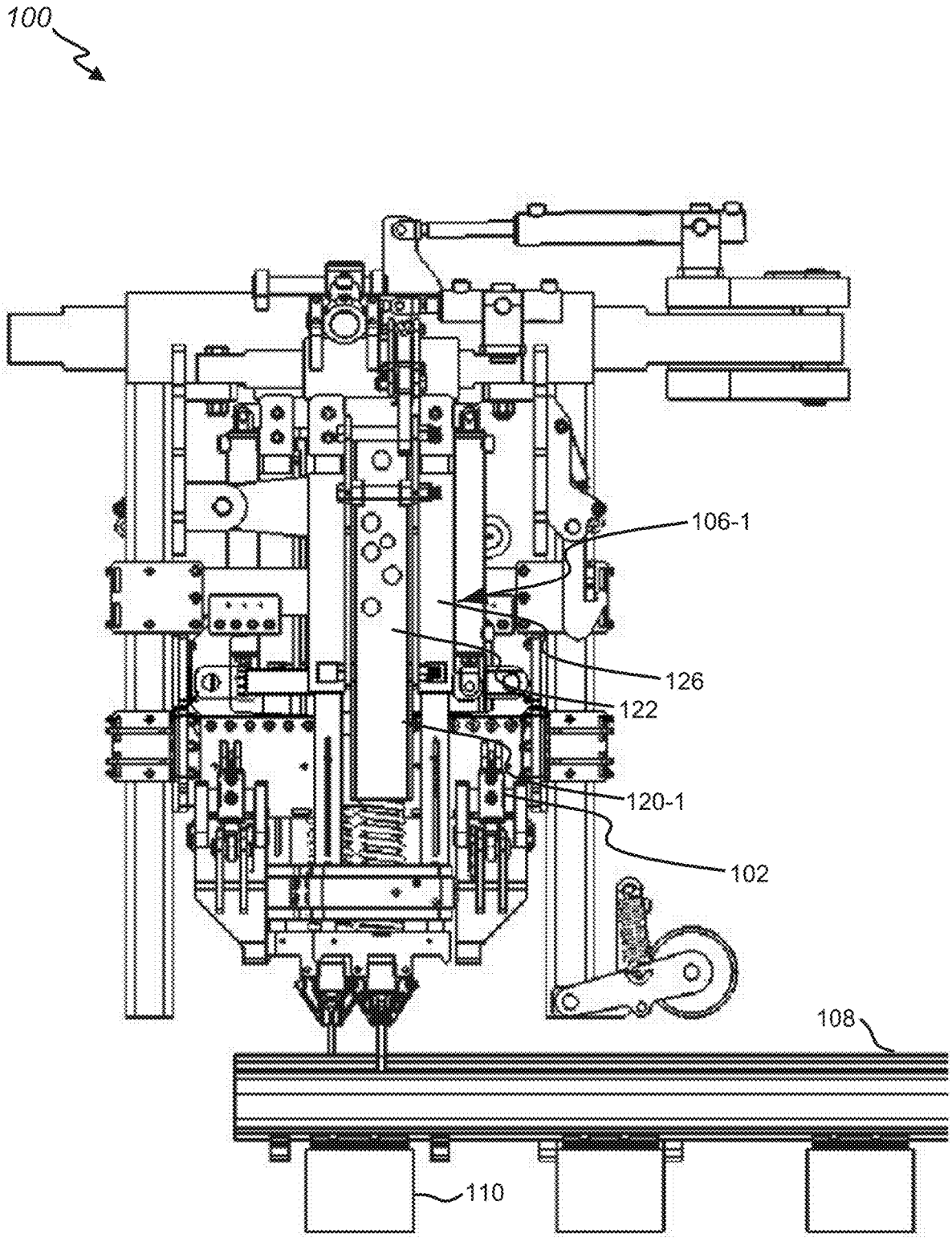
FIG. 2A depicts a partial side view of a portion of the single-plane multifunctional railway component handling system in a stowed position, in accordance with disclosed embodiments of the present disclosure.
Figure 2B:
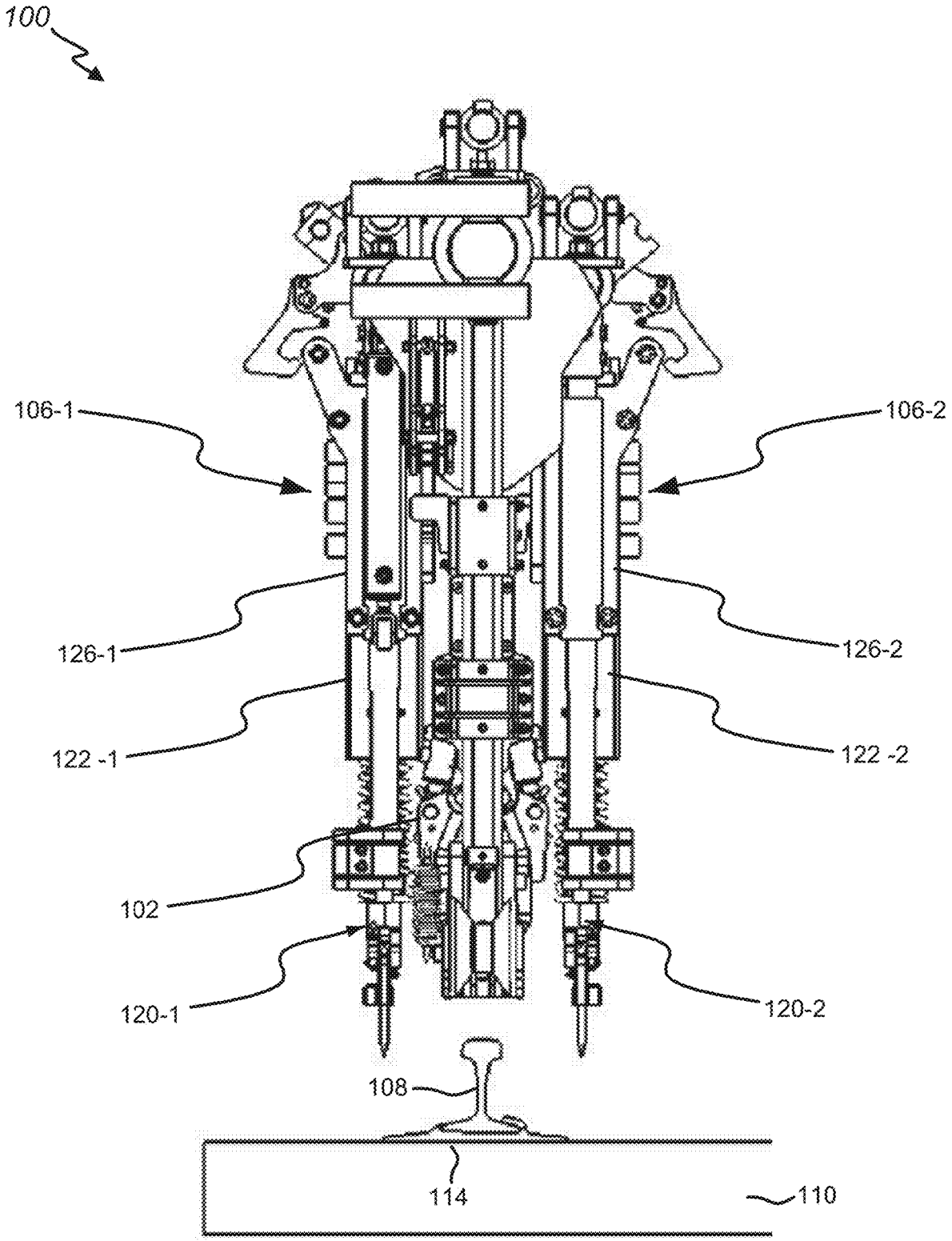
FIG. 2B depicts a partial end view of the portion of the single-plane multifunctional railway component handling system in the stowed position, in accordance with disclosed embodiments of the present disclosure.
Figure 2C:
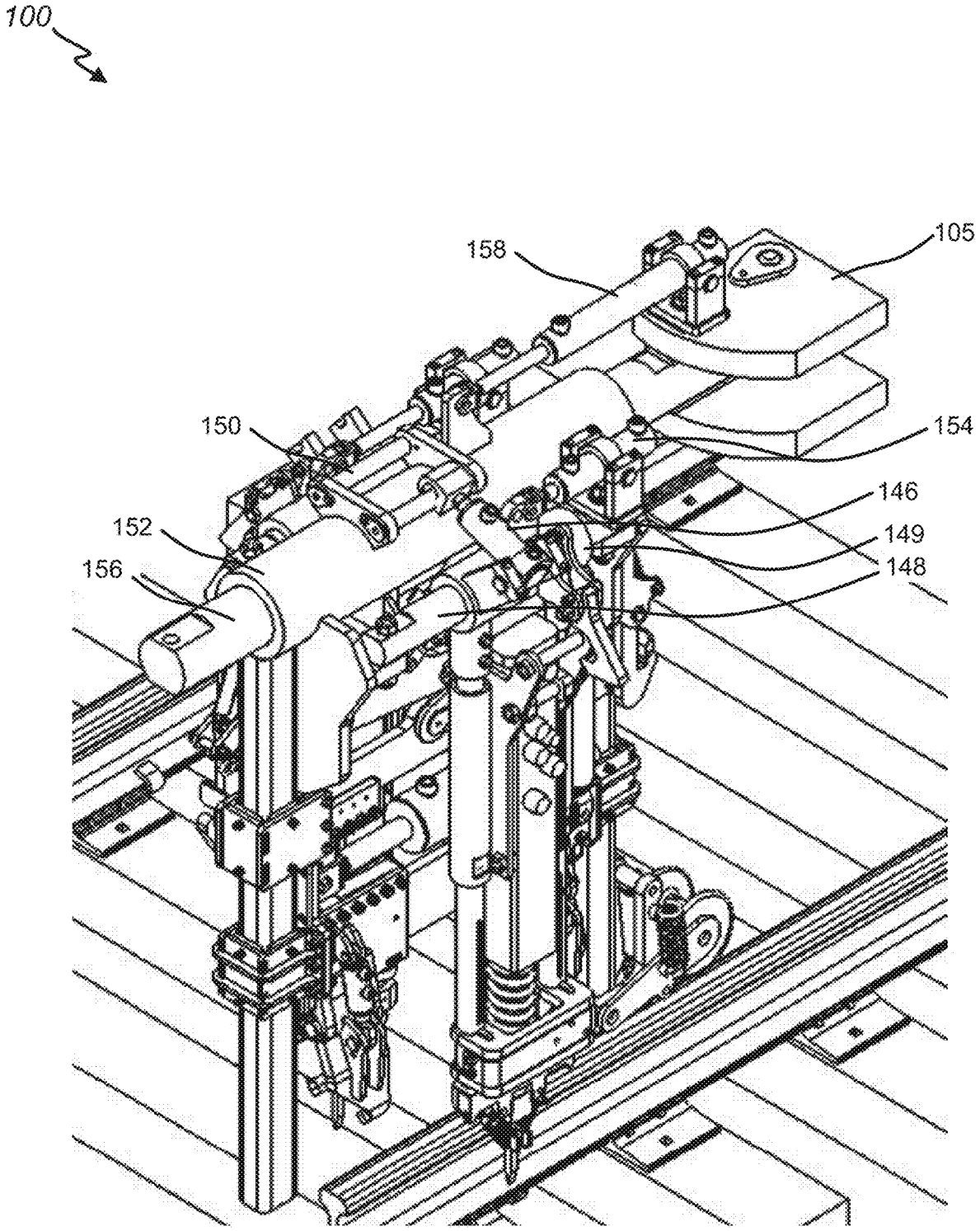
FIG. 2C depicts a partial perspective view of the portion of the single-plane multifunctional railway component handling system in the stowed position, in accordance with disclosed embodiments of the present disclosure.

FIG. 2A depicts a partial side view of a portion of the single-plane multifunctional railway component handling system 100 in a stowed position, in accordance with disclosed embodiments of the present disclosure. FIG. 2B depicts a partial end view of the portion of the single-plane multifunctional railway component handling system 100 in the stowed position, in accordance with disclosed embodiments of the present disclosure. FIG. 2C depicts a partial perspective view of the portion of the single-plane multifunctional railway component handling system 100 in the stowed position, in accordance with disclosed embodiments of the present disclosure. As in the depicted position, the system 100 does not contact the rail 108 in the stowed position. The stowed position may correspond to a ready position and/or an otherwise non-deployed position. Other embodiments may be configured to utilize other stowed positions and/or other ready positions.

Figure 3:
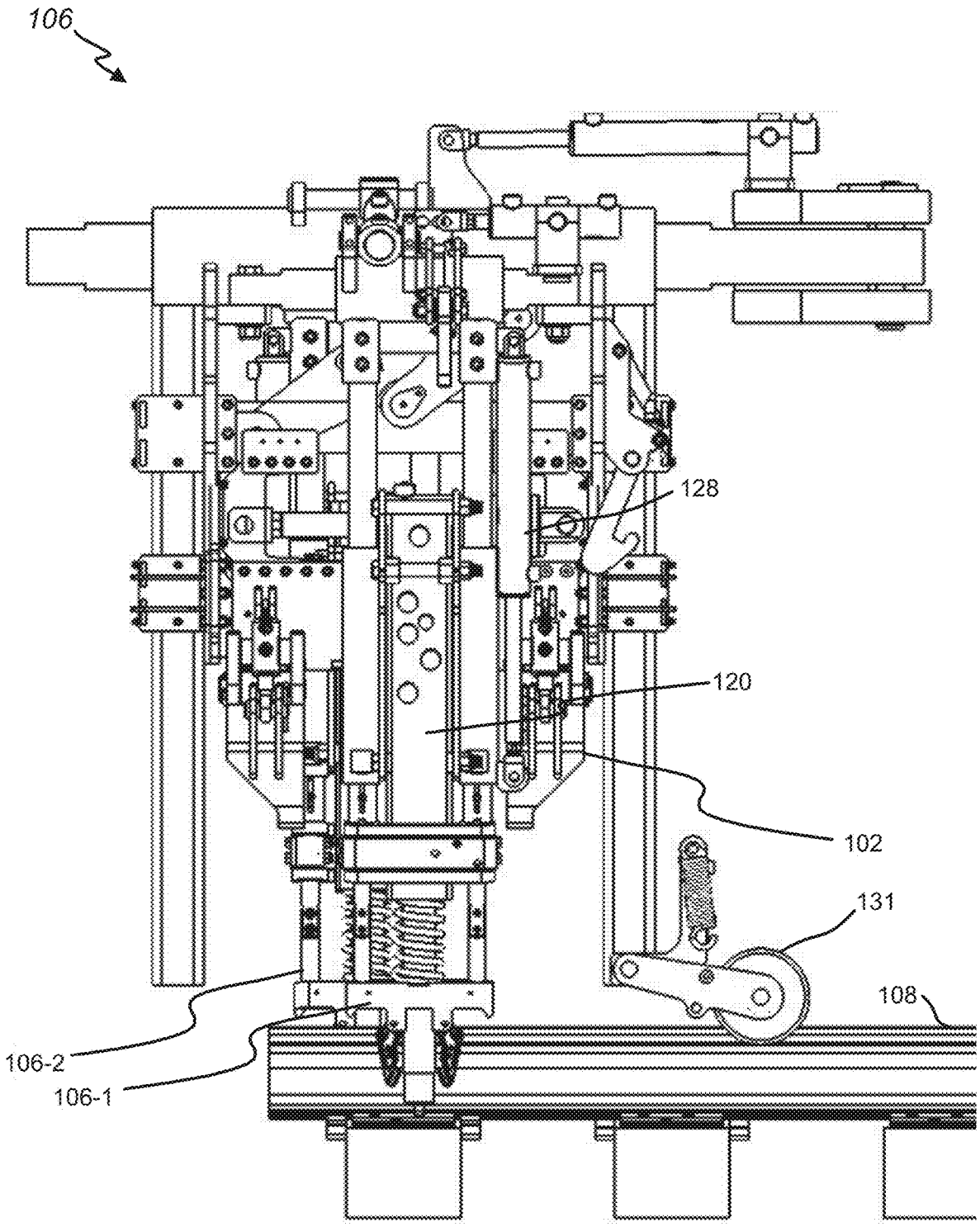
FIG. 3 depicts a partial side view of a portion of the single-plane multifunctional railway component handling system in one example deployed state on the railway during a fastener driving operation, in accordance with disclosed embodiments of the present disclosure.

FIG. 3 depicts a partial side view of a portion of the single-plane multifunctional railway component handling system 100 in one example deployed state on the railway during a fastener driving operation, in accordance with disclosed embodiments of the present disclosure. In FIG. 3, the portion of the component handling system 100 is depicted without the feed subsystem 109 for the sake of clarity. The illustrated deployed position shows the roller of the roller assembly 131 extended, e.g., by way of an actuated cylinder, to contact the rail head of the rail 108. Further, as in the illustrated deployed position, the pair of fastener installers 106 may be operated while the anchor manipulation subsystem 102 remains in a stowed or otherwise non-deployed position. The example states are not limiting; other states may be employed by various embodiments.

According to various embodiments, the anchor manipulation subsystem 102 and/or the fastener installers 106 may be lowered to a working position with each set of one or more components associated with each railway tie 110, and may be raised to a stowed position or another position suitable for transition between railway ties 110 to create or increase clearance with respect to railway components. Such embodiments may allow for increased adaptability to a variety of working conditions. However, disclosed embodiments may allow for the anchor adjuster 102 to remain in a lowered working position or to be partially raised as the component adjustment system 100 transitions between railway ties 110 to make component adjustments associated with a plurality of railway ties 110. Such embodiments may allow for increased speed and efficiency in making component adjustments with respect to a large number of railway ties 110. Some of such embodiments may include adjusting hammer assemblies 120 to an outward state away from the rail 108 to create or increase clearance with respect to railway components to accommodate transitions between tie plates 114. Each of the foregoing positioning operations may be directed by an operator and/or by the control system 201 based at least in part on the sensor feedback described herein.

Figure 4A:
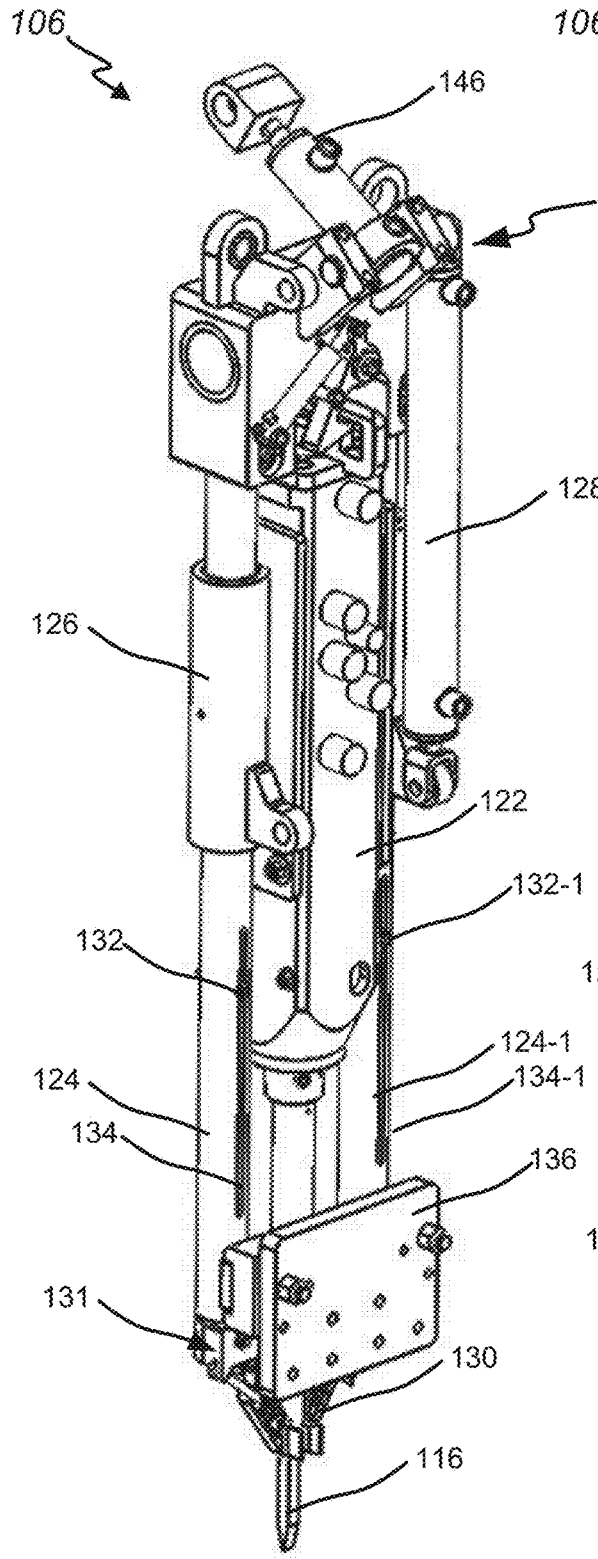
FIG. 4A depicts a perspective view of part of the fastener installer separated from the single-plane multifunctional railway component handling system, in accordance with disclosed embodiments of the present disclosure.
Figure 4B:
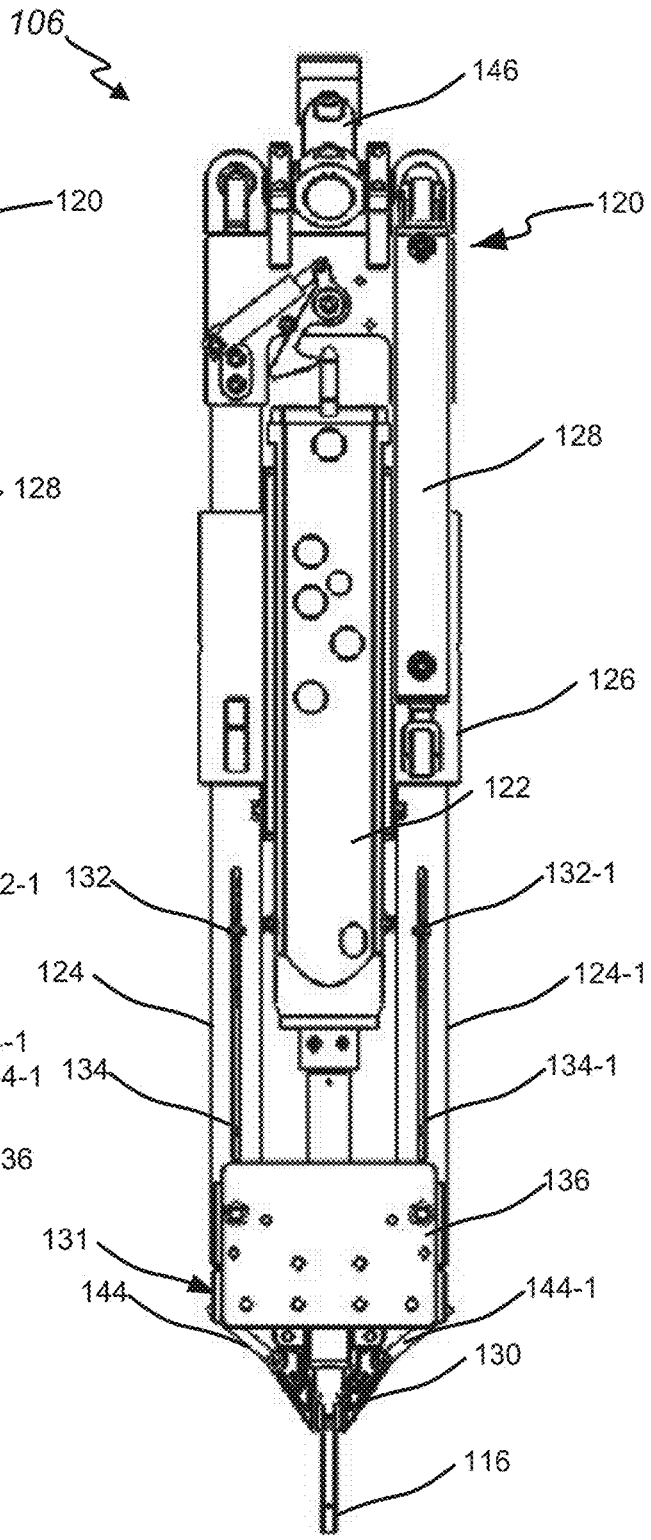
FIG. 4B depicts a side view of part of the fastener installer separated from the single-plane multifunctional railway component handling system, in accordance with disclosed embodiments of the present disclosure.

FIG. 4A depicts a perspective view of part of the fastener installer 106 separated from the single-plane multifunctional railway component handling system 100, in accordance with disclosed embodiments of the present disclosure. FIG. 4B depicts a side view of part of the fastener installer 106 separated from the single-plane multifunctional railway component handling system 100, in accordance with disclosed embodiments of the present disclosure. The portion of the fastener installer 106 depicted may correspond to the field-side installer 106-1 and/or the gage-side installer 106-2.

As depicted, the fastener installer 106 may include a dual shaft, in-line hammer assembly 120. The fastener installer 106 may include a hammer assembly 120 may include a hammer 122 disposed between dual shafts 124. For the sake of simplicity of description, a number of components may be generally referenced herein as the hammer 122 without distinguishing between the components. Such components may include what may be variously known in the art as a hammer, a hammer bushing, an anvil, an anvil sleeve, and/or the like, which together may comprise the assembly referenced herein as the hammer 122.

As illustrated in various figures, a pair of pivotally mounted hammer assemblies 120 may be configured in an opposing arrangement. In a deployed state, the hammer assemblies 120 may be disposed on opposite sides of the rail 108. Each fastener installer 106 may slidably connected with the rest of the workhead of the component handling system 100 via a dual-slide coupling. For example, referring more specifically to FIG. 2C, each fastener installer 106 may include one or more pivot cylinders 146 arranged to move each hammer assembly 120 about a respective pivot corresponding to a patterning slide shaft 148, with which the hammer assembly 120 may be slidably coupled via a hammer coupling 149. The pivot cylinder 146 may be a short-stroke cylinder and may be adapted to selectively extend and retract under direction of an operator and/or under direction of the control system 201 based at least in part on the sensor feedback described herein. The selective actuation of the pivot cylinder 146 may selectively push or pull the hammer assembly 120 and pivot the hammer assembly 120 about the corresponding pivot point. With that pivoting action, the hammer assembly 120 may move along a plane that is perpendicular or substantially perpendicular to the rail 108.

The pivot cylinder 146 may be slidably coupled with a dual-shaft anchor 150. The dual-shaft anchor 150 may be rigidly affixed to a slidable frame coupling 152 of a main shaft structure. In various embodiments, the pivot cylinder 146 and/or one or more other slidable couplings disclosed herein may include bearings to facilitate movement along respective shafts, in which instances, the movement may correspond to rolling movement rather than sliding movement.

Figure 2D:
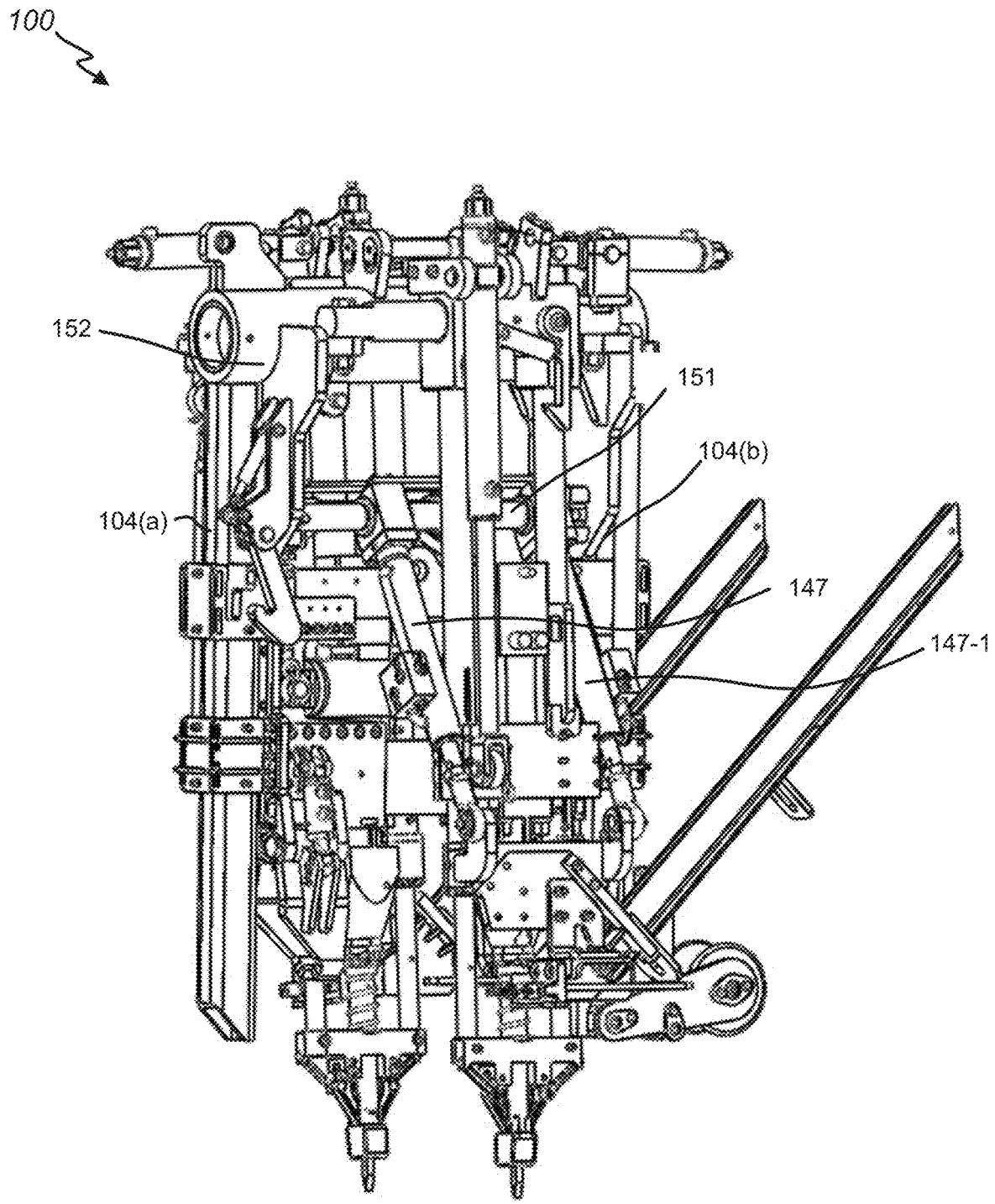
FIG. 2D depicts a partial perspective view of the portion of the single-plane multifunctional railway component handling system in the stowed position, in accordance with disclosed embodiments of the present disclosure.
Figure 2E:
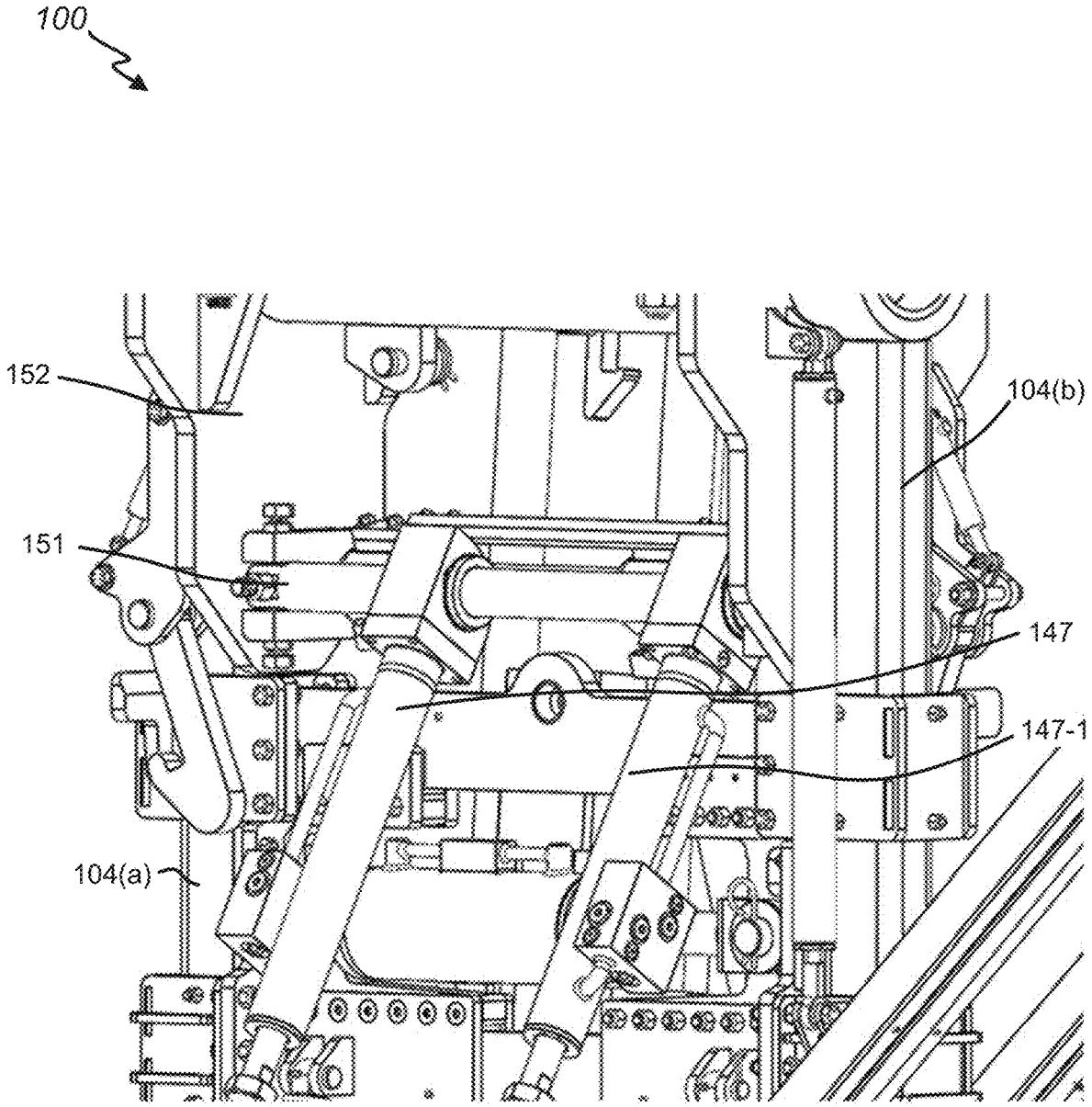
FIG. 2E depicts a close-up perspective view of a portion of the single-plane, multifunctional railway component handling system without a hammer assembly, in accordance with disclosed embodiments of the present disclosure.

FIGS. 2D and 2E shows an alternative embodiment where each fastener installer 106 may include one or more pivot cylinders 147 arranged to move each hammer assembly 120 about a respective pivot corresponding to a stabilizer shaft 151 that is attached the main shaft structure (e.g., a lower extension from the slidable frame coupling 152) between the legs 104(*a*), 104(*b*) of the frame 104. FIG. 2E shows a partial close-up view without a hammer assembly 120 for illustration. In various embodiments, the stabilizer shaft 151 may be rigidly affixed to the main shaft structure and/or the legs 104(*a*), 104(*b*). The pivot cylinders 147 may be slidably coupled with the stabilizer shaft 151. In some embodiments, the pivot cylinders 147 may include bearings to facilitate movement along the stabilizer shaft 151, in which instances, the movement may correspond to rolling movement rather than sliding movement.

Like the pivot cylinder 146, the pivot cylinders 147 may be adapted to selectively extend and retract under direction of an operator and/or under direction of the control system 201 based at least in part on the sensor feedback described herein. The selective actuation of the pivot cylinders 147 may selectively push or pull the hammer assembly 120 and pivot the hammer assembly 120 about the corresponding pivot point and along a plane that is perpendicular or substantially perpendicular to the rail 108. In the various embodiments, the pivot cylinder 146 and/or the pivot cylinders 147 may be further operable to selectively lock the hammer assembly 120 in place for hammer operations in order to provide stability to the hammer assembly 120.

Referring again to FIG. 2C, a main shaft cylinder 158 may be connected to the slidable frame coupling 152 and the hinge assembly 105. The main shaft cylinder 158 may be adapted to selectively extend and retract in order to selectively push or pull to move the slidable frame coupling 152 along the main shaft 156. With such action, all the components coupled to the slidable frame coupling 152, including the frame 104, the hammer assemblies 120, and structure of the anchor manipulator 102, may be positioned along a plane that is parallel or substantially parallel to the rail 108. In operation, the workhead, once positioned generally over a given railway tie 110, may utilize the main shaft cylinder 158 to further refine the positioning of the structure supported by the slidable frame coupling 152. Such positioning, along with any other positioning operations disclosed herein, may be directed by an operator and/or may be directed by the control system 201 based at least in part on the sensor feedback described herein.

Such positioning may also be relegated to an initial positioning refinement stage. After the initial positioning refinement stage, further positioning of the hammer assemblies 120 may be effected by way of the patterning slide cylinders 154 and the pivot cylinders 146 during fastener installation operations over a railway tie 110. Likewise, further positioning of the anchor manipulator 102 may be effected by way of a linkage cylinder 182 and a linkage system 180 during anchor installation operations over a railway tie 110. However, some embodiments may utilize the main shaft cylinder 158 in conjunction with the patterning slide cylinder 154 and/or the linkage cylinder 182 and linkage system 180 during installation operations even after the initial positioning of structure supported by the slidable frame coupling 152. The various positioning operations may provide an extended range of movement for the installation operations and may be directed by the control system 201 based at least in part on the sensor feedback disclosed herein.

The patterning slide cylinder 154 may be coupled to the hammer assembly 120. The patterning slide cylinder 154 may be a short-stroke cylinder and may be adapted to selectively extend and retract in order to selectively push or pull to move the hammer assembly 120 along the patterning slide shaft 148, which also moves the pivot cylinder 146 along the dual-shaft anchor 150. This movement may be along a plane that is parallel or substantially parallel to the rail 108. In various embodiments, such movement along the patterning slide shaft 148 may have a range, for example, from approximately five inches, five and a half inches, or more.

Accordingly, the dual-slide coupling of the pivot cylinder 146 and the hammer assembly 120 may allow the pivot cylinder 146 and the hammer assembly 120 to slide along the dual-shaft anchor 150 and the patterning slide shaft 148, respectively, in unison. This adjustment may allow for the hammer assembly 120 to perform fastener installation with respect to multiple fastener holes in tie plates 114, which, as disclosed herein, may be performed under control of the control system 201 and may accommodate various fastener hole patterns. In addition, compound, multi-axial movement of the lower structure of the hammer assembly 120 may be effected with simultaneous actuation of the pivot cylinder 146, as well as of the patterning slide cylinder 154. Actuation of the pivot cylinder 146 may move the hammer assembly 120 into a number of different positions so that the lower structure of the hammer assembly 120 may pivot toward or away from the rail 108 under control of the control system 201 to perform fastener installation in various positions, which may range, for example, from up against the foot of the rail 108 to several inches away from the rail 108. Such compound, multi-axial movement to adjust to various positions during fastener installation operations may advantageously increase the speed and efficiency of the process.

For ease of maintenance and accessibility, the patterning slide shaft 148 may be hingedly attached to the frame 104 at one end of the patterning slide shaft 148. The other end of the patterning slide shaft 148 may be fastened to the frame 104 with a single fastener that can easily be removed. When the fastener is removed, the hammer assembly 120 may be pivoted about the hinge attachment, outward away from the rest of the workhead. The pivoted position is illustrated by FIG. 1C.

Each hammer assembly 120, the field-side hammer assembly 120-1 and the gage-side hammer assembly 120-2, may be configured a separate circuit so that each may move independently of the other of the pair. Each hammer assembly 120 may be independently directed by the control system 201 to perform fastener installation according to different patterns of fastener holes in the tie plates 114, which may be different for field-side holes and gage-side holes, from tie plate 114 to tie plate 114, and from track to track. Each hammer assembly 120 may selectively adjust positioning and perform fastener installation independently from the other, as well as simultaneously as the other, which may include each moving at a different or equivalent rates.

Accordingly, such selective operations may advantageously adapt to a variety of different fastener hole patterns that may be encountered in the field. Such operations, as with all adjustments/operations of the component handling system 100, may be autonomously performed by the system 100, or initiated remotely by an operator in an operator's cab. With the autonomous mode, the system 100 may automatically detect a give fastener pattern with one or more sensors and operate the hammer assemblies 120 to match the fastener patterns. The control system 201 may independently direct each hammer assembly 120 to adjust and perform fastener installation according to the most efficient pattern for the particular hole layout in each tie plate portion. Thus, each hammer assembly 120 may operate asymmetrically to facilitate asymmetrical fastener installations, while efficiently avoiding unnecessary operations and adjustments. Further, in some instances, the obstructions such as railway components, electrical boxes, or other obstructions may create tight working spaces. Advantageously, the hammer assemblies 120 may asymmetrically adapt to avoid such obstructions and/or maneuver within such tight spaces.

Some embodiments may provide for automatic balancing or rebalancing of load with respect to the hammer assemblies 120. The system 100 may detect, with one or more sensors such position, torque, load sensors, or other sensors disclosed herein, an off-balance loading situation caused by positions of the hammer assemblies 120. For example, an off-balance loading situation may occur when both hammer assemblies 120 are positioned too much toward the same side. If such an off-balance load is detected, the control system 201 may override previous positioning directions and rebalance the hammer assemblies 120 by repositioning one or both hammer assemblies 120 until a satisfactory balance threshold is satisfied. In some embodiments, off-balance loads may be preemptively avoided by the system 100. For example, when one hammer assembly 120 is positioned beyond a certain distance (absolute distance from a reference point of the workhead or a relative distance with respect to the other hammer assembly 120), the system 100 may automatically move one or both hammer assemblies 120 to avoid an off-balance load.

In some embodiments, the component handling system 100 may be controlled by the control system 201 with sensor feedback (e.g., via position sensors detecting positions of the hammer assemblies 120 and/or components associated therewith) to operate in a mode where the hammer assemblies 120 always move simultaneously in a manner that maintains a balanced state. With that mode of operation, when one hammer assembly 120 moves one direction at a particular rate, the other hammer assembly 120 may move in the same or opposite direction at the same rate. The simultaneously movement of the hammer assemblies 120 may maintain positional symmetry with respect to a distance between one or more centerlines between the hammer assemblies 120 (e.g., a centerline of the workhead parallel to the rail 108 and/or a centerline perpendicular to the rail 108). Stated otherwise, the centerlines of the hammer assemblies 120 may be maintained at the same distance from one or more centerline of the component handling system 100. Such a mode of operation may be selectable in disclosed embodiments.

The hammer 122 may be slidably coupled with the dual shafts 124 via a slidable coupling 126. In some embodiments, the hammer 122 may be attached to the slidable coupling 126 via four bolts, which are illustrated in FIGS. 2A and 2B. Advantageously, the hammer 122 may be easily removed for maintenance in such embodiments by removing those four bolts.

Referring to the details illustrated in FIGS. 4A and 4B, one or more driving cylinders 128 may be drivably connected to the hammer 122 so that the control system 201 may control the one or more driving cylinders 128 to raise the hammer 122 and lower the hammer 122 with driving force to drive a fastener 116 that is retained by jaws 130 of a jaw assembly 131. The depicted embodiment utilizes a single cylinder 128 drivingly connected to the hammer 122. Other embodiments may utilize multiple cylinders 128 drivingly connected to the hammer 122, e.g., opposing cylinders 128 connected to the slidable coupling 126 in opposing/symmetrical positions with respect to the hammer 122. When the one or more driving cylinders 128 raise and lower the hammer 122, the slidable coupling of the hammer 122 and the shafts 124 allows the hammer 122 to slide along the shafts 124 while transferring minimal to no load onto the shafts 124. FIGS. 4A and 4B illustrate embodiments with a driving cylinder 128 disposed in one particular position with respect to the hammer 122; other figures, such as FIG. 3, illustrate embodiments with a driving cylinder 128 disposed in another particular position with respect to the hammer 122.

Figure 4C:
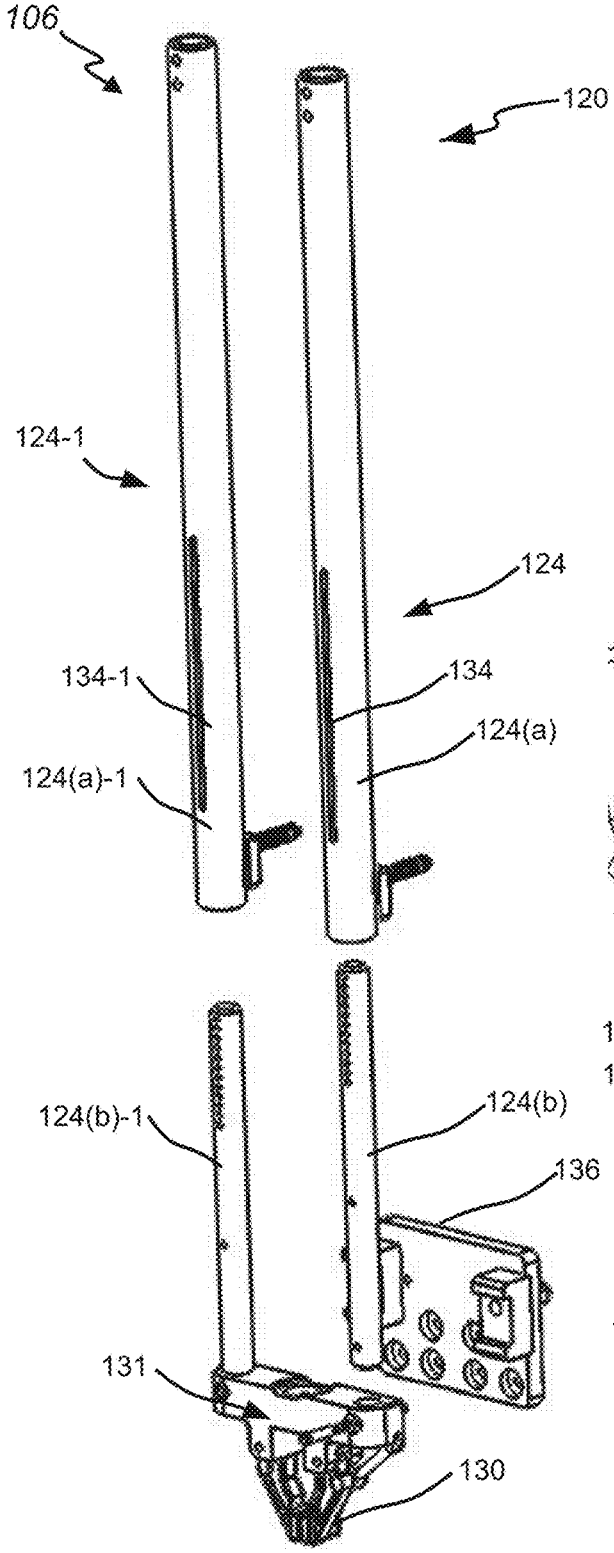
FIG. 4C depicts an exploded view of part of the hammer assembly, in accordance with disclosed embodiments of the present disclosure.

FIG. 4C depicts an exploded view of part of the hammer assembly 120, in accordance with disclosed embodiments of the present disclosure. As illustrated in FIG. 4C, the dual shafts 124 may include concentric shafts 124(*a*) and 124(*b*) configured to allow movement of the inner shaft 124(*b*) with respect to the outer shaft 124(*a*) when the driving cylinder 128 raises and lowers the hammer 122. The shafts 124 may allow for jaw 130 movement up and down concentric with the shafts 124, again in line with load. Thus, in operation, the hammer 122 and the jaws 130 may move in parallel with the shafts 124 and in line with the hammering load.

To facilitate fastener driving, the hammer assembly 120 may be configured for a two-stage driving operation under direction of an operator and/or the control system 201. FIGS. 4A and 4B illustrate the hammer assembly 120 as it may be in an initial ready position. From the initial ready position, the hammer assembly 120 may transition to a first stage of the driving operation. In the first stage, the driving cylinder 128 may begin to drive the hammer 122 downward such that a shaft of the hammer 122 may move through an orifice of the jaw assembly 131. As the driving cylinder 128 drives the hammer 122 downward, the hammer 122 drives the jaw assembly 131 downward via forces imparted through a hammer spring member 123. While the hammer spring member 123 is omitted from FIGS. 4A through 4F for the sake of clarity of illustration, the hammer spring member 123 is illustrated in FIG. 4G (described below). The driving forces of the hammer 122, through the hammer spring member 123 and against the jaw assembly 131 fixedly attached to the inner shaft 124(*b*), may cause the jaw assembly 131 and the inner shaft 124(*b*) to move with respect to the outer shaft 124(*a*) until a limiting component 132 bottoms out in a groove 134. The limiting component 132, which is illustrated in FIGS. 4A and 4B, may, for example, correspond to a bolt, lug, and/or the like.

In the second stage of the driving operation, as the driving cylinder 128 continues to drive the hammer 122 downward, the inner shaft 124(*b*) no longer moves with respect to the outer shaft 124(*a*), such movement being prevented by the limiting component 132 having bottomed out in the groove 134. The jaw assembly 131, being fixedly attached to the inner shaft 124(*b*), likewise no longer moves downward in the second stage. FIG. 4G depicts a side close-up view of part of the fastener installer 106 at one point in a fastener driving operation, in accordance with disclosed embodiments of the present disclosure. The depicted point in the driving operation may correspond to a point in the second stage. The example of FIG. 4G depicts the hammer assembly 120 driving a fastener 116 through the jaws 130, through a hole of the tie plate 114, and into the tie 110. At that point, the head of the hammer 122 has been driven between the spring-loaded jaws 130. For the sake of clarity in illustration, the jaws 130 are illustrated as positioned away from the hammer 122 in FIG. 4G and spring components are not shown in that figure. FIG. 411 depicts a perspective close-up view of part of the fastener installer 106 at a similar point in a fastener driving operation, but with more detail.

After the hammer stroke of the hammer 122 is complete, the hammer 122 may return to first stage position and the initial ready position at least in part by release or active retraction of the hammer cylinder 128 in conjunction with spring forces of the hammer spring member 123, as well as reactive forces from the hammer strike. Once back in the ready position, another faster 116 may be racked into the jaws 130 and the hammer assembly 120 may be positioned, under direction of the control system 201, for the next driving operation or to accommodate other operations, such as anchor installation, transition to another tie plate 110, and/or the like.

Figure 4D:
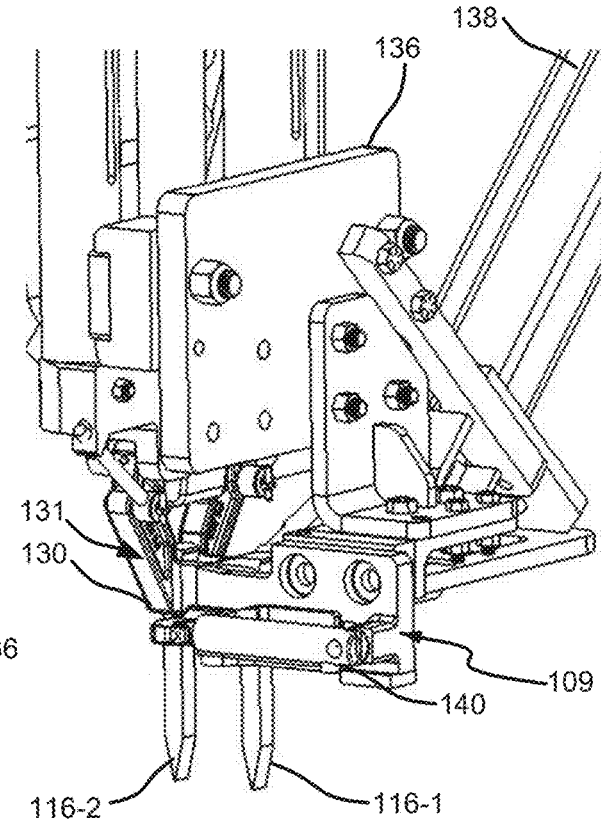
FIG. 4D depicts a perspective close-up view of part of the fastener installer with a partial view of the feed subsystem coupled with the fastener installer, in accordance with disclosed embodiments of the present disclosure.
Figure 4E:
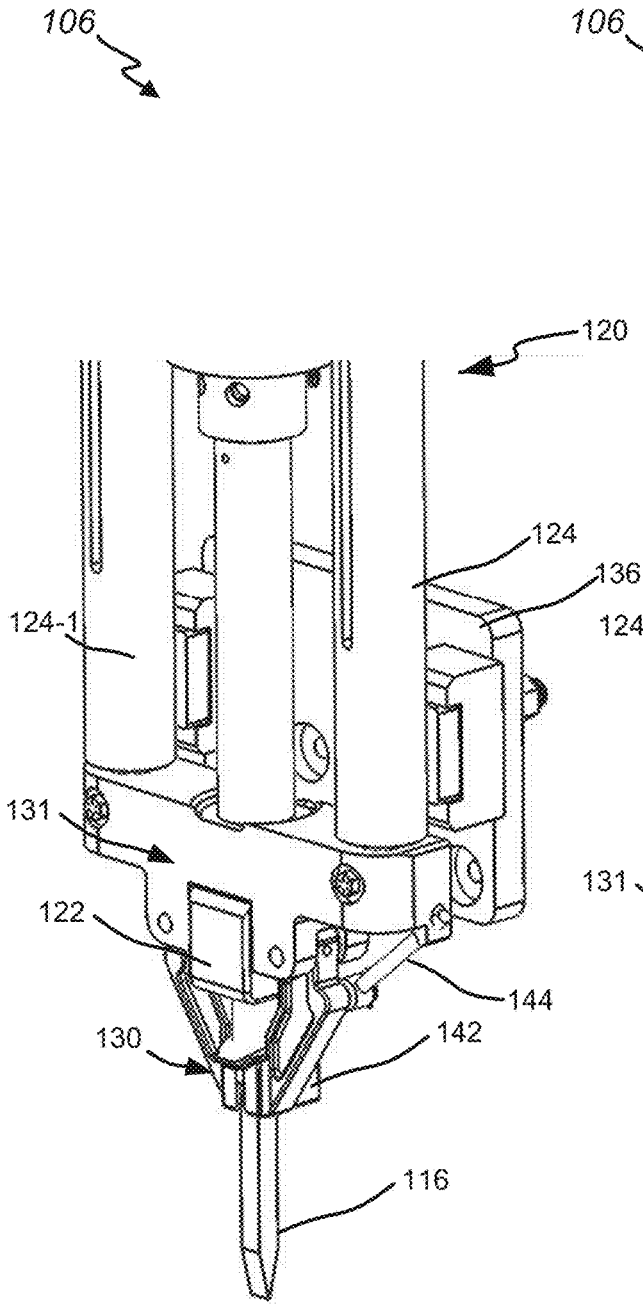
FIG. 4E depicts a perspective close-up view of part of the fastener installer separated from the feed subsystem, in accordance with disclosed embodiments of the present disclosure.
Figure 4F:
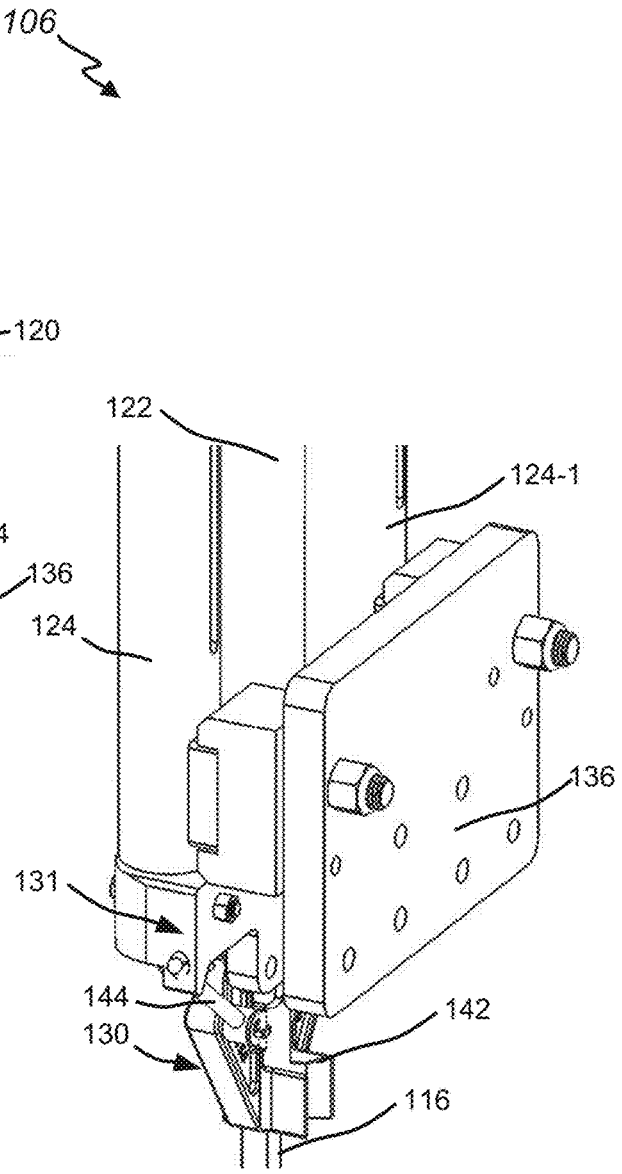
FIG. 4F depicts another perspective close-up view of part of the fastener installer separated from the feed subsystem, in accordance with disclosed embodiments of the present disclosure.
Figure 4G:
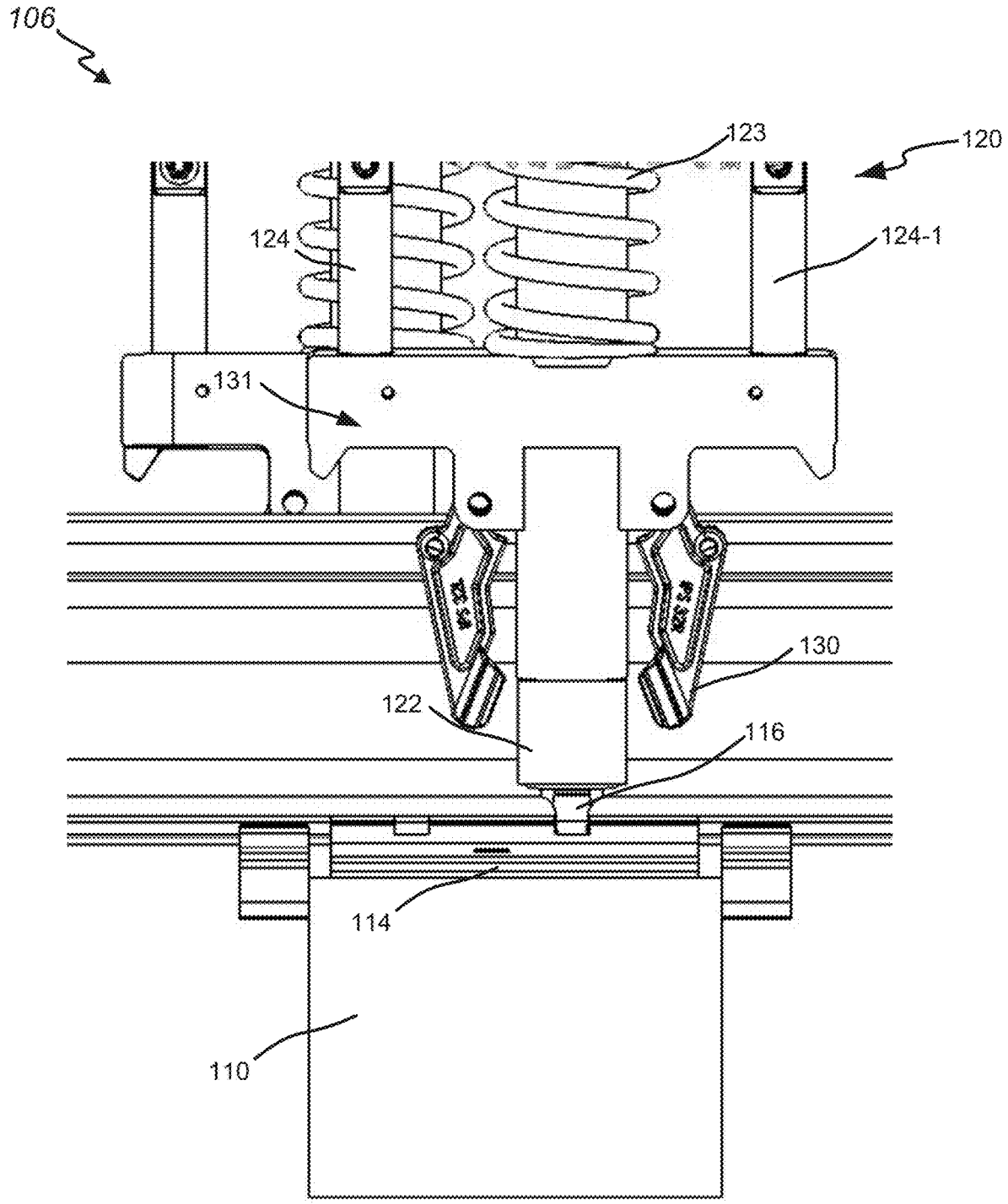
FIG. 4G depicts a side close-up view of part of the fastener installer at one point in a fastener driving operation, in accordance with disclosed embodiments of the present disclosure.
Figure 4H:
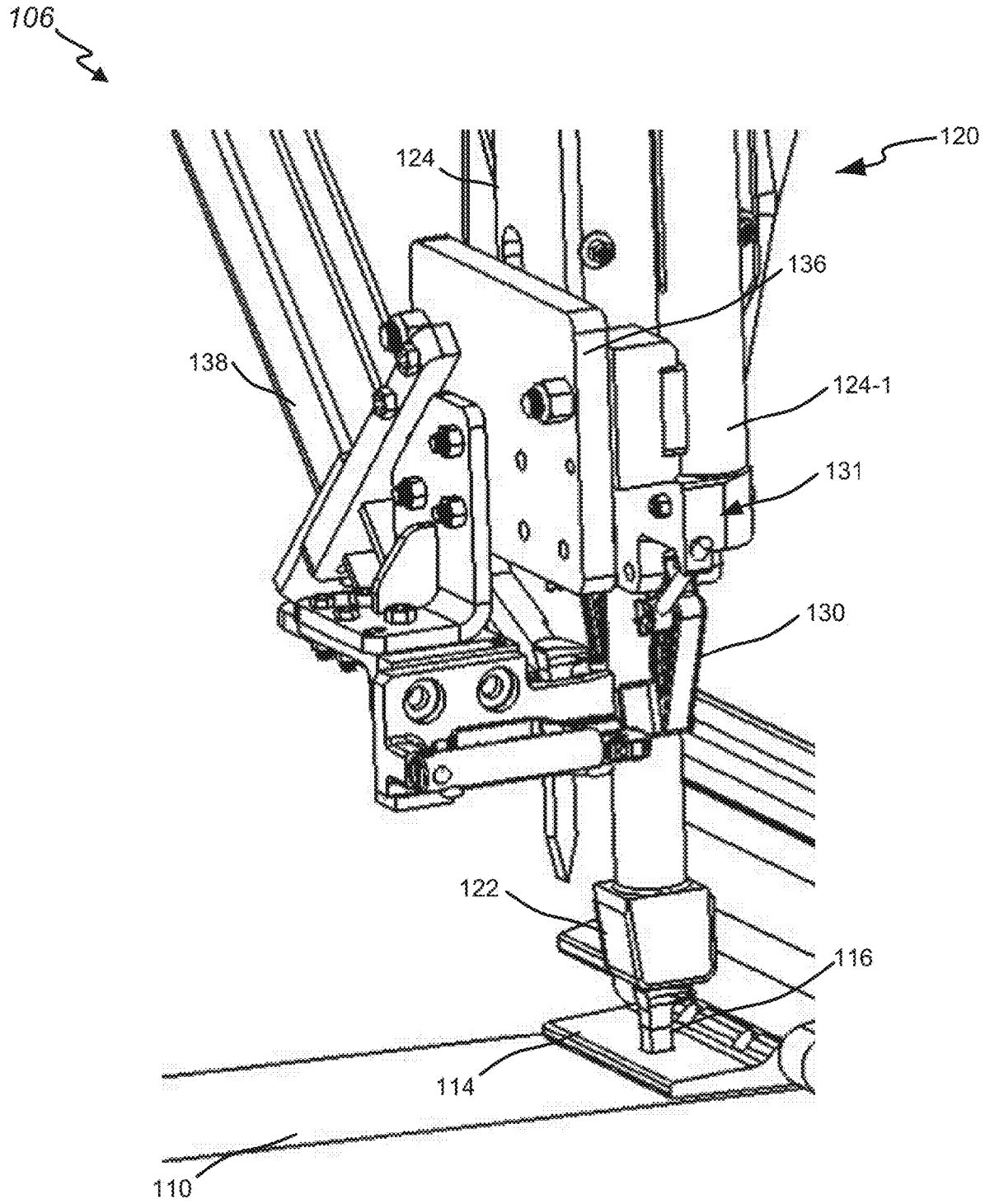
FIG. 4H depicts a perspective close-up view of part of the fastener installer at a similar point in a fastener driving operation, in accordance with disclosed embodiments of the present disclosure.

FIG. 4D depicts a close-up perspective view of part of the fastener installer 106 with a partial view of the feed subsystem 109 coupled with the fastener installer 106, in accordance with disclosed embodiments of the present disclosure. FIG. 4E depicts a close-up perspective view of part of the fastener installer 106 separated from the feed subsystem 109, in accordance with disclosed embodiments of the present disclosure. FIG. 4F depicts another close-up perspective view of part of the fastener installer 106 separated from the feed subsystem 109, in accordance with disclosed embodiments of the present disclosure.

The hammer assembly 120 may be configured to accept fasteners 116 from the feed subsystem 109. The fastener installer 106 may be coupled with the feed subsystem 109 by way of a feed subsystem interface 136. As illustrated, the feed subsystem interface 136 may be matingly engaged with a mating stud of the shafts 124. The feed subsystem interface 136 may be fastened to the shafts 124 and may be configured for quick attachment to, and detachment from, the feed subsystem 109, allowing for ease of maintenance.

The feed subsystem 109, under control of the control system 201, may include a slide 138 configured to urge feed individual fasteners down the slide 138 to a ready position adjacent to jaws 130 of a jaw assembly 131 of the fastener installer 106. In FIG. 4D, the fastener 116-1 is depicted in the ready position adjacent to the jaws 130. In the ready position, the fastener 116-1 may be adjacent to a fastener loader 140 of the feed subsystem 109. The fastener loader 140 may include a cylinder and may be communicatively coupled the control system 201. From the ready position, the fastener loader 140, under control of the control system 201, may drive the fastener 116-1 toward the jaws 130 by actuation of the cylinder. In this manner, the fastener loader 140 may rack the fastener 116-1 into the jaws 130. In mechanical operation, the feed subsystem 109 may mechanically operate in any suitable manner, however the feed subsystem 109 is advantageously controlled and configured to work in conjunction with components of the fastener-installing subsystem 106, under control of the control system 201, to effect the improvements of various embodiments disclosed herein.

The jaws 130 may include open, opposing guide members 142, more clearly illustrated in FIG. 4F, to facilitate receiving a fastener 116 from the fastener loader 140 and allowing the driven fastener 116 to slide along the opposing guide members 142, which action imparts forces on the guide members 142 to open the jaws 130 to fully receive the loaded fastener 116. The jaws 130 may be formed to grip the loaded fastener 116 when the fastener 116 is seated in the jaws 130. FIGS. 4E and 4F, for example, show the fastener 116 seated in the jaws 130 and in full engagement by the jaws 130. When the fastener 116 is seated in the jaws 130, the jaws 130 may grip the fastener 116 by way of forces imparted by spring members 144 (springs not shown). With the spring members 144, the jaws 130 may be spring-loaded to a normally closed position. Referring again to FIG. 4D, the fastener 116-2 is illustrated as seated in full engagement by the jaws 130. Accordingly, the hammer assembly 120 may be configured for loading and retaining the fasteners 116 in the jaw assembly 131.

The dual shaft, in-line hammer assembly 120 provides technical improvements that yield a number of advantages over conventional approaches and that solve problems left unsolved by conventional approaches. Not only does the hammer assembly 120 provide for improved structural integrity while providing a compact configuration, but also the hammer assembly 120 allows for a reduced number of components as compared to conventional approaches. With the hammer assembly 120, the actual physical wear on the components is minimized, as the hammer assembly 120 may be configured so that key components are in line with the hammering load. The configuration eliminates or mitigates cantilever loading from offset, cantilevered, or otherwise overhanging components which would cause moments that, in conjunction with percussive hammering load, would otherwise accelerate wear on the components. As noted previously, cantilever loading on the guide shafts 124 may be eliminated or minimized at least in part because components are in line with the hammering action. The hammer forces may be absorbed by the driving cylinder 128 and upper structure. The compact configuration of the dual shaft, in-line hammer assembly 120 may further allow for minimized use of space to allow for multifunctional aspects of the embodiments disclosed herein. Accordingly, the hammer assembly 120 may allow for maximal functionality in minimal space.

In addition, the hammer assembly 120 may provide for improved structural integrity to handle lateral loads that may not uncommonly be a result of operators using the hammer assembly 120 in various ways beyond driving fasteners 116. As one example, an operator may use the hammer assembly 120 in a process of laterally adjusting the position of the tie plate 114. In such cases, the operator may lower the bottom of the anvil sleeve on the tie plate 114 and activate the hammer (percussive) function while dragging the tie plate 114 by way of the anvil sleeve and activation of a cylinder in the upper structure. This technique can be very damaging to the anvil sleeve and the bushings that support the small guide rods and can cause accelerated wear. To address that problem, the shafts 124 may be dimensioned with sufficient size (e.g., 1.375-inch diameters or larger), the jaw assembly 131 may be dimensioned (e.g., 9 inches center-to-center) to accommodate the shafts 124 of that size, and the in-line aspects of the shafts 124 may be configured to provide suitable lateral support.

Figure 4I:
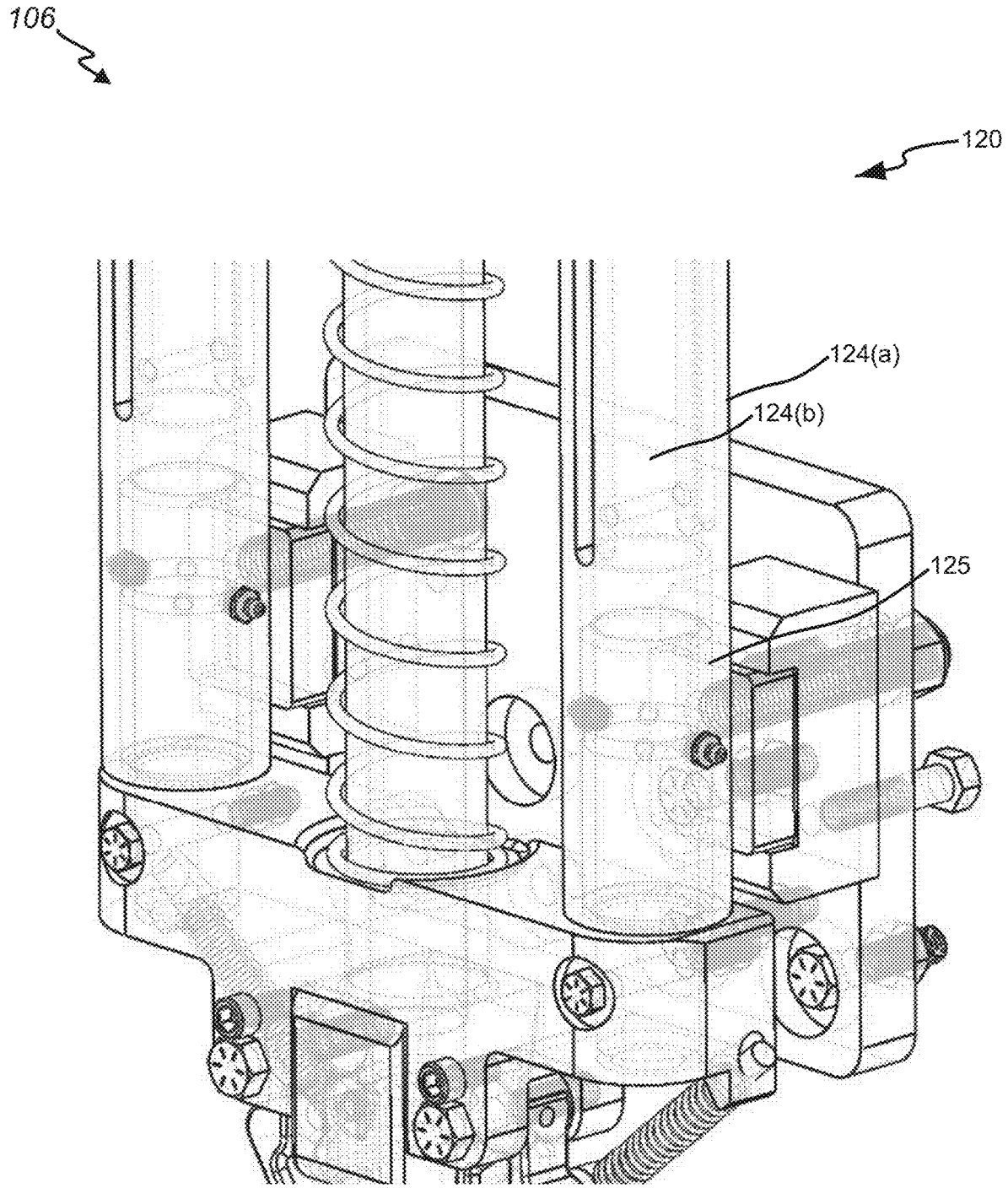
FIG. 4I depicts a close-up view of part of the hammer assembly to illustrate a portion of the dual-shaft configuration of the shafts, in accordance with disclosed embodiments of the present disclosure.

FIG. 4I depicts a close-up view of part of the hammer assembly 120 to illustrate a portion of the dual-shaft configuration of the shafts 124(*a*), 124(*b*), in accordance with disclosed embodiments of the present disclosure. As part of the technical improvements provided by the hammer assembly 120, each dual-shaft configuration may include an elongated shaft bushing 125 inside an annulus between outer shaft 124(*a*) and the inner shaft 124(*b*). The shaft bushing 125 may provide sliding support for the inner shaft 124(*b*) such that the inner shaft 124(*b*) may slide with respect to the shaft bushing 125, while the shaft bushing 125 adds lateral support for the inner shaft 124(*b*). The dual-shaft configuration may allow the shaft bushing 125 to have a sufficient length (e.g., approximately five inches or more) and corresponding surface area to react against lateral loads. This may allow the shaft bushing 125 to not only provide lateral support but also may increase durability of the shaft bushing 125, which would otherwise be a high-failure component due to the lateral loading.

In addition, the dual-shaft configuration may allow for ease of maintenance when the hammer assembly 120 is in a working position. For example, the limiting components 132 may be easily removed. This may allow the inner shafts 124(*b*) and the jaw assembly 131 to be detached from the rest of the hammer assembly 120.

Various embodiments may include a plurality of sensors (e.g., one or a combination of position sensors, measurement sensors, distance sensors, proximity sensors, cameras for optical recognition, image analysis, metrics, and recognition, motion sensors, light sensors, ambient light photo sensors, photodiode photo sensors, optical detectors, photo detectors, color sensors, and/or the like) in order to facilitate operations, such as automatic alignment of the hammer assemblies 120 and the anchor manipulator 102 with railway components (e.g., fasteners, anchors, tie plates, and/or railway ties), automatic fastener installation, automatic anchor adjustment and tie plate, and other adjustment operations disclosed herein, any one or combination of which operations may be performed under control of the control system 201. One or more of the sensors may be attached to any suitable element of the component handling system 100 and disposed to capture data indicative of the positioning and/or other characteristics of aspects of the hammer assemblies 120, the anchor manipulator 102, the fasteners 116, fastener patterns, the tie plates 114, holes in the tie plates 114, the anchors 114(*a*), 114(*b*), the ties 110, and/or the rail 108. By way of example, one or more sensors (e.g., a linear variable differential transformer (LVDT) sensor) may be coupled to each of one or a combination of the cylinders 128, 142, 146, 147, 154, 158, 174, 182, 183 to detect positioning of the respective cylinder. Disclosed embodiments may learn and infer positions of fastener holes in tie plates 114 based at least in part on the detected positions of the cylinders, with sensors having sensor sensitivity within a few thousandths of an inch. Additional disclosed embodiments may utilize such position sensors in conjunction with other types of sensors, such as one or a combination of the sensor types above, to learn and detect positions of fastener holes, as well as other aspects described further herein.

The patterning slide cylinder 154 and/or one or more of the other cylinders of the system 100 may correspond to a trunnion-mounted cylinder. One or more of the sensors may be coupled to base ends of the trunnion-mounted cylinders to facilitate serviceability. This may allow for ease of maintenance, such that the one or more sensors may be replaced without having to replace the entire cylinder. In like manner, each of the other cylinders of the component handling system 102 may be trunnion-mounted with the associated one or more sensors to a base end of the respective cylinder to facilitate serviceability.

In various embodiments, one or more sensors may be disposed on the workhead to have various fields of view to detect various features such as positions, surfaces, edges, contours, relative distances, and/or any other suitable indicia of the elements of the system 100 (e.g., the anchor manipulator 102 and/or the fastener installer 106) and/or railway components (e.g., fasteners, anchors, tie plates, and/or railway ties). For example, the one or more sensors may include one or more cameras mounted and attached in any suitable manner to the frame 104 to have fields of view to capture images and/or other indicia of various aspects of the railway ties 110, the tie plates 114, the holes of the tie plates 114, and/or the rail 108. The one or more sensors may be attached to the forward leg 104(*a*), the rear leg 104(*b*), and/or a component of the upper structure of another part of the workhead.

Each of the sensors of disclosed embodiments may be communicatively coupled to a receiver of the control system 201 via wired or wireless communication channels. The sensors, receiver, and/or control system 201 may include any suitable sensors, controller(s), processor(s), memory, communication interface(s), and other components to facilitate various embodiments disclosed herein. The sensors, receiver, and/or control system 201 may include any sensor circuitry necessary to facilitate the various embodiments, including without limitation any one or combination of analog-to-digital converter circuitry, multiplexer circuitry, amplification circuitry, signal conditioning/translation circuitry, and/or the like. The data captured by the one or more sensors may be used by the control system 201 to detect positioning and facilitate system-directed positioning and installation operations of the hammer assemblies 120 and the anchor manipulator 102.

Figure 5:
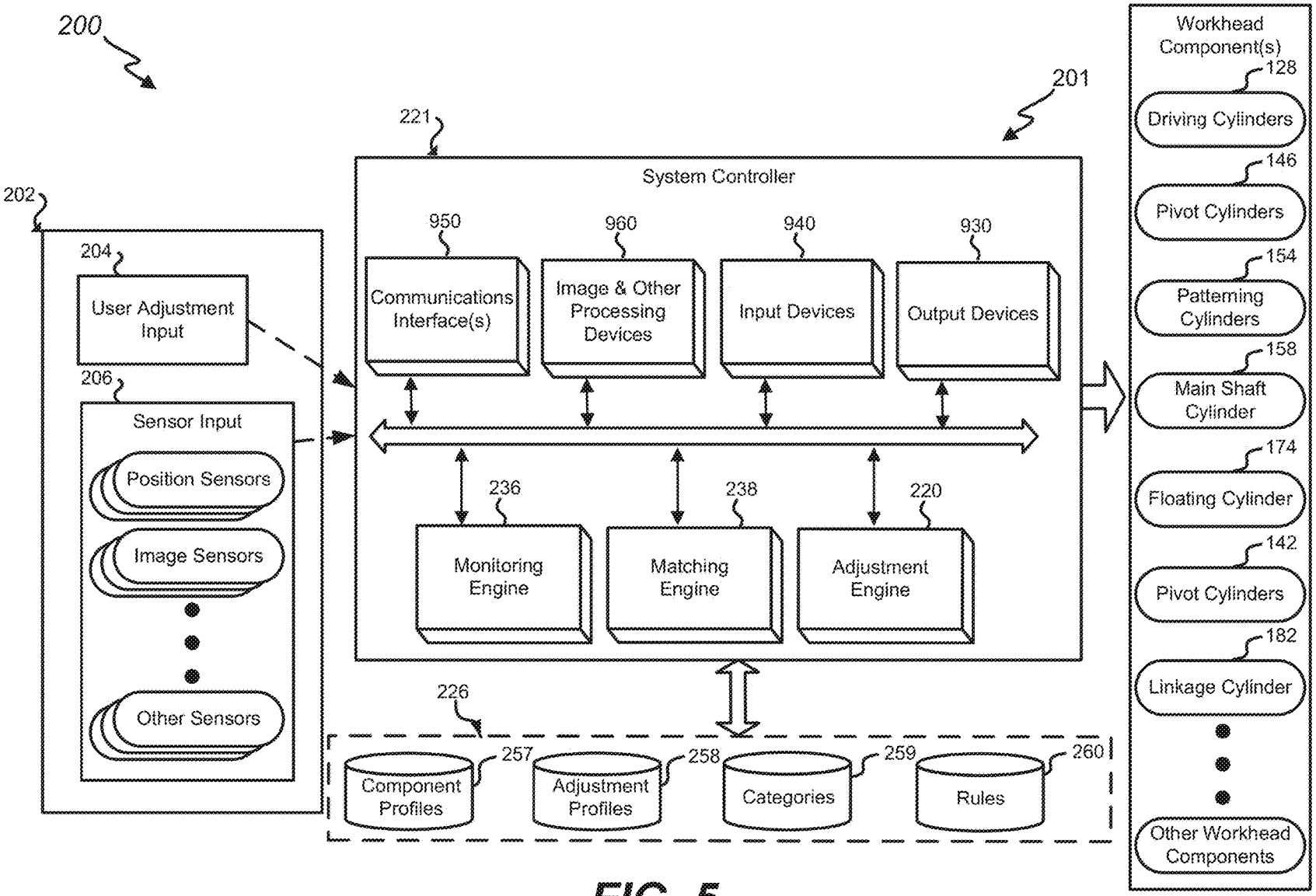
FIG. 5 illustrates a subsystem corresponding to the control system to facilitate component handling system automation control, in accordance with disclosed embodiments of the present disclosure.

FIG. 5 illustrates a subsystem 200 corresponding to the control system 201 to facilitate component handling system 100 automation control, in accordance with disclosed embodiments of the present disclosure. The subsystem 200 may be included in or otherwise control aspects of the railway component handling system 100. While the subsystem 200 is illustrated as being composed of multiple components, it should be understood that the subsystem 200 may be broken into a greater number of components or collapsed into fewer components. Each component may include any one or combination of computerized hardware, software, and/or firmware. In various embodiments, the subsystem 200 may include a system controller and/or control engine 221, executed by one or more processors and may be implemented with any suitable device, such as a computing device, a standalone system controller device, a system controller device integrated with another device, such as operator station control device, etc. The system controller 221 may be located in or about the operator's cab. In some embodiments, the system controller 221 may be located at the workhead, being attached to the upper structure of the workhead.

The system controller 221 may include communications interfaces 950, image processing and other processing devices 960, input devices 940, output devices 930, and other components disclosed herein. Some of such components are discussed further in reference to FIG. 9. As illustrated in FIG. 5, the system controller 221 may be communicatively coupled with interface components and communication channels (which may take various forms in various embodiments as disclosed herein) configured to receive adjustment input 202 via the communications interfaces 950 and/or input devices 940. As depicted, the adjustment input 202 may include user adjustment input 204. The user input 204 may include real-time user control via a user interface—e.g., one or more interfaces provided via the operator station. User input may be provided by way of one or more user input devices, such as a touchscreen, a mouse, a track ball, a keyboard, buttons, switches, control handles, and/or the like.

The adjustment input 202 may further include the sensor input 206 disclosed herein. As described above, disclosed embodiments of the component handling system 100 may include a plurality of sensors (e.g., position sensors, measurement sensors, distance sensors, proximity sensors, cameras for optical recognition, image analysis, metrics, and recognition, and/or the like) attached to any suitable structural element of the component handling system 100. For example, one or more sensors may be attached to one or more of the cylinders and/or the frame 104. The one or more sensors may be disposed to capture sensor data that facilitates automatic alignment, installation, and adjustment operations by detecting various features such as positions, appearance, surfaces, edges, contours, relative distances, and/or any other suitable indicia of the elements of the component handling system 100 (e.g., the anchor manipulator 102 and/or the fastener installer 106) and/or railway components (e.g., fasteners, anchors, tie plates, railway ties, the rail, and/or the like) in accordance with disclosed embodiments.

For example, in disclosed embodiments, signals from a plurality of sensors may be utilized by the control system 201 to detect movement and positioning of the workhead components, such as the components of the anchor manipulator 102 and the fastener installer 106. Additionally, signals from the plurality of sensors may be utilized by the control system 201 to detect and recognize railway components, fasteners, anchors, tie plates, railway ties, the rail, and/or the like railway components. Further, in disclosed embodiments, signals from the plurality of sensors may be utilized by the control system 201 to detect and recognize railway components, fasteners, anchors, tie plates, railway ties, and rails. Still further, signals from the plurality of sensors may be utilized by the control system 201 to detect obstructions, such as electrical boxes, stones, and other foreign objects. Hence, the sensors may be disposed to capture and sense data that facilitates one or a combination of the automatic detection, recognition, learning, positioning, installation, adjustment, and patterning features disclosed herein.

Sensors and control units may be coupled and connected in a serial, parallel, star, hierarchical, and/or the like topologies and may communicate to the control system 201 via one or more serial, bus, or wireless protocols and technologies which may include, for example, Wi-Fi, CAN bus, Bluetooth, I2C bus, ZigBee, Z-Wave and/or the like. For instance, one or more sensors and control units may use a ZigBee® communication protocol while one or more other devices communicate with the receiver using a Z-Wave® communication protocol. Other forms of wireless communication may be used by sensors, control units, and the control system 201. For instance, sensors, control units, and the control system 201 may be configured to communicate using a wireless local area network, which may use a communication protocol such as 802.11.

In some embodiments, a separate device may be connected with the control system 201 and/or the operator's station to enable communication with railway component adjustment devices. The separate device may be configured to allow for Zigbee®, Z-Wave®, and/or other forms of wireless communication. In some embodiments, the control system 201 and/or the operator's station may be enabled to communicate with a local wireless network and may use a separate communication device in order to communicate with sensors and control units that use a ZigBee® communication protocol, Z-Wave® communication protocol, and/or some other wireless communication protocols.

Utilizing the processing devices 960, the subsystem 200 may process sensor input 206 and analyze the sensor input 206 to provide for the railway component adjustment automation control of one or more aspects of the component handling system 100. The sensor input 206 may be captured by any or combination of the sensors/detectors disclosed herein to facilitate detection, recognition, and differentiation of one or combination of types of features, railway components, positions, objects, appearances, movements, directions of movements, speeds of movements, device use, and/or the like. For example, the sensor input 206 may include location data, such as any information to facilitate detection, recognition, and differentiation of one or combination of locations of one or more components of the component handling system 100, such as components of the hammer assemblies 120 and the anchor manipulator 102, and/or railway components (e.g., fasteners, anchors, tie plates, railway ties, the rail, and/or the like) in and/or about the component handling system 100.

The railway component adjustment automation control may direct the fastener installation processes disclosed herein, as well as the anchor installation processes disclosed herein. For example, as disclosed herein, the anchor installation processes may include move the railway anchors 114(*a*), 114(*b*) along the underside of the rail 108 (after the anchors have been attached to the rails by conventional means) toward the vertical faces of the railway tie 110 and toward the tie plate 114 until the railway anchors 114(*a*), 114(*b*) are in an installed position. While the following description may focus more to a certain extent on the use case of automation control of aspects of fastener installation, such features and description are likewise applicable to the anchor installation processes. In some embodiments, a monitoring engine 236 may gather and process adjustment input 202 to facilitate creation, development, and/or use of railway adjustment profiles 226. The railway adjustment profiles 226 may include railway component profiles 257, such as the tie plate profiles and anchor profiles disclosed herein. The railway adjustment profiles 226 may include adjustment action profiles 258, such as the fastener, tie plate, and anchor installation patterns and processes disclosed herein. The railway adjustment profiles 226 may include categories 259, such as reference image and characteristic data compiled, utilized, and refined via machine learning to facilitate the recognition, characterization, and categorization of railway components disclosed herein. The railway adjustment profiles 226 may include rules 260 for handling the thresholds, operator selections, exceptions, inconsistencies, nonconformities, errors, operational modes, and/or the like disclosed herein.

The railway adjustment profiles 226 may include any suitable data that may be captured to indicate, infer, and/or determine component and adjustment identification, actions, locations, temporal factors, contexts, and patterns for components and/or adjustments. In various embodiments, the railway adjustment profiles 226 may be implemented in various ways. For example, one or more data processing systems may store the profile data. One or more relational or object-oriented databases, or flat files on one or more computers or networked storage devices, may store the profile data. In some embodiments, a centralized system stores the profile data; alternatively, a distributed/cloud system, network-based system, such as being implemented with a peer-to-peer network, or Internet, may store the profile data. The various aspects of the profiles data repositories 226 may be stored separately or consolidated into one repository.

In some embodiments, the controller 221 may include a matching engine 238 that may be an analysis engine. The matching engine 238 may be configured to perform any one or combination of features directed to matching or otherwise correlating information—and, in some embodiments, implementing machine learning—about components, action data, location data, temporal data, and/or the like. The captured data may be aggregated, consolidated, and transformed into refined profiles 226. In some embodiments, the monitoring engine 236 and/or the matching engine 238 may facilitate one or more learning/training modes. Some embodiments may perform image analysis of image data captured with cameras on one or more components of the component handling system 100 and/or other associated devices to determine one or more image baselines for railway components. Captured railway image data may be correlated to reference images using any suitable railway component traits for correlation.

For example, in some embodiments, the matching engine 238 may determine component characteristics based at least in part on adjustment input 202 received and processed by the monitoring engine 236. The matching engine 238 may define attributes of a railway component sensed based at least in part on the particular characteristics. The matching engine 238 may link railway image data to railway component profiles with image data associated with railway components, to determine identities of railway components. The reference image data may be refined over time as image baselines for particular railway components are developed with additional data captures. Such reference images may be used by the system to identify inconsistencies/nonconformities with respect to particularized patterns. When the system captures new images of a detected tie plate 114, a detected set of one or more fasteners 116, a detected anchor(s) and/or other objects detected proximate thereto, the system may analyze the image and perform comparative analyses of the detected tie plate 114, a detected set of one or more fasteners 116, a detected anchor(s) and/or other objects detected proximate thereto, with respect to reference image data and/or other tie plate, fastener, anchor, and/or other object profile 257 information to determine consistencies and identify any inconsistencies. With such comparative analyses, the system 201 may provide error checking and correction for instances where an operator makes a selection that does not match the detected railway components and/or other objects. For example, the system may determine one or more inconsistencies between a selected template for a tie plate configuration/pattern and detected fasteners, holes, and/or dimensions of a detected tie plate 114, where the template-specified holes do not match the detected fasteners, holes, and/or dimensions of the detected tie plate 114. The control system 201 may determine one or more inconsistencies between a selected pattern of fastener holes or other selections of fastener holes location(s) as targets for fastener installation and detected fasteners, holes, and/or dimensions of a detected tie plate 114, where the selections do not match the detected fasteners, holes, and/or dimensions of the detected tie plate 114. For instance, the control system 201 may recognize a fastener or other obstruction already in place in a fastener hole targeted for fastener installation. In such instances, the control system 201 may either pause installation operations and alert the operator via the user interface regarding the recognized fastener or unidentified obstruction, or skip the fastener installation operation for that fastener hole and proceed with one or more other installation operations while alerting the operator for subsequent inspection and remediation as necessary. Which measures the control system 201 employs may be operator-selectable.

Thus, the system 201 may provide error checking and correction for instances where an operator misidentifies a fastener installation target (e.g., identifying a fastener hole via the user interface in a position where there is no fastener hole detected, overlooks a fastener hole by not selecting the fastener hole via the user interface for extraction, or selects an obstructed fastener hole or already fastened hole for fastener installation), and/or where the operator misidentifies as a template a fastener hole and tie plate configuration/pattern where the fasteners and/or fastener holes do not match the detected fasteners and/or fastener holes of the detected tie plate (e.g., when a previously selected pattern of fastener installation does not match a detected set of one or more fastener holes). As yet another example, system may determine one or more inconsistencies between a selected pattern of anchors or other selections of anchor location(s) as targets for anchor adjustment and detected anchors and/or other objects detected, where the selections do not match the detected anchors and/or other objects.

When such inconsistencies/nonconformities satisfy one or more thresholds, certain adjustment actions may be caused and/or recommended via the user interface. For example, when a detected hole placement in a detected tie plate deviates from a designated tie plate template by more than a first threshold (e.g., a sixteenth of inch or more), the control system 201 may generate a user notification regarding the deviation, and may adjust the hammer assembly 120 by the deviated distance to accurately drive a fastener 116 into the deviated hole. However, when a detected hole placement in a detected tie plate 114 deviates from a designated tie plate pattern by more than a second threshold (e.g., an inch or more), the control system 201 may generate a user notification regarding the deviation, and may or may not require operator confirmation before adjusting the hammer assembly 120 by the deviated distance to accurately drive a fastener 116 into the deviated hole. In such cases, a different tie plate profile 257 may be generated or selected before proceeding. As another example, when a detected hole is obstructed (e.g., by a stone), the control system 201 may generate a user notification regarding the obstruction and may pause installation and/or adjustment operations until operator intervention is received. As yet another example, when a detected tie plate placement on a railway tie 110 deviates from a centered position or a different designated position (with respect to edges of the tie) by more than a threshold (e.g., half an inch or more), the control system 201 may generate a user notification regarding the deviation, and may require operator confirmation before continuing driving operations. Thus, disclosed embodiments not only ensure consistent and accurate installation of fasteners 116, but also consistent and accurate installation/adjustment of tie plates 114 and anchors 114(*a*), 114(*b*). As with all notifications, such notifications may include surfacing an image(s) of the detected aspects to the user interface. Moreover, such notifications and the corresponding thresholds that trigger the notifications may be operator-configurable to account for case-specific variances and tolerances.

According to disclosed embodiments, one or more adjustment sequences may be initiated with a push of a button. Advantageously, disclosed embodiments may eliminate the need for at least three operators—one to separately operate a left-side hammer, one to separately operate a right-side hammer, and one to load fasteners into the feed trays. For example, the productivity increases with disclosed embodiments may allow the need for a third operator to be eliminated. In such cases, two operators may separately load fasteners when the control system controls the machine-directed operational features so that the two operators need not actively engage the controls to line up and drive every spike. The machine-directed operational features of the system 100 may correspond to technical improvements resulting in increased efficiencies, decreased costs, and less risk for operator error.

In operation, after the workhead is positioned generally over a given railway tie 110 needing fastener and/or anchor installation, further refinement of positioning of the hammer assemblies 120 and/or the anchor manipulator 102 to facilitate fastener and/or anchor installation operations may be directed by control system 201 based at least in part on the captured sensor data to perfectly align the working assembly before it begins each separate task and subtask, as appropriate. The automatic positioning refinement may or may not be initiated by an operator via one or more user-selectable options presented with the operator interface. Such captured sensor data may include previously recorded patterning data but may also include real-time sensor data. The real-time sensor data may be used by the control system 201 to identify inconsistencies and nonconformities, such as obstructions, variances in railway components with respect to one another and stored characteristics, and/or the like. The real-time sensor data, which may include image data of the railway components and installations, may be surfaced to an operator via the user interface. Further, the real-time image data may include real-time video that may be presented so that an operator may monitor installation/adjustment operations.

An adjustment sequence may include automatic guidance to make positioning determinations of positions of the anchor manipulator 102 and/or the fastener installer 106, and to automatically guide the anchor manipulator 102 and/or the fastener installer 106 into target positions. For example, such automatic guidance may include moving the fastener installer 106 from a stowed position (or another position) to a deployed position and positioning the fastener installer 106 in a particular fastener driving position to drive a railway fastener 116 through a tie plate hole and into a railway tie 110. Additionally or alternatively, such automatic guidance may include moving the anchor manipulator 102 from a stowed position (or another position) to a deployed position and positioning the anchor manipulator 102 in a particular tie plate addressing position to address anchors 114(*a*), 114(*b*) and to move the anchors 114(*a*), 114(*b*) with one or more operations disclosed herein. While each step or a subset of the steps of the one or more adjustment sequences may be automatically initiated and controlled by the control system 201, each step or a subset of the steps of the one or more adjustment sequences may be selectively initiated and controlled by an operator via operator control of input devices.

Figure 6A:
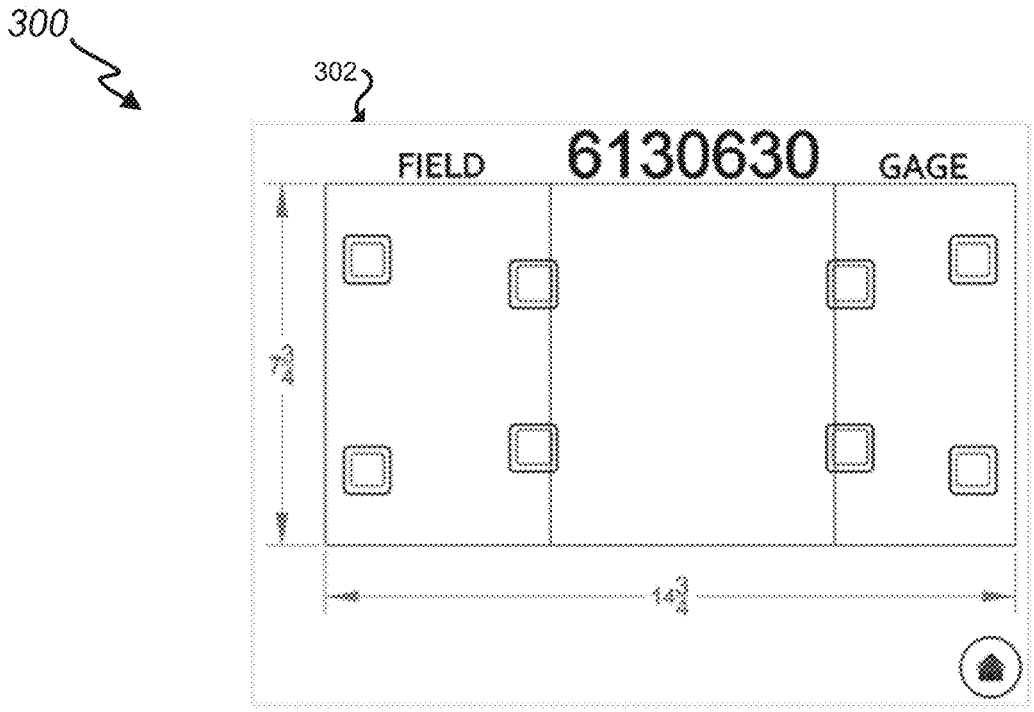
FIGS. 6A, 6B, 6C, and 6D illustrate some graphical aspects of an exemplary portion of an operator interface, in accordance with disclosed embodiments of the present disclosure.
Figure 6B:
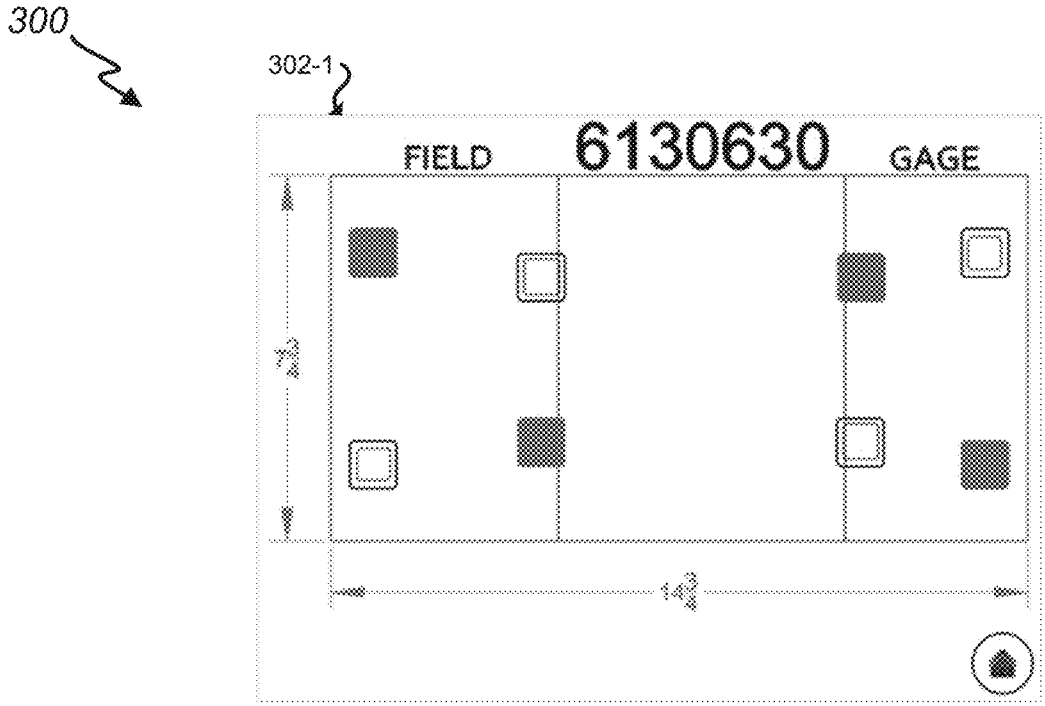
Figure 6C:
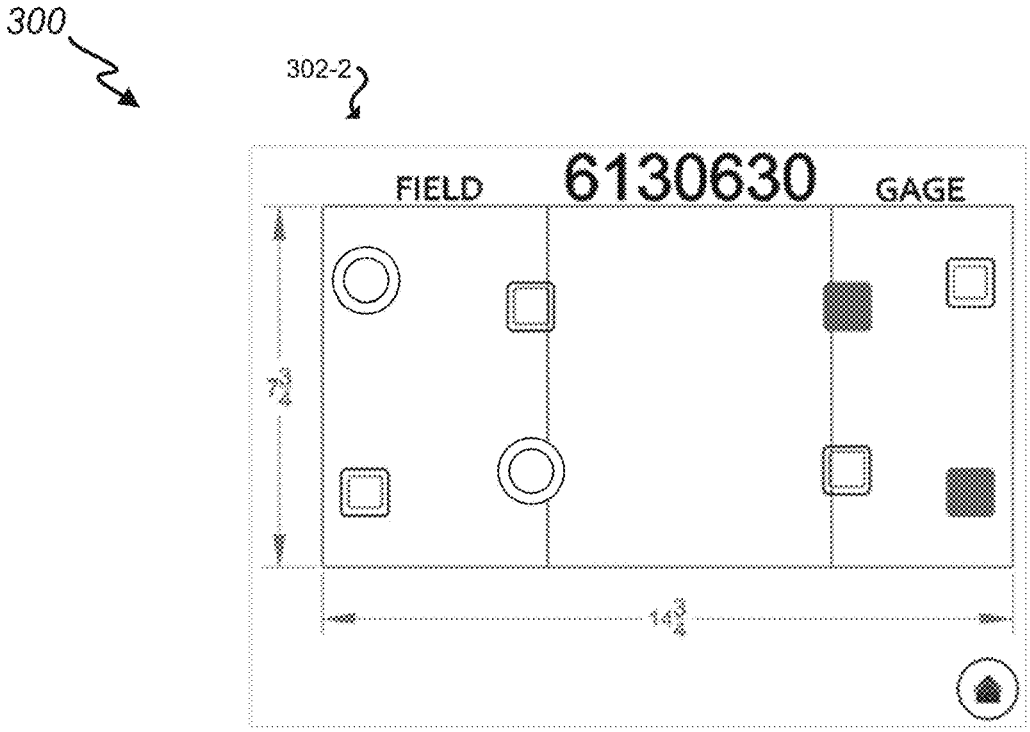
Figure 6D:
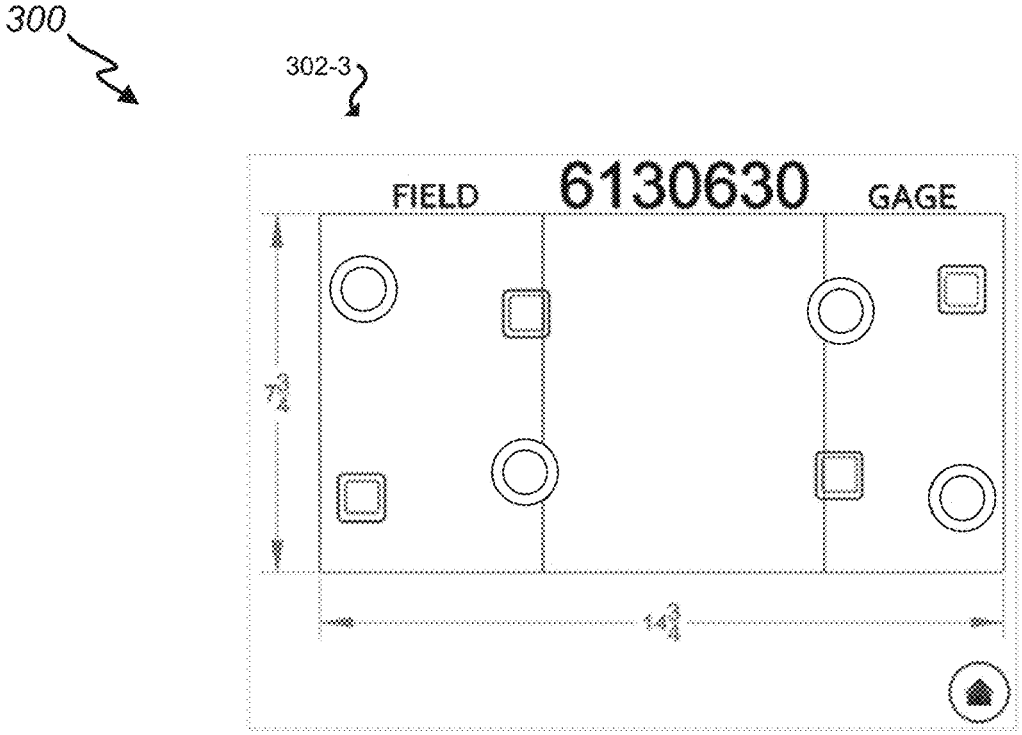

FIGS. 6A, 6B, 6C, and 6D illustrate some graphical aspects of an exemplary portion of an operator interface 300, in accordance with disclosed embodiments of the present disclosure. As disclosed herein, the system controller 221 may generate a user interface 300 for an operator to view and control various aspects of the system 100 via user-selectable options of the user interface. The control system 201, having identified a particular tie plate 114 configuration corresponding to the detected tie plate 114 with the one or more sensors, may generate the operator interface 300 to illustrate the corresponding tie plate design. For example, the operator interface 300 may illustrate a geometrically accurate tie plate design 302 that may correspond to the detected tie plate 114. Similarly, the control system 201 may update the emulation of the detected tie plate 114 to further emulate installed railway fasteners 116 corresponding to a detected set of one or more fasteners 116 with the one or more sensors, thus generating the operator interface 300 to illustrate the corresponding fastener images and positions. For example, the operator interface 300 may illustrate detected fasteners 116 on the geometrically accurate tie plate design 302 corresponding to the detected tie plate 114, as illustrated in FIGS. 6C and 6D. The emulation may be updated in real time, substantially real time, or upon detected state changes in railway component states and/or installation operations. In a similar manner, the emulation may be updated based on sensor data to accurately reflect any variances detected, such as obstructions, which may be represented with actual image data captured of the obstruction and presented with the user interface 300 as an overlay on other graphics of the railway components and/or integrated with actual image data captured of detected railway components.

The control system 201 may be loaded with common fastener, anchor, tie plate, and rail design specifications, which may be stored in the profiles 257. In some cases, design drawings may be loaded into the control system 201 to be used by the control system 201 to develop fastener, anchor, tie plate, and rail profiles 257 and graphical depictions such as that illustrated with the fastener and tie plate design 302, which may be to scale in some embodiments.

Additionally or alternatively, the control system 201 may detect fastener, anchor, tie plate, and rail characteristics with one or more sensors. For example, captured sensor data for a particular tie plate 114 may be used to create a tie plate profile. Likewise, captured sensor data for other railway components, such as a particular railway fastener 116 and a particular anchor 114(*a*), 114(*b*), may be used to create another railway component profile, such as a fastener profile and an anchor profile.

Captured images of the particular railway components may be used for the various railway component profiles 257. For example, captured images of the particular fastener 116, anchor 114(*a*), 114(*b*), and tie plate 114 may be used for the fastener, anchor, and tie plate profiles 257. The fastener and tie plate profiles 257 may include information that may be used as templates for fastener driving operations. The fastener and tie plate profiles 257 may include fastener and tie plate characteristics, such as fastener and tie plate identifiers (e.g., model numbers), physical dimension information, fastener hole position information, fastener hole size information, field side and gage side identifiers, shape, contour, and other geometrical modelling information, images, and/or the like. Disclosed embodiments may likewise include features for capturing images of other railway components, such as anchors 114(*a*), 114(*b*) and the rail 108 itself, and for using the images to develop profiles for those components.

As the workhead is positioned over each tie plate 114, the control system 201 may analyze sensor data to identify characteristics of the particular tie plate 114, such as dimensions and hole placement. Having identified the tie plate characteristics, the control system 201 may search retained tie plate profiles 257 to compare the identified tie plate characteristics with defined attributes (e.g., dimension and hole configuration attributes in attribute fields) stored in the tie plate profiles to determine whether or not a matching tie plate profile 257 already exists in the system 201. In similar manner, some embodiments may provide for analysis of sensor data to identify characteristics of the particular anchors 114(*a*), 114(*b*), and may provide for similar anchor profile 257 matching operations.

With the matching, extraction, and adjustment processes disclosed herein, the control system 201 may additionally account for the variances concomitant with direction of travel and on which rail 108 of the pair of rails 108 the workhead is used. With these variances, the orientations of tie plates 114, fasteners 116, and anchors 114(*a*), 114(*b*) change, and positions of associated fastener holes change from the perspective of the workhead. With the sensor feedback, the control system 201 may identify the direction of travel and/or the variances an orientations and positions. The control system 201 may then automatically adapt the user interface 300 to reflect, from the perspective of an operator, the variances. The interface adaptation may include changing orientation of the illustrated railway components. In some embodiments, the representation of the railway components may be two-dimensional, such as that depicted in the figures. However, the two-dimensional depiction is only for the sake of simplicity, and the user interface 300 may represent the railway components with three-dimensional graphics and perspective views. Thus, the user interface 300 may illustrate the detected railway components with an orientation and/or perspective view that is similar to the perspective with which an operator may view the corresponding railway components from the operators, if there was a clear line of sight from the operator to the railway components. One or more user-selectable options (e.g., touchscreen options, finger swiping options, and or the like) may be enabled with the user interface 300 to allow the operator to select and modify orientations and perspectives of the detected railway components as emulated with the user interface 300.

When there is a matching tie plate profile 257 by the control system 201, the control system 201 may utilize the matching tie plate profile 257 to perform machine-directed fastener installation for the given tie plate 114, as well as subsequent matching tie plates 114. Upon identification of the matching tie plate profile 257, the control system 201 may cause a notification to be presented via the user interface 300. The notification may prompt operator confirmation of the match to proceed with the fastener operations without further operation interaction. In a similar manner, some embodiments may provide for similar anchor profile 257 matching operations for the tie plate and anchor adjustment operations and likewise may provide for notifications for proceeding with machine-directed anchor and/or tie plate adjustment operations without further operation interaction. The automatic control of such operations may be based at least in part on specifications of prescribed engagement and adjustment distances specified in the profile information 257. For example, the fastener installer 106 and/or the anchor manipulator 102 may be lowered to install fasteners 116 and/or to engage anchors 114(*a*), 114(*b*) and/or a tie plate 114 based at least in part on a specified distance that takes into account the dimensions the workhead, the rail 108, the tie plate 114, anchors 114(*a*), 114(*b*), and/or the fasteners 116. Likewise, anchor and tie plate adjustments may be controlled based at least in part on a specified distance to move the railway anchors 114(*a*), 114(*b*) and/or the tie plate 114. Each of these operations may be guided based at least in part on the sensor input 206, which may be used to guide the movements of the railway and workhead components.

Taking the example of a tie plate 114, the notification of the match may include a graphical depiction of the matching tie plate, the matching dimensions, and/or the matching hole configuration. For example, the tie plate design 302 that may correspond to detected tie plate 114 and matching tie plate profile 257 may be presented. The notification may further include surfacing an image(s) of the detected tie plate 114 alongside or overlaid on the graphical depiction 302 of the matching tie plate. In the case of an overlay, one or both of the image(s) of the detected tie plate 114 and the graphical depiction 302 of the matching tie plate may be rescaled so that each have the same scale. The overlay of the image(s) of the detected tie plate 114 may be a composite of multiple detected images, as well as one or more supplemental images. For example, to represent both the gage side and the field side of a tie plate 114, multiple images may be assembled. Since the portion of the tie plate 114 that is covered by the rail 108 is not visible, the system 201 may omit that portion from the overlay or supplement that portion with a system-generated graphic. In a similar manner, the above examples with respect to respect to a tie plate 114, may likewise apply to anchors 114(*a*), 114(*b*) and/or fasteners 116, with the control system 201 and user interface 301 providing similar matching and graphical features for anchors 114(*a*), 114(*b*) and/or fasteners 116.

Further, the notification may prompt operator selection or confirmation of a desired number of fasteners in desired holes of the tie plate 114. For example, FIG. 6B illustrates the tie plate design 302-1 with a subset of selected holes for fastener installation. User-selectable options (e.g., via a touchscreen interface or another suitable means) may be provided to correspond to each hole of the depicted tie plate design 302-1. With the user-selectable options, the operator may designate which holes should receive fasteners 116. In some cases, the depicted tie plate design 302-1 may be pre-populated with the last received hole selections for the particular tie plate design 302-1 when detected tie plate characteristics match the last or otherwise previously determined tie plate characteristics. However, when there is a mismatch, a notification identifying the mismatch and prompting user selection may be generated and presented via the user interface 300.

In a similar manner, some embodiments may provide for the aforesaid features for anchors 114(*a*), 114(*b*) and the anchor installation operations. Thus, the anchor installation operations may proceed as long as detected anchor characteristics match the last or otherwise previously determined anchor characteristics and positions, railway tie characteristics and positions, and/or tie plate characteristics and positions. When there is a mismatch, a notification identifying the mismatch and prompting user selection may be generated and presented via the user interface 300.

Accordingly, in addition or in alternative to identifying characteristics of the particular tie plate 114, the control system 201 may analyze sensor data to identify characteristics of other detected railway components, such as detected railway anchors 114(*a*), 114(*b*). Take the following description with respect to a detected tie plate 114 as example that is to be understood to likewise apply to detected railway anchors 114(*a*), 114(*b*). Having identified the tie plate characteristics, the control system 201 may search retained tie plate profiles 257 to compare the identified tie plate characteristics with defined attributes (e.g., dimension attributes in attribute fields) stored in the tie plate profiles to determine whether or not a matching tie plate profile 257 already exists in the control system 201. When there is a matching tie plate profile 257 stored by the control system 201, the control system 201 may utilize the matching tie plate profile 257 to perform machine-directed fastener installation with a set of one or more fasteners 116, as well as subsequent matching tie plates 114. Upon identification of the matching tie plate profile 257, the control system 201 may cause a notification to be presented via the user interface 300.

The notification of the match may include a graphical depiction of the matching tie plate(s), which may include the matching dimensions. The notification may further include surfacing an image(s) of the detected tie plate(s) 114, which may be overlaid on a graphical illustration of the matching tie plate. In alternatives, image(s) of the detected tie plate(s) 114 may be presented without graphical illustrations of the matching tie plate. In the case of an overlay, one or both of the image(s) may be rescaled so that each have the same scale. Such detection, analysis, matching, and notification features may be likewise applied to detected railway anchors 114(*a*), 114(*b*), learned railway anchor profiles, railway anchor installation operations, and other detected railway components and instructions that affect railway anchor installation operations.

Further, the notification may prompt operator selection or confirmation of the target tie plate holes where fasteners 116 are to be installed in the tie plate 114. For example, FIG. 6B illustrates the tie plate design 302-1 with a subset of selected holes for fastener installation. User-selectable options (e.g., via a touchscreen interface or another suitable means) may be provided to correspond to each fastener hole of the depicted tie plate 114. With the user-selectable options, the operator may designate the target holes for fastener installation. In some embodiments, upon detection of a set of target tie plate holes that match a previously detected set of target tie plate holes, a notification may prompt operator confirmation of the detected set of target tie plate holes to proceed with the fastener installation operations without further operation interaction. In other embodiments, automatic installation operations may proceed without need for user confirmation as long as a currently detected set of target tie plate holes match a previously detected set of target tie plate holes. Again, such features may be likewise applied to sleep detected railway anchors 114(*a*), 114(*b*), learned railway anchor profiles, railway anchor installation operations, and other detected railway components and instructions that affect railway anchor installation operations.

In one mode, the operator may indicate the sequence of fastener installation, i.e., which hole should be filled first, second, third, etc. In another mode, the operator need only indicate which holes should receive fasteners 116. With that input, the control system 201 may determine the optimal sequence based at least in part on efficiency of movement and/or balancing the static and/or percussive loads between the two hammer assemblies 120. With the former mode, when the operator indicates the sequence, the control system 201 may determine the optimal sequence as in the latter mode and then compare the operator-indicated sequence to the optimal sequence. If the two sequences are not equivalent, the control system 201 may cause a notification to be presented to the operator, recommending the optimal sequence and prompting the operator to accept or reject the optimal sequence with selection of one or more user-selectable options presented with the operator interface 300.

In some embodiments, the control system 201 may cause a notification to be presented via the operator interface 300 upon detection of each tie plate 114. Further, the control system 201 may prompt operator confirmation of the match to proceed with the fastener operations without further operation interaction with each tie plate 114, so that the operator must provide a separate confirmation to proceed each time a tie plate 114 is encountered. However, other embodiments may not require such confirmation but may proceed with the fastener installation operations with respect to a series of tie plates 114 without further operation interaction. Such operations may proceed until the control system 201 identifies one or more inconsistencies/nonconformities with respect to the particularized pattern, which may include a detected change to a different tie plate hole configuration, an obstruction, a missing tie plate, a non-centered or otherwise ill-placed tie plate with respect to the tie, and/or the like. At that time, the control system 201 may cause a notification to be presented via the operator interface 300 and may or may not require operator interaction in order to proceed further, depending on the extent of the detected inconsistencies/nonconformities.

When there is no matching tie plate profile 257 stored by the control system 201, the control system 201 may transition to a learning mode. The control system 201 may facilitate one or more learning modes. In one operational mode of the system 100, an operator may train the control system 201 to record a fastener installation procedure for a given tie plate 114. For example, the control system 201 may provide a user-selectable option to record a sequence of fastener driving operations in order to learn a new template for fastener driving. An operator may select the record option to initiate system recording, then proceed to direct fastener installation to completely install fasteners 116 in a first tie plate 114 with a desired number of fasteners 116 in desired holes of the tie plate 114, which may or may not correspond to installing a fastener 116 in every hole of the tie plate 114. In some embodiments, this training may include the operator directly controlling each instance of fastener installation for the given tie plate 114. With the sensor feedback, the control system 201 may learn the pattern of fastener installation for the particular tie plate 114. Some embodiments may learn and infer positions of fastener holes in tie plates 114 using the detected positions of the cylinders, as detected by the associated position sensors. Additional disclosed embodiments may utilize other types of sensors, which may or may not be in conjunction with position sensors, to learn and detect positions of fastener holes. The control system 201 may store the learned pattern of fastener holes, as well as the positioning and driving operations of the hammer assemblies 120, as part of a tie plate profile 257 for subsequent fastener installation operations. The pattern may be stored by the control system 201 along with various other learned patterns for subsequent use. Such options for various patterns may be provided for operator selection via the graphical operator interface 300. In a similar manner, the control system 201 may facilitate such learning modes with respect to anchor and tie plate adjustment operations.

With the initial learning instance and subsequent learning instances with sensor data for corresponding tie plates 114, the control system 201 may progressively learn and develop tie plate profiles 257. In such cases, the control system 201 may generate graphical depictions such as that illustrated with the tie plate design 302 based at least in part on the learned and developed tie plate profiles 257. Having learned a tie plate configuration, the system 102 may perform machine-directed fastener installation for subsequent tie plates 114 having hole configurations that match the hole configuration of the learned tie plate 114. By way of example, with subsequent tie plates 114 in a series, the pattern may be repeated such that the control system 201 may direct installation operations according to the learned pattern. In a similar manner, the adaptive system 100 may perform machine-directed anchor and tie plate adjustments for subsequent railway anchors 114(*a*), 114(*b*) and tie plates 114 having configurations that match the anchor and tie plate configuration of the learned configurations.

In some operational modes, one hole of the tie pattern may be designated by the operator as the index hole such that rest of the pattern is keyed off that index hole. By default, the index hole may be the first hole position identified by the operator. In other instances, the operator may separately designate one hole as an index hole. Having trained the control system 201 to proceed with the recorded installation pattern based at least in part on the index hole, the operator may select and confirm each index hole each time a tie plate 114 is encountered in order to initiate system-directed completion of the installation pattern, keying off that index hole selected by the operator. In some embodiments, the operator may drive a fastener 116 into the index hole; in other embodiments, the operator may merely identify or position the tip of a fastener 116 held by the hammer assembly 120 over the index hole. In either case, using the previously learned pattern for the particular tie plate hole configuration, the control system 201 may then automatically complete fastener installation for each tie plate 114 without further operator input or interaction after initial direction to the index hole. This and other system-controlled may free up the operator to perform other tasks, such as loading fasteners 116 into the feed trays.

Figure 7A:
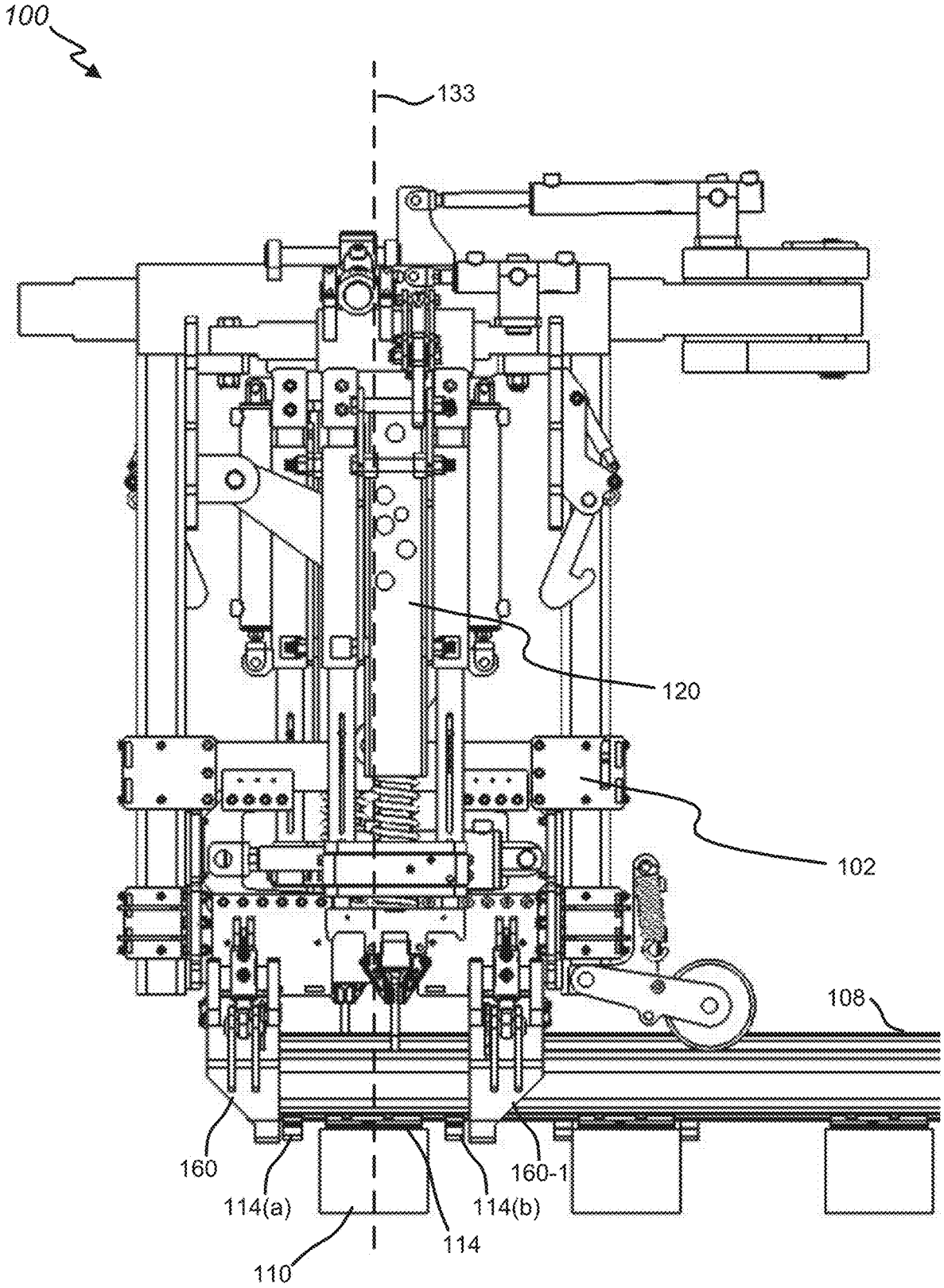
FIG. 7A depicts a partial side view of the single-plane multifunctional railway component handling system with the anchor manipulation subsystem in a deployed position, in accordance with disclosed embodiments of the present disclosure.

Now focusing more on the anchor manipulation subsystem 102, FIG. 7A depicts a partial side view of the single-plane multifunctional railway component handling system 100 with the anchor manipulation subsystem 102 in a deployed position, in accordance with disclosed embodiments of the present disclosure. Advantageously, when the system 100 is positioned over a particular railway tie plate 114, the fastener installer 106 and the anchor manipulator 102 may be adapted to share the same centerline 133 so that each are efficiently aligned with the tie plate 114. This self-aligning configuration eliminates or at least minimizing any need for modifying alignment between operations of the fastener installer 106 and the anchor manipulator 102. Thus, when the fastener installer 106 has completed fastener installation operations for a particular tie plate 114, the anchor manipulator 102 may be already aligned with the tie plate 114. At the end of the fastener installation process for the particular tie plate 114, each hammer assembly 120 may be automatically controlled by the control system 221 without operator interaction to pivot away from the rail 108, thereby providing more space for the subsequent anchor installation operations effected by the anchor manipulator 102. The anchor manipulator 102 may be lowered straight down to engage the tie plate 114 and/or the railway anchors 114(*a*), 114(*b*) without any additional adjustment to the alignment. Such a mode of operation may be selectable in disclosed embodiments.

To further illustrate that advantageous auto-alignment, the centerline 133 is depicted in FIG. 7A. Accordingly, in disclosed embodiments, the centerline 133 may be shared by the fastener installer 106 and the anchor manipulator 102. Although FIG. 7A depicts the hammer assembly 120 in an off-center position within its range of movement and with respect to the centerline 133, the hammer assembly 120 shares that centerline 133 such that the hammer assembly 120 can be centered within its range of movement and with respect to the centerline 133. While each individual hammer assembly 120 may be off-center from the depicted centerline 133 of the entire workhead assembly depending on where it is along its sliding pattern shaft, the pair of hammer assemblies 120 taken together form a balanced system centered about the workhead centerline 133 because each hammer assembly 120 is more or less an equal distance from the workhead centerline 133 to the left or right.

Again, FIG. 7A depicts the anchor manipulator 102 in a deployed position. Disclosed embodiments may provide for automatic lowering of the anchor manipulator 102 from a stowed position (or another position) to a deployed position. After an operator initiates the lowering operation with selection of a user-selectable option presented with the operator interface 300, the control system 221 may direct and control the lowering operation without further interaction of the operator. As part of the lowering operation, the control system 221 may position the anchor manipulator 102 in a particular anchor addressing position to address one or more railway anchors 114(*a*), 114(*b*) to move the one or more railway anchors 114(*a*), 114 (*b*) with one or more operations disclosed herein. In the addressing position, the anchor manipulator 102 may be engaging, or may be positioned to engage, the railway anchors 114(*a*), 114(*b*). FIG. 7A depicts the anchor manipulator 102 as positioned to engage the railway anchors 114(*a*), 114(*b*).

Figure 7B:
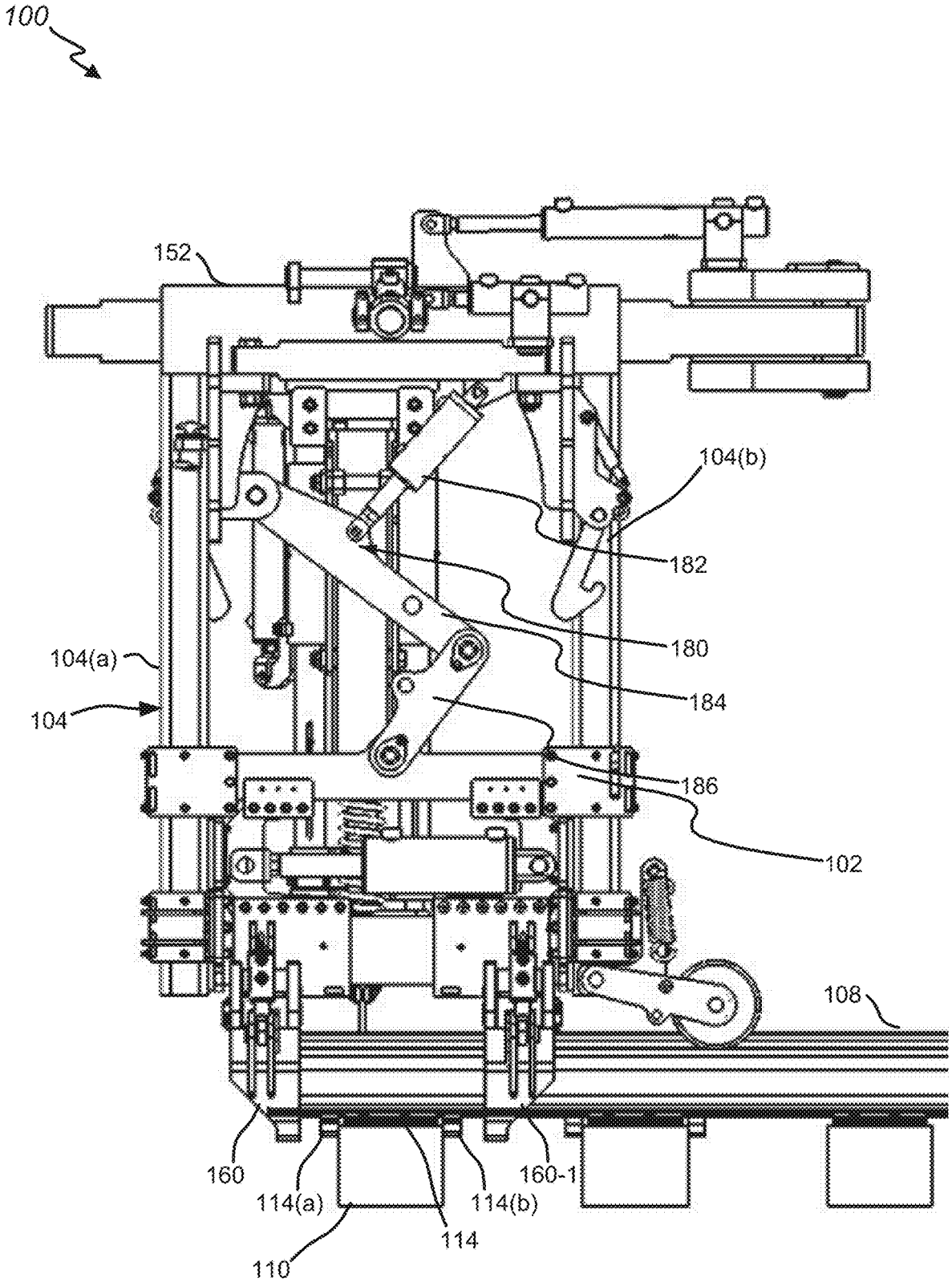
FIG. 7B depicts a partial side view of the single-plane multifunctional railway component handling system with the anchor manipulation subsystem in the deployed position, in accordance with disclosed embodiments of the present disclosure.
Figure 7C:
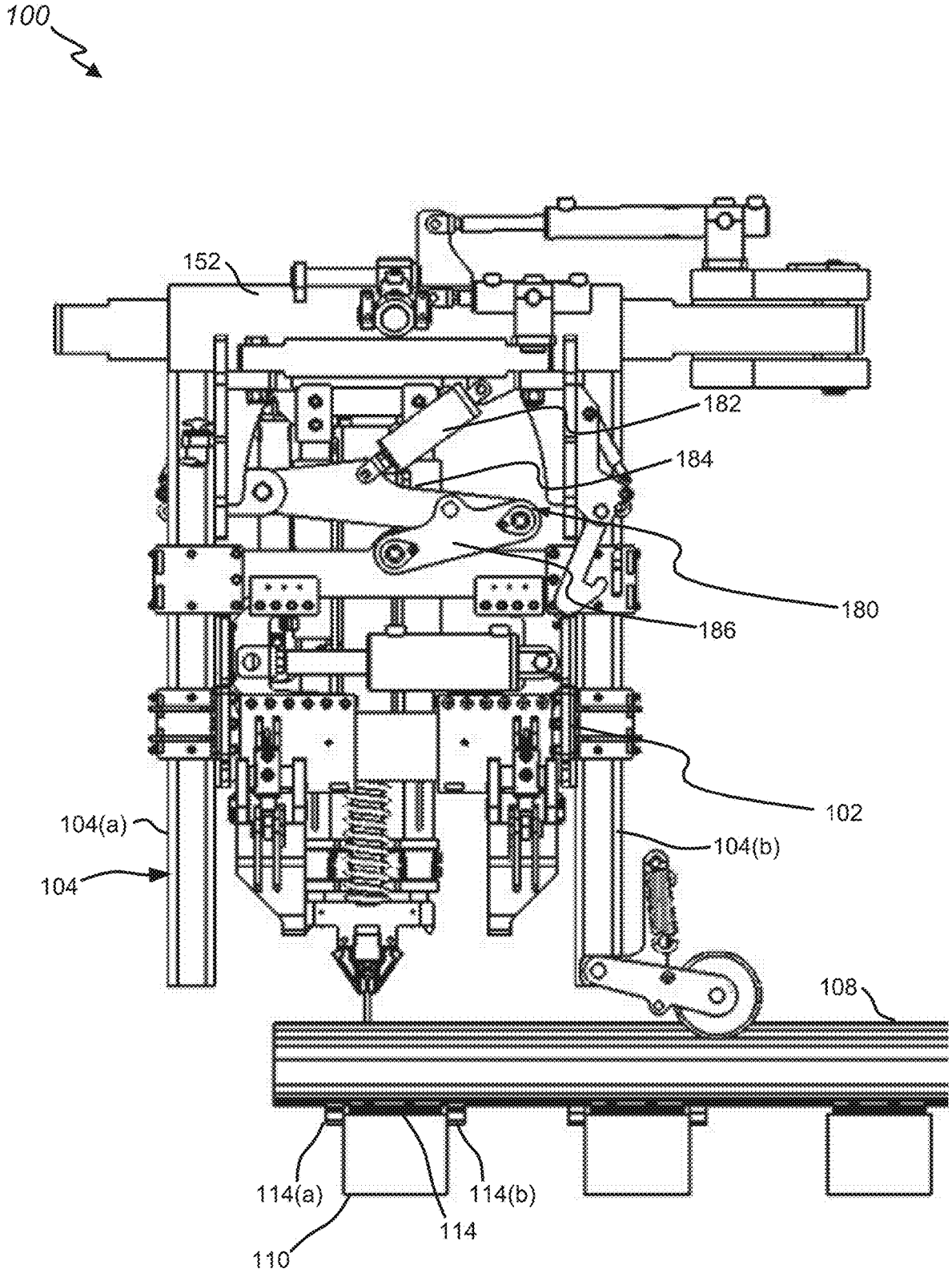
FIG. 7C depicts a partial side view of the single-plane multifunctional railway component handling system with the anchor manipulation subsystem in a non-deployed position, in accordance with disclosed embodiments of the present disclosure.

FIG. 7B depicts a partial side view of the single-plane multifunctional railway component handling system 100 with the anchor manipulation subsystem 102 in the deployed position, with the hammer assembly 120 removed for the sake of clarity. In FIG. 7B, the anchor manipulator 102 is depicted as having already engaged and adjusted the railway anchors 114(*a*), 114(*b*) toward the tie plate 114. FIG. 7C depicts a partial side view of the single-plane multifunctional railway component handling system 100 with the anchor manipulation subsystem 102 in a non-deployed position, with the hammer assembly 120 again removed for the sake of clarity. In FIG. 7C, the anchor manipulator 102 is depicted as having been raised to a stowed or ready position, after having adjusted the railway anchors 114(*a*), 114(*b*) toward the tie plate 114.

As disclosed herein, the anchor manipulator 102 may be slidably coupled to the tubular legs 104(*a*), 104(*b*) of the frame 104, e.g., via sleeve members of the anchor manipulator 102. In some embodiments, the raising and lowering of the anchor manipulator 102 may be effected by way of the linkage system 180. The linkage system 180 may generally correspond to "z-linkage system" having five pivot points. As illustrated, an intermediate linkage member 184 of the linkage system 180 may be pivotably coupled to a short-stroke linkage cylinder 182, to a lower extension of the main shaft structure (e.g., a lower extension from the slidable frame coupling 152), and to a lower linkage member 186. The short-stroke linkage cylinder 182 may also be pivotably coupled to the slidable frame coupling 152. The lower linkage member 186 may also be pivotably coupled to the anchor manipulator 102. The z-linkage configuration may enable the short-stroke linkage cylinder 182, under control of the control system 221, to move the anchor manipulator 102 up and down at a higher ratio than 1:1. By way of example, approximately three to four inches of stroke may result in 18 or more inches of vertical movement. Advantageously, the anchor manipulator 102 may be raised to a high, non-deployed position when not in use in order to greatly improve visibility of the lower operational area from the perspectives of the operator and one or more sensors.

Figure 7D:
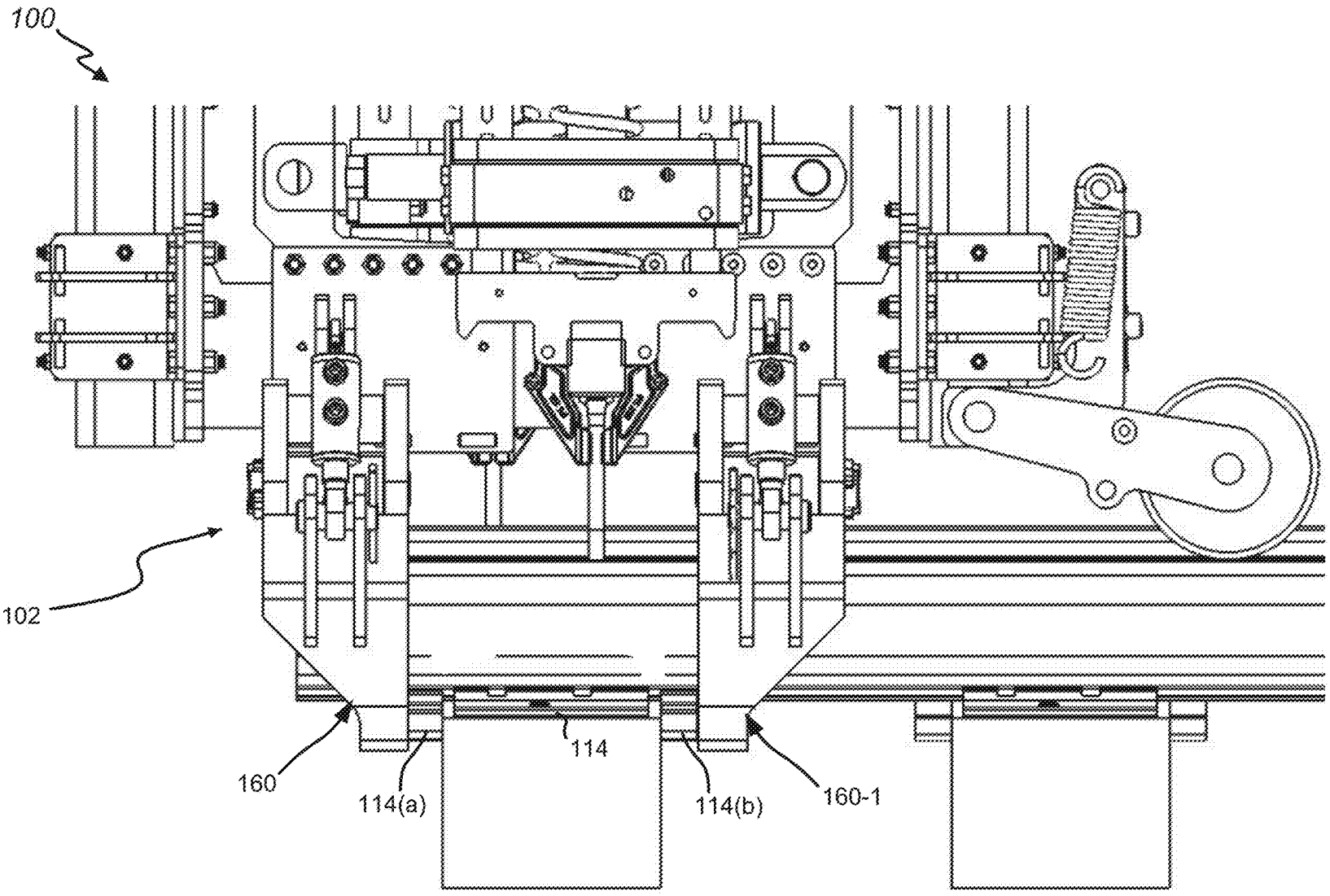
FIGS. 7D, 7E, and 7F respectively depict a close-up side view, a partial end view, and a close-up end view of the single-plane multifunctional railway component handling system with the anchor manipulation subsystem in the deployed position, in accordance with disclosed embodiments of the present disclosure.
Figure 7E:
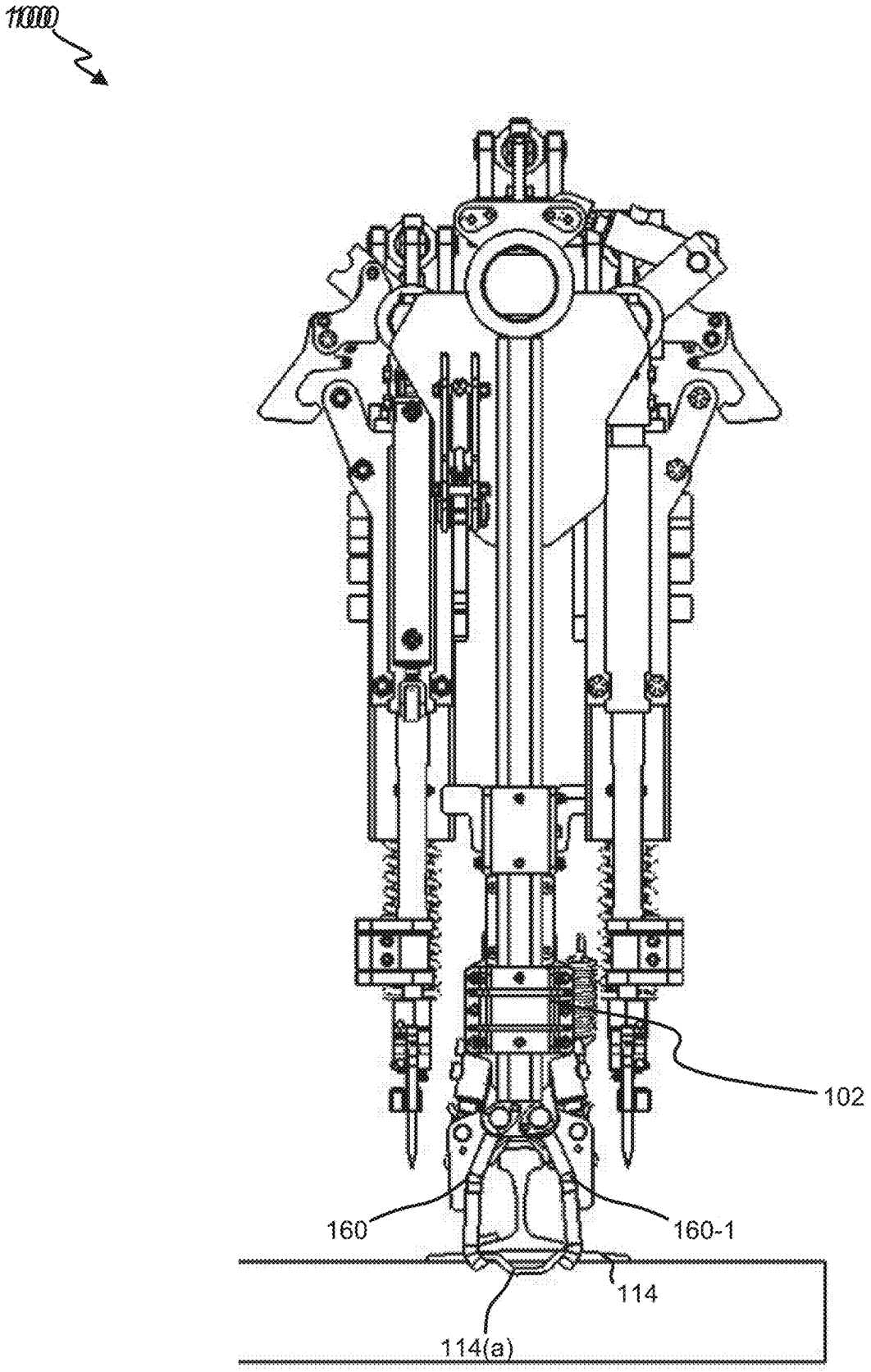
Figure 7F:
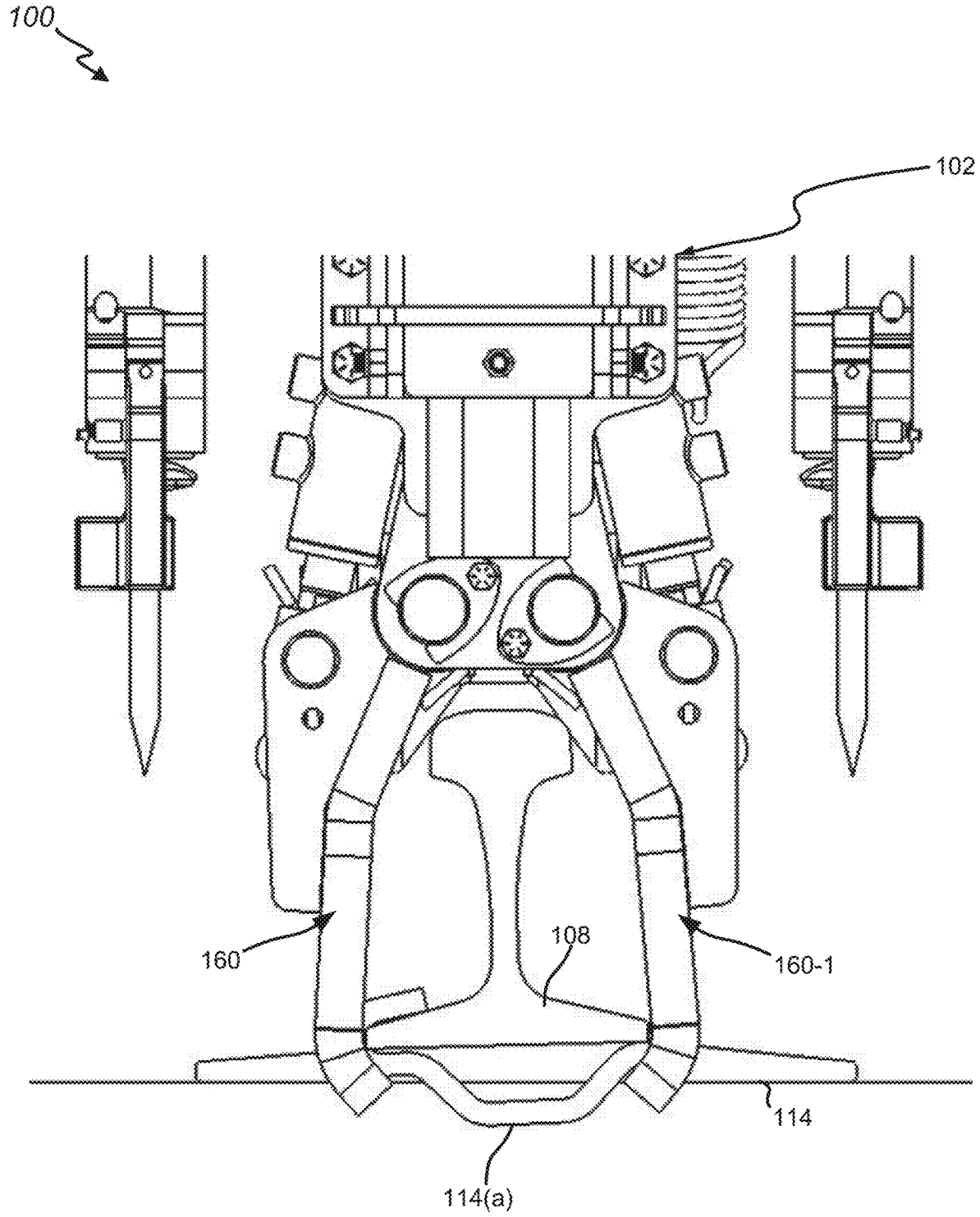
Figure 7G:
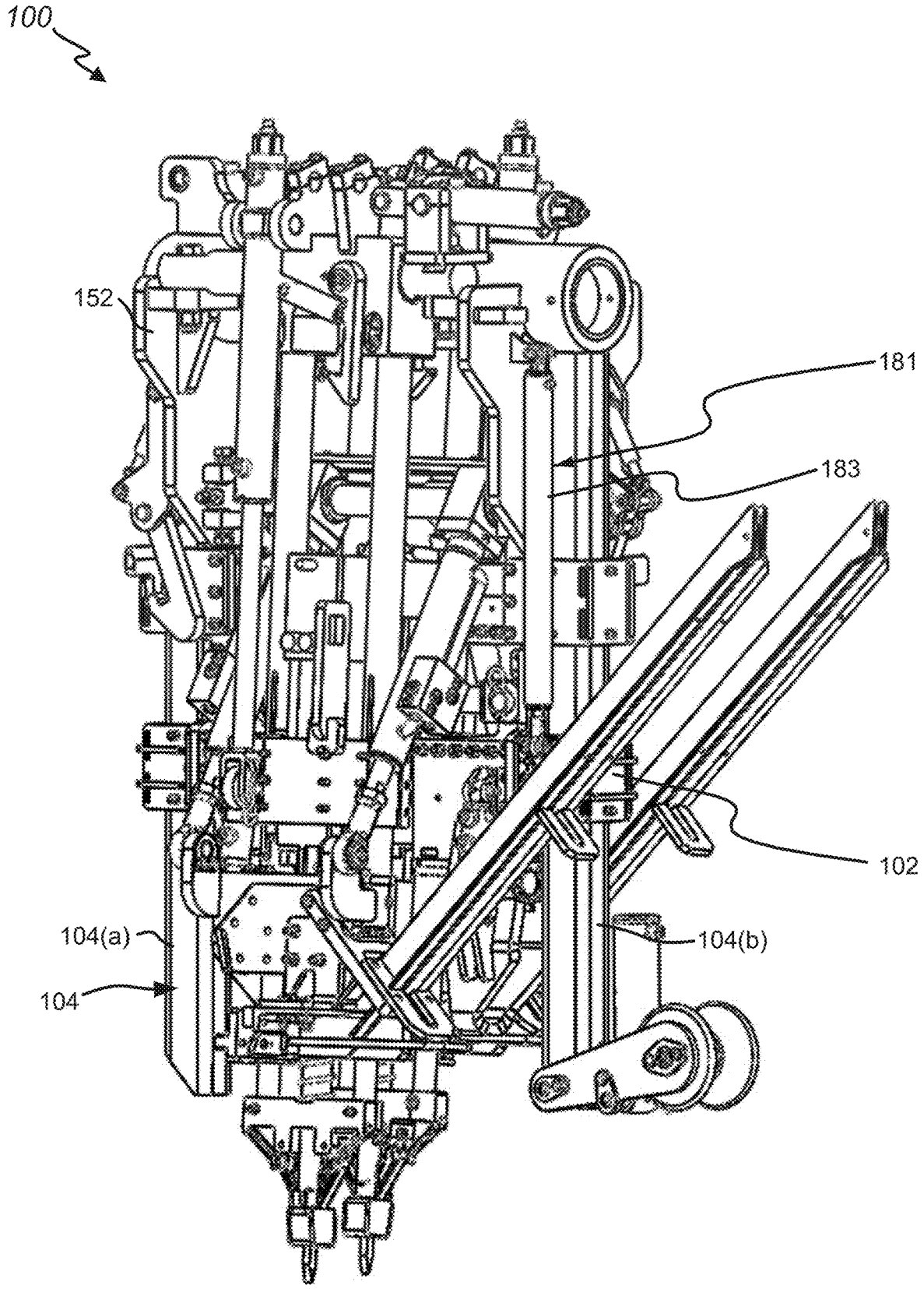
FIG. 7G shows a perspective view of an embodiment which employs an alternative linkage system, in accordance with disclosed embodiments of the present disclosure.

FIG. 7G shows a perspective view of an embodiment which employs an alternative linkage system 181. The linkage system 181 may include a set of one or more linkage cylinders 183 adapted to selectively raise and lower of the anchor manipulator 102 with respect to the frame 104. Each linkage cylinder 183 may be coupled to the main frame structure (e.g., a lower extension from the slidable frame coupling 152) and to the anchor manipulator 102 (e.g., an extension of the support framework 166 of the self-centering assembly 164). In various embodiments, a single linkage cylinder 183, two linkage cylinders 183 in opposing arrangement (e.g., symmetrically disposed in a field-side corner and in a gage-side corner), four linkage cylinders 183 in opposing arrangement, or another arrangement may be employed to facilitate selectively raising and lowering of the anchor manipulator 102.

Disclosed embodiments may provide for automatic raising of the anchor manipulator 102 from a deployed position to another position, such as a stowed position or a ready position. The control system 221 may direct and control the raising operation after completion of the anchor installation process with respect to a set of railway anchors 114(*a*), 114(*b*), without interaction of the operator. However, an operator may override the process, as well as any process disclosed herein, with a user-selectable option provided via the operator 300, and, further, may configure the operational settings such that any step or substep of the operations require operator initiation/confirmation.

Figure 8A:
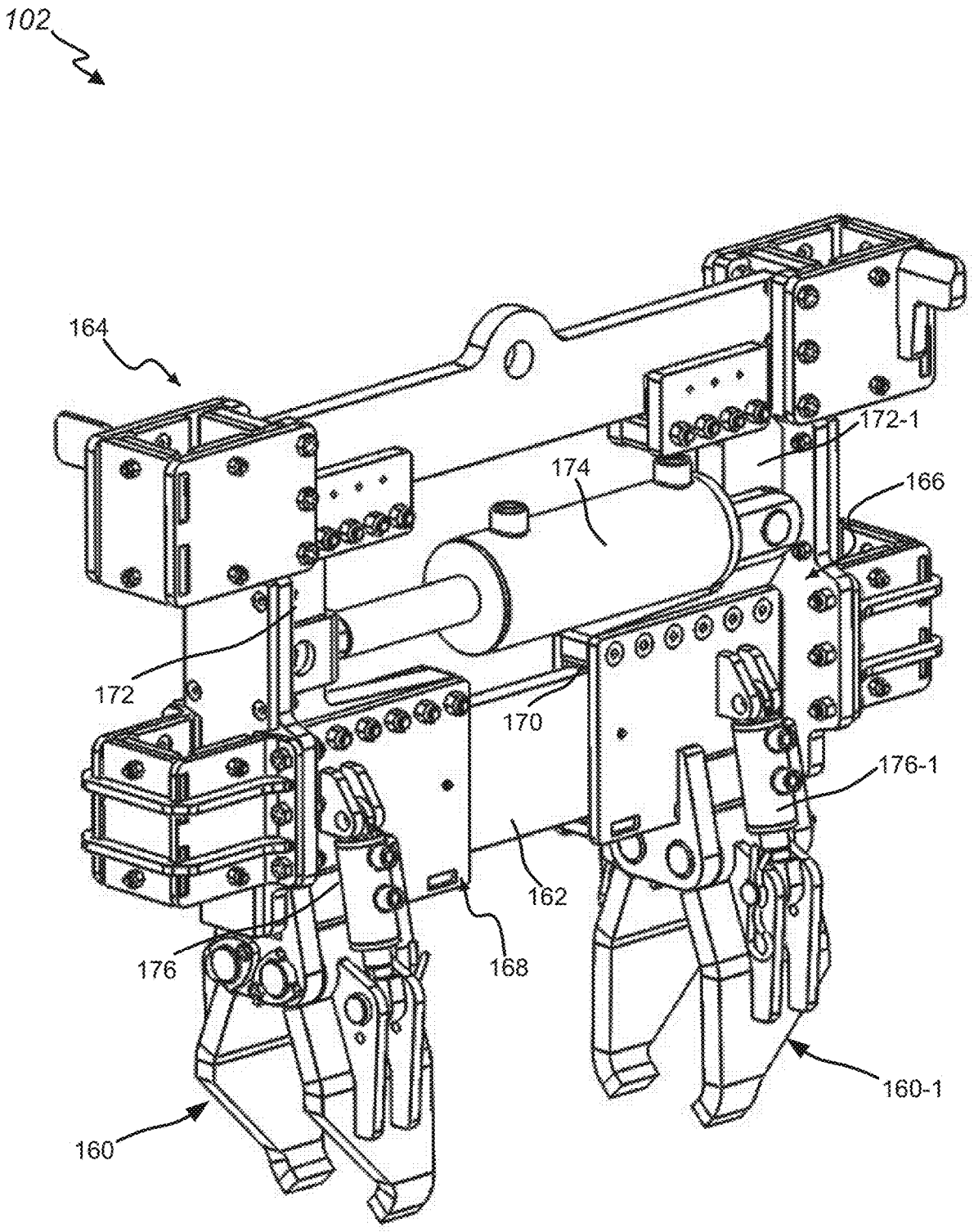
FIGS. 8A and 8B respectively depict a perspective view and a side view of at least part of the anchor manipulator separated from the single-plane multifunctional railway component handling system, in accordance with disclosed embodiments of the present disclosure.
Figure 8B:
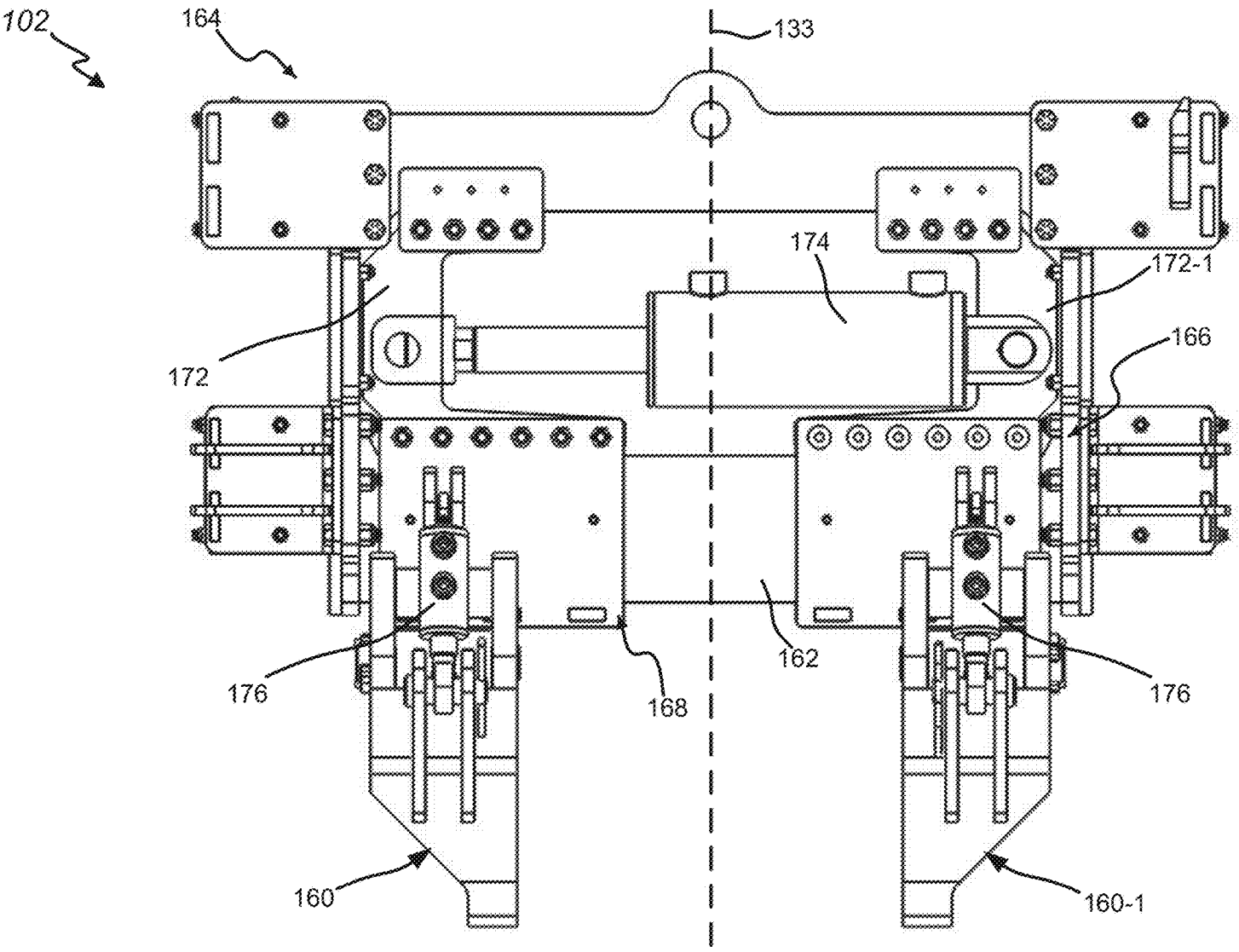

FIGS. 7D, 7E, and 7F respectively depict a close-up side view, a partial end view, and a close-up end view of the single-plane multifunctional railway component handling system 100 with the anchor manipulation subsystem 102 in the deployed position, in accordance with disclosed embodiments of the present disclosure. FIGS. 8A and 8B respectively depict a perspective view and a side view of at least part of the anchor manipulator 102 separated from the single-plane multifunctional railway component handling system 100, in accordance with disclosed embodiments of the present disclosure. Focusing more on FIGS. 8A and 8B, the anchor manipulator 102 may include a self-centering assembly 164 that includes a support framework 166 arranged to provide guidance and support to a self-centering subassembly 168 while allowing travel of the self-centering subassembly 168 with respect to the support framework 166. The support framework 166 may include one or more beams 162. The depicted embodiment includes a dual beam configuration 162. The self-centering subassembly 168 may be slidably coupled to the dual beams 162. The beams 162 may trap the self-centering subassembly 168 while allowing travel of the self-centering subassembly 168 along the beams 162.

The self-centering subassembly 168 may include a pair of sliding bracket assemblies 172 in opposing arrangement. The anchor manipulator 102 may include a floating cylinder 174 connected to the self-centering subassembly 168, for example, by way of the sliding bracket assemblies 172. The floating cylinder 174 may be adapted to extend and retract in order to selectively push or pull the sliding bracket assemblies 172 along the beams 162.

The dual beam configuration 162 may be configured to react against the squeezing loads from operations of the self-centering subassembly 168 imparted via the sliding bracket assemblies 172. As illustrated, the dual beams 162 may have rectangular forms, which advantageously minimizes lateral space taken up by the self-centering assembly 164 (to allow for the multifunctional components along the same centerline) while maximizing support in the vertical direction. The unique structure of the sliding bracket assemblies 172, with the "c-shaped" brackets, may facilitate maximum cylinder stroke for the floating cylinder 174 while distributing loads throughout the dual beams 162 and while minimizing overall space necessary. The dual beams 162 may be adapted to facilitate holding the vertical rectangular tubes rigid. Also, to facilitate ease of maintenance, the self-centering subassembly 168 may be readily disassembled with disassembly of the small number of bolts as illustrated. Removable weldments on the outside of the vertical sliding tubes may allow for simple and quick replacement of slide pads and the assembly components.

The self-centering subassembly 168 may include slide pads 170, directly or indirectly coupled to the sliding brackets 172, to contact the beams 162 and allow for sliding movement with respect to the beams 162. The slide pads 170 may be formed to provide significant wear areas due to an elongated form in order to have extensive usable life spans. Further, the beams 162 may be connected to the support framework 166 with fasteners to allow ease of assembly, access, and serviceability, e.g., in order to eventually replace the slide pads 170.

As illustrated in several of the figures, the self-centering subassembly 168 may include one or more anchor tools 160 that extend from the self-centering subassembly 168. The embodiment depicted includes a pair of anchor tools 160 in opposing and parallel arrangement. More specifically, the set of the anchor tools 160 may correspond to two pairs of the anchor tools 160 connected to act as one: one anchor tool pair 160 may be opposingly arranged with respect to the other anchor tool pair 160-1. The opposing pairs of anchor tools 160 of the anchor manipulator 102 may be formed to straddle the railway anchors 114(*a*), 114(*b*), the railway tie 110, and the tie plate 114. Prior to adjustment by the anchor manipulator 102, the railway anchors 114(*a*), 114(*b*) may be attached by conventional means to the rail 108 a prescribed distance from one another (e.g., approximately up to 14 inches) and on either side of the railway tie 110. The opposing pairs of anchor tools 160 may be configured to accommodate such distances.

Each paddle of the anchor tools 160 may be pivotally mounted to the sliding bracket assembly 172 of the self-centering subassembly 168 in an opposing arrangement with respect to an opposing paddle of the anchor tools 160. Each paddle of the anchor tools 160 may be additionally coupled to the sliding bracket assembly 172 of the self-centering subassembly 168 via a paddle pivot cylinder 142 arranged to move each paddle about a respective pivot into a number of different positions along a plane perpendicular to the self-centering assembly 164. Alternative embodiments may include arrangements whereby each paddle may move about a respective pivot into a number of different positions at other angles with respect to the self-centering assembly 164. Each pivot may correspond to a pivot joint connected to the sliding bracket assembly 172. Each pivot cylinder 142 may be adapted to selectively extend and retract in order to selectively push or pull a respective paddle of the anchor tools 160 about the corresponding pivot point. Each pivot cylinder 142 may be controlled by the control system 201 to move synchronously or otherwise in unison. Each pivot cylinder 142 may be controlled by the control system 201 to move independently of the other arm pivot cylinder 142 of the pair, which may enable the anchor tools 160 to accommodate variations in rails, anchors, and the proximate work area.

The anchor tools 160 may be designed to directly contact/engage surfaces of the railway anchors 114(*a*), 114(*b*) in order to transmit force to and move the railway anchors 114(*a*), 114(*b*) along the underside of the rail 108 toward the vertical faces of the railway tie 110 and toward the tie plate 114 until the railway anchors 114(*a*), 114(*b*) are in an installed position. The installed position may correspond to the railway anchors 114(*a*), 114(*b*) being positioned at least against the tie 110. In some installations, the railway anchors 114(*a*), 114(*b*) may be further positioned against the tie plate 114 such that the railway anchors 114(*a*), 114(*b*) cut into the tie 110 if need be and abut the tie plate 114, leaving no gap between the railway anchors 114(*a*), 114(*b*) and the tie plate 114. The anchor manipulator 102 may be adjustable to achieve either installation scenario pursuant to direction of the operator via selection of operator-selectable options with the operator interface.

Each anchor tool 160 may engage the railway anchors 114(*a*), 114(*b*) and/or push the railway anchors 114(*a*), 114(*b*) simultaneously or substantially simultaneously. The anchor tools 160 may accordingly contact and substantially evenly apply force to the railway anchors 114(*a*), 114(*b*) without skewing the railway anchors 114(*a*), 114(*b*) (which skewing may cause the anchor to fly off the rail due to the high tension the anchor is under when engaged with the rail). Thus, the railway anchors 114(*a*), 114(*b*) may be controlled to slide evenly and safely along an underside of the rail 108 toward the railway tie 110 and the tie plate 114. Accordingly, railway anchor adjustment may correspond to a method of adjusting rail anchors by sliding anchors toward tie faces (e.g., along with installation of a new and/or replacement railway tie 110, or when seating of the anchors 114 against the tie 110 is otherwise needed).

Advantageously, the self-centering assembly 164 may correspond to a technical improvement that provides a technical solution for common problems of railway anchor pairs 114(*a*), 114(*b*) not being symmetrically disposed about a railway tie 110 prior to anchor adjustment operations. Another advantage of the self-centering assembly 164 may be the elimination of any need to clamp the rail 108. With disclosed embodiments, no rail clamp is necessary to engage and clamp the rail 108 in order to stabilize the workhead and facilitate generation of the necessary forces to achieve adjustment of the railway anchors 114(*a*), 114(*b*).

To address asymmetrically placed railway anchor pairs 114(*a*), 114(*b*), the self-centering assembly 164 may correspond to a floating assembly configured to self-center in the process of addressing a railway anchor pair 114(*a*), 114(*b*). If the opposing anchor tools are initially in positions where the anchor tools are not evenly spaced from the anchors (i.e., a first distance from the anchor tool pair 160 to the anchor 114(*a*) is not equivalent to a second distance from the anchor tool pair 160-1 to the anchor 114(*b*)), the anchor tools pairs 160 may sequentially or simultaneously self-center with respect to the anchor pair 114(*a*), 114(*b*) and the railway tie 110, consequent to actuation of the floating cylinder 174. In the self-centering operation, the closer (first) anchor tool pair 160 can first contact the first anchor (i.e., the anchor that is closer to one of the anchor tools pairs). When the reactive force of the first anchor overcomes the force needed to move the second anchor tool pair 160, the first anchor tool pair 160 may stop moving as the second anchor tool pair 160 moves toward the second anchor until each anchor tool pair 160 is contacting its respective anchor 114(*a*), 114(*b*). Then, when the forces are balanced, the self-centering assembly 164 may be self-centered with respect to the anchors 114(*a*), 114(*b*). In some cases, that position may coincide with being self-centered with respect to the railway tie 110 as well. The anchor tool pairs 160 may proceed to squeeze the anchors 114(*a*), 114(*b*). In some instances, one anchor will contact the tie 110 first, when the anchor is closer than the other anchor to the tie 110. In such instances, the anchor tool pair 160 engaging the closer anchor may stop moving as the closer anchor contacts the tie 110. Then, the other anchor tool pair 160 may continue moving the other anchor until it also contacts the tie 110 and the forces are balanced again. In some installations, the anchor tool pairs 160 may continue to squeeze the anchors 114(*a*), 114(*b*) to a limited extent.

Figure 8D:
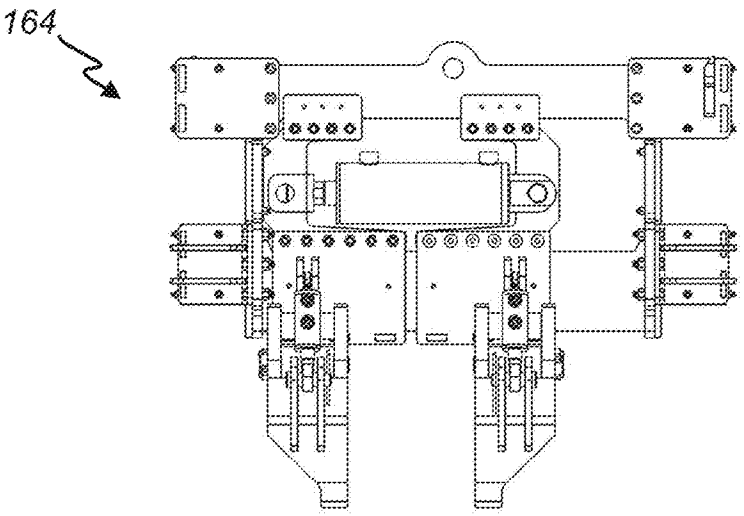
FIGS. 8C, 8D, and 8E depict side views of the self-centering assembly in various final positions after completion of anchor squeezing, in accordance with disclosed embodiments of the present disclosure.
Figure 8C:
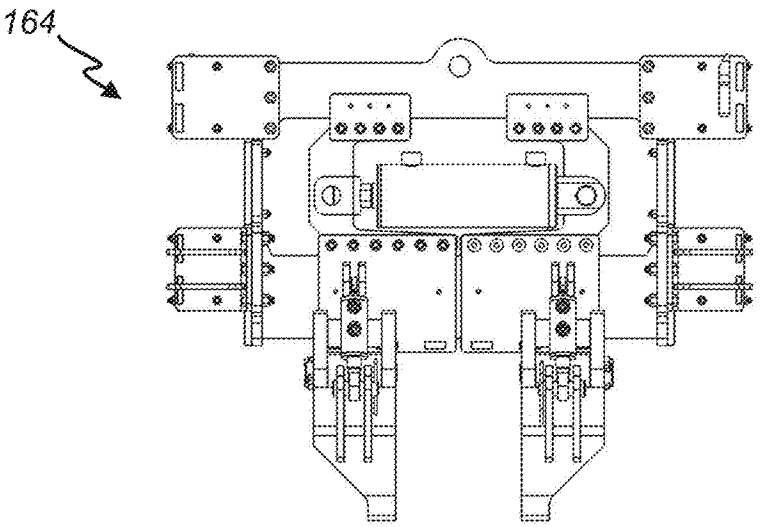
Figure 8E:
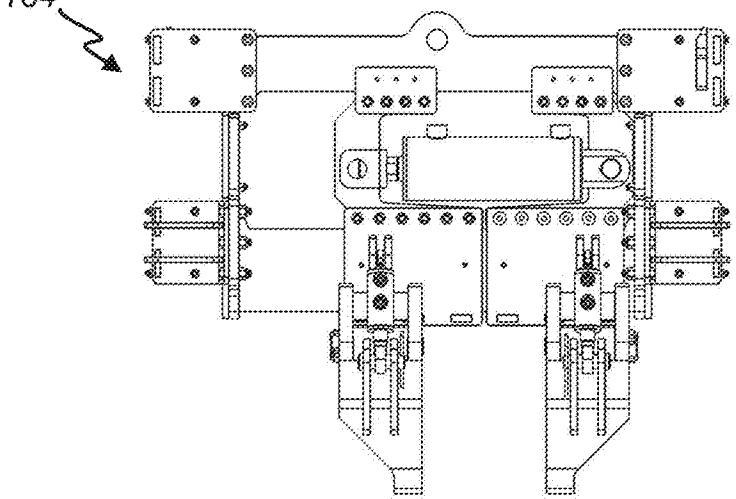

Accordingly, the self-centering assembly 164 may have a wide range of operations and may be adaptable to accommodate various placements of the railway anchors 114(*a*), 114(*b*). The final position of the anchor tool pairs 160 after completion of anchor squeezing may vary depending on the placement of the railway anchors 114(*a*), 114(*b*) and the position of the anchor manipulator 102 and/or workhead as a whole. By way of example, FIGS. 8C, 8D, and 8E depict side views of the self-centering assembly 164 in various final positions after completion of anchor squeezing. After completion of anchor squeezing, the anchor tool pairs 160 may pivot away from the rail 108 and the floating cylinder 174 may be controlled by the control system 201 to extend and return the self-centering subassembly 168 to an initial ready state, which may correspond to the state illustrated in FIG. 8B. The anchor manipulator 102 as a whole may also be automatically raised by the control system 201 from the deployed position to a stowed position or another position. After the anchor tool pairs 160 are raised above the rail 108, each paddle of an anchor tool pair 160 may be controlled to articulate inward toward the other, closing or substantially closing the paddles together. In this manner, the paddles may be closed when in stowed position or otherwise non-deployed position in order to increase the operational space for subsequent fastener installation operations, as well as to increase the field of view from the perspective of an operator and from the perspectives of one or more sensors.

Each of the anchor tools 160 may be formed to accommodate and overcome a variety of variables and complications that can be encountered when attempting anchor adjustments. For example, rail sizes can vary in height, with greater heights compounding the difficulties presented by the cant of the rails. Similarly, rail sizes can vary in width, particularly with regard to rail bases. Rail variations can also include curvatures corresponding to curved sections of track, installation variations, and material warpage/degradation over time. Anchor styles and sizes can also vary significantly in practice. Yet another complication that can arise is the rock/ballast under, besides, and sometime over anchors. All of these variables can present difficulties for anchor adjustment.

However, the disclosed anchor tools 160 may be configured to adapt to such variations. The paddles of the anchor tools 160 may be formed and articulated to hug the opposing edges of the base of the rail 108, as illustrated, for example, in FIG. 7F. With the anchor tools 160, no tool change or setting adjustment necessary for different rail sizes and anchor styles. The paddles are formed to be splayed outward to provide clearance way from the rail 108 and other things attached to the rail 108 when the paddles are spread to accommodate movement along the rail 108. In addition, the paddles of the anchor tools 160 may each be pivoted independently, and the working tips of the paddles may be formed and angled to ensure that maximum engagement with an anchor is possible despite the aforementioned variables. This is particularly important so as to ensure maximum engagement with the small side of the anchor, thereby avoiding slipping off that side of the anchor or missing it entirely. For example, in the example, the anchor tools 160 are depicted as having a step formation such that the bottom portions of the anchor tools 160 have smaller widths than the portions above. In some embodiments, the anchor tools 160 may taper from 6-inch widths down to 4-inch widths at the bottom portions. So, for example, the anchor tools 160 may accommodate wider rails 108—e.g., 6-inch base rails—as well as smaller rail bases—e.g., 5 inches. Further, with respect to the ballast/rock, the form of the paddles and the configuration of the anchor tools 160 may allow for a "dig" function to clear ballast/rock by moving tools in and out rapidly before moving anchors.

Figure 9:
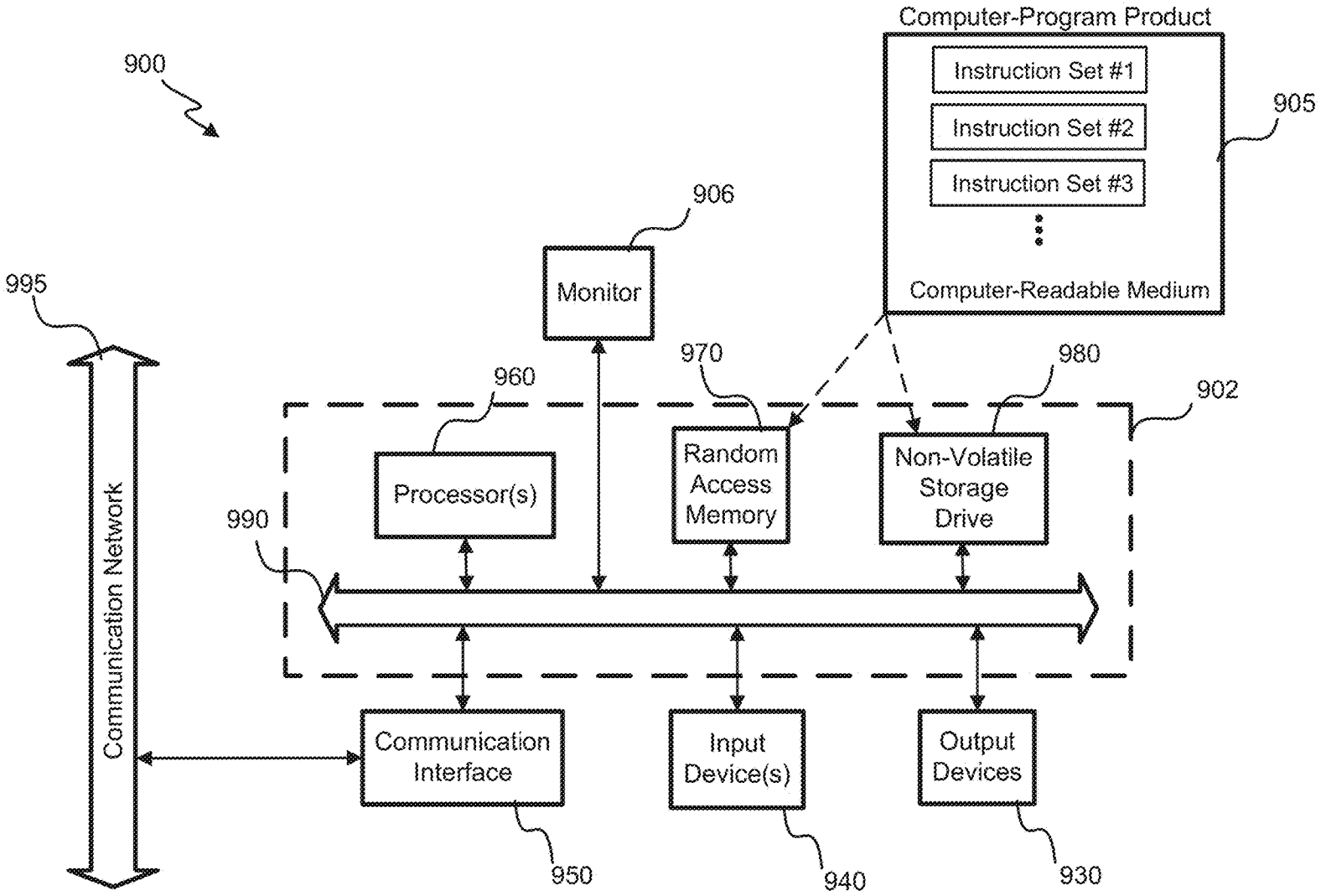
FIG. 9 is a diagram of an embodiment of a special-purpose computer system, in accordance with disclosed embodiments of the present disclosure.

With reference to FIG. 9, an embodiment of a special-purpose computer system 900 is shown. The above methods may be implemented by computer-program products that direct a computer system to perform the actions of the above-described methods and components. In some embodiments, the special-purpose computer system 900 may implement the subsystem 200. In some embodiments, the special-purpose computer system 900 may be included in a control system 201 that could, for example, be included in an operator station. Each such computer-program product may comprise sets of instructions (codes) embodied on a computer-readable medium that directs the processor of a computer system to perform corresponding actions. The instructions may be configured to run in sequential order, or in parallel (such as under different processing threads), or in a combination thereof. Merely by way of example, one or more procedures described with respect to the method(s) discussed herein might be implemented as code and/or instructions executable by a computer (and/or a processor within a computer); in an aspect, then, such code and/or instructions can be used to configure and/or adapt a general purpose computer (or other device) to perform one or more operations in accordance with the described methods, transforming the computer into the special-purpose computer system 900.

As discussed further herein, according to a set of embodiments, some or all of the procedures of such methods are performed by the computer system 900 in response to processor-execution of one or more sequences of one or more instructions (which might be incorporated into the operating system and/or other code, such as an application program) contained in the working memory. Such instructions may be read into the working memory from another computer-readable medium, such as one or more of the non-transitory storage device(s). Merely by way of example, execution of the sequences of instructions contained in the working memory might cause the processor(s) to perform one or more procedures of the methods described herein.

Special-purpose computer system 900 may include a computer 902, a monitor 906 coupled to computer 902, one or more additional user output devices 930 (optional) coupled to computer 902, one or more user input devices 940 (e.g., joystick, keyboard, mouse, track ball, touch screen buttons, switches, control handles, and/or the like) coupled to computer 902, a communications interface 950 coupled to computer 902, a computer-program product 905 stored in a tangible computer-readable memory in computer 902. Computer-program product 905 directs system 900 to perform the above-described methods. Computer 902 may include one or more processors 960 that communicate with a number of peripheral devices via a bus subsystem 990. These peripheral devices may include user output device(s) 930, user input device(s) 940, communications interface 950, and a storage subsystem, such as random-access memory (RAM) 970 and non-volatile storage drive 980 (e.g., disk drive, optical drive, solid state drive), which are forms of tangible computer-readable memory.

Computer-program product 905 may be stored in non-volatile storage drive 980 or another computer-readable medium accessible to computer 902 and loaded into memory 970. Each processor 960 may comprise a microprocessor, such as a microprocessor from Intel® or Advanced Micro Devices, Inc.®, or the like. To support computer-program product 905, the computer 902 runs an operating system that handles the communications of product 905 with the above-noted components, as well as the communications between the above-noted components in support of the computer-program product 905. Exemplary operating systems include Windows® or the like from Microsoft® Corporation, Solaris® from Oracle®, LINUX, UNIX, and the like. The processors 960 may include one or more special-purpose processors such as digital signal processing chips, graphics acceleration processors, video decoders, image processors, and/or the like.

User input devices 940 include all possible types of devices and mechanisms to input information to computer system 902. These may include a keyboard, a keypad, a mouse, a scanner, buttons, control handles, switches, a digital drawing pad, a touch screen incorporated into the display, audio input devices such as voice recognition systems, microphones, and other types of input devices. In various embodiments, user input devices 940 may be embodied as a computer mouse, a trackball, a track pad, a joystick, buttons, control handles, switches, wireless remote, a drawing tablet, a voice command system. User input devices 940 typically allow a user to select objects, icons, text and the like that appear on the monitor 906 via a command such as a click of a button or the like. User output devices 930 include all possible types of devices and mechanisms to output information from computer 902. These may include a display (e.g., monitor 906), printers, non-visual displays such as audio output devices, etc. Some embodiments may not have a separate monitor 906, but may have the monitors integrated with input devices and/or output devices, such as mobile devices, touchscreen devices, etc.

Communications interface 950 provides an interface to other communication networks 995 and devices and may serve as an interface to receive data from and transmit data to other systems, WANs and/or the Internet 918. Embodiments of communications interface 950 typically include an Ethernet card, a modem (telephone, satellite, cable, ISDN), a (asynchronous) digital subscriber line (DSL) unit, a FireWire® interface, a USB® interface, a wireless network adapter, and the like. For example, communications interface 950 may be coupled to a computer network, to a FireWire® bus, or the like. In other embodiments, communications interface 950 may be physically integrated on the motherboard of computer 902, and/or may be a software program, or the like. In further examples, the communications interface 950 may be part of a communications subsystem, which can include without limitation a modem, a network card (wireless or wired), an infrared communication device, a wireless communication device, and/or a chipset (such as a Bluetooth™ device, BLE, an 802.11 device, an 802.15.4 device, a Wi-Fi device, a WiMAX device, cellular communication device, etc.), and/or the like. The communications subsystem may permit data to be exchanged with a network (such as the network described below, to name one example), other computer systems, and/or any other devices described herein.

RAM 970 and non-volatile storage drive 980 are examples of tangible computer-readable media configured to store data such as computer-program product embodiments of the present invention, including executable computer code, human-readable code, or the like. Other types of tangible computer-readable media include floppy disks, removable hard disks, optical storage media such as CD-ROMs, DVDs, bar codes, semiconductor memories such as flash memories, read-only-memories (ROMs), battery-backed volatile memories, networked storage devices, and the like. RAM 970 and non-volatile storage drive 980 may be configured to store the basic programming and data constructs that provide the functionality of various embodiments of the present invention, as described above. The above are examples of one or more non-transitory storage devices that may be utilized by the system 900. Such storage devices may be configured to implement any appropriate data stores, including without limitation, various file systems, database structures, and/or the like.

Software instruction sets that provide the functionality of the present invention may be stored in RAM 970 and non-volatile storage drive 980. These instruction sets or code may be executed by the processor(s) 960. RAM 970 and non-volatile storage drive 980 may also provide a repository to store data and data structures used in accordance with the present invention. RAM 970 and non-volatile storage drive 980 may include a number of memories including a main random-access memory (RAM) to store instructions and data during program execution and a read-only memory (ROM) in which fixed instructions are stored. RAM 970 and non-volatile storage drive 980 may include a file storage subsystem providing persistent (non-volatile) storage of program and/or data files. RAM 970 and non-volatile storage drive 980 may also include removable storage systems, such as removable flash memory.

Bus subsystem 990 provides a mechanism to allow the various components and subsystems of computer 902 communicate with each other as intended. Although bus subsystem 990 is shown schematically as a single bus, alternative embodiments of the bus subsystem may utilize multiple buses or communication paths within the computer 902.

The above methods may be implemented by computer-program products that direct a computer system to control the actions of the above-described methods and components. Each such computer-program product may comprise sets of instructions (codes) embodied on a computer-readable medium that directs the processor of a computer system to cause corresponding actions. The instructions may be configured to run in sequential order, or in parallel (such as under different processing threads), or in a combination thereof. Special-purpose computer systems disclosed herein include a computer-program product(s) stored in tangible computer-readable memory that directs the systems to perform the above-described methods. The systems include one or more processors that communicate with a number of peripheral devices via a bus subsystem. These peripheral devices may include user output device(s), user input device(s), communications interface(s), and a storage subsystem, such as random-access memory (RAM) and non-volatile storage drive (e.g., disk drive, optical drive, solid state drive), which are forms of tangible computer-readable memory.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, hydraulic, pneumatic, and/or electric control connections, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs) or programmable logic controllers (PLCs), field programmable gate arrays (FPGAs), image processors, controllers, micro-controllers, microprocessors, other electronic units designed to perform the functions described above, and/or a combination thereof.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine-readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the terms "storage medium," "storage media," "computer-readable medium," "computer-readable media," "processor-readable medium," "processor-readable media," and variations of the term may represent one or more devices for storing data, including read only memory (ROM), random access memory (RAM), magnetic RAM, core memory, magnetic disk storage mediums, optical storage mediums, flash memory devices and/or other machine readable mediums for storing information. The terms, computer-readable media, processor-readable media, and variations of the term, include, but are not limited to portable or fixed storage devices, optical storage devices, wireless channels and various other mediums capable of storing, containing or carrying instruction(s) and/or data.

Certain elements of the system 100 may be in direct contact with each other and experience relative motion between their contacting (immediately adjacent) faces. In these instances, it may be sufficient to allow steel-on-steel contact and not experience overly destructive wear characteristics over time with normal use, depending on the quality of the base material of each component. Alternatively, in certain instances where relative motion occurs between faces of two or more components, it may be necessary to incorporate additional media between the components in order to absorb any wear from normal use into the replaceable wear component rather than the steel components. For example, a wear pad mounted between the faces of two sliding components to aid in reducing the friction between the two components as they move past one another and to minimize the amount of actual physical wear on the primary components. The wear pad would be the replaceable component meant to be discarded when physical wear reaches a certain limit.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

While the principles of the disclosure have been described above in connection with specific apparatuses and methods, it is to be clearly understood that this description is made only by way of example and not as limitation on the scope of the disclosure. Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered. Furthermore, while the figures depicting mechanical parts of the embodiments are drawn to scale, it is to be clearly understood as only by way of example and not as limiting the scope of the disclosure.

Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning. Furthermore, the use of ordinal number terms, such as "first," "second," etc., to clarify different elements in the claims is not intended to impart a particular position in a series, or any other sequential character or order, to the elements to which the ordinal number terms have been applied.

While the principles of the disclosure have been described above in connection with specific apparatuses and methods, it is to be clearly understood that this description is made only by way of example and not as limitation on the scope of the disclosure.

What is claimed:

1. A railway component handling system comprising:

a railway anchor manipulator movably couplable with a support structure of a railway workhead, the railway anchor manipulator comprising one or more anchor tools and operable to squeeze one or more railway anchors;

one or more actuators operable to selectively raise or lower the railway anchor manipulator;

a railway fastener installer comprising a hammer assembly and movably couplable with the support structure, the railway fastener installer operable to install one or more railway fasteners through one or more holes of a railway tie plate and into a railway tie, where the railway fastener installer is slidably and pivotably couplable with the support structure; and the railway anchor manipulator operable to:

lower to a deployed position at least partially by operation of the one or more actuators;

engage one or more railway anchors attached to a rail with the one or more anchor tools; and adjust the one or more railway anchors using the one or more anchor tools.

2. The railway component handling system as recited in claim 1, where the hammer assembly is movably coupled with a dual-shaft assembly so that the hammer assembly is disposed in line between a pair of shafts of the dual-shaft assembly.

3. The railway component handling system as recited in claim 1, where the railway anchor manipulator and the railway fastener installer are each selectively operable so that respective centerlines of the railway anchor manipulator and the railway fastener installer coincide.

4. A railway component handling system comprising:

a railway anchor manipulator movably couplable with a support structure of a railway workhead, the railway anchor manipulator comprising one or more anchor tools and operable to squeeze one or more railway anchors, where:

a frame assembly of the support structure comprises a first leg and a second leg; and the railway anchor manipulator is movably couplable with the first leg and the second leg so that the railway anchor manipulator is operable to lower to a deployed position in part by sliding along the first leg and the second leg of the frame assembly; and one or more actuators operable to selectively raise or lower the railway anchor manipulator;

a railway fastener installer comprising a hammer assembly and movably couplable with the support structure, the railway fastener installer operable to install one or more railway fasteners through one or more holes of a railway tie plate and into a railway tie; and the railway anchor manipulator operable to:

lower to the deployed position at least partially by operation of the one or more actuators;

engage one or more railway anchors attached to a rail with the one or more anchor tools; and adjust the one or more railway anchors using the one or more anchor tools.

5. A railway component handling system comprising:

a railway anchor manipulator movably couplable with a support structure of a railway workhead, the railway anchor manipulator comprising one or more anchor tools and operable to squeeze one or more railway anchors;

a self-centering assembly that comprises the one or more anchor tools and that is movably coupled with a dual-beam support framework;

one or more actuators operable to selectively raise or lower the railway anchor manipulator;

a railway fastener installer comprising a hammer assembly and movably couplable with the support structure, the railway fastener installer operable to install one or more railway fasteners through one or more holes of a railway tie plate and into a railway tie; and the railway anchor manipulator operable to:

lower to a deployed position at least partially by operation of the one or more actuators;

engage one or more railway anchors attached to a rail with the one or more anchor tools; and adjust the one or more railway anchors using the one or more anchor tools.

6. The railway component handling system as recited in claim 5, further comprising a floating actuator coupled with the one or more anchor tools and operable to cause sliding movement of the one or more anchor tools with respect to the dual-beam support framework.

7. The railway component handling system as recited in claim 5, where the one or more actuators are coupled with the self-centering assembly so that the self-centering assembly is disposed below a main shaft structure of the support structure.

8. The railway component handling system as recited in claim 7, where the main shaft structure is movably coupled with a main shaft of the support structure, and the railway component handling system further comprises a main shaft actuator attached to the main shaft structure and operable to selectively slide the main shaft structure along the main shaft.

9. A railway component handling system comprising:

a railway anchor manipulator movably couplable with a support structure of a railway workhead, the railway anchor manipulator comprising one or more anchor tools and operable to squeeze one or more railway anchors;

one or more actuators operable to selectively raise or lower the railway anchor manipulator;

a railway fastener installer comprising a hammer assembly and movably couplable with the support structure, the railway fastener installer operable to install one or more railway fasteners through one or more holes of a railway tie plate and into a railway tie;

the railway anchor manipulator operable to:

lower to a deployed position at least partially by operation of the one or more actuators;

engage one or more railway anchors attached to a rail with the one or more anchor tools; and adjust the one or more railway anchors using the one or more anchor tools; and a system controller configured to facilitate alignment of the railway anchor manipulator and the railway fastener installer with respect to the railway tie so that the railway anchor manipulator and the railway fastener installer are disposed in an aligned position with respect to the railway tie.

10. The railway component handling system as recited in claim 9, where the system controller is further configured to, when the railway fastener installer is in the aligned position, control the railway fastener installer to install the one or more railway fasteners through the one or more holes of the railway tie plate and into the railway tie.

11. The railway component handling system as recited in claim 10, where the controlling the railway fastener installer to install the one or more railway fasteners through the one or more holes of the railway tie plate and into the railway tie is based at least in part on a recorded pattern indicative of positions of the one or more holes of the railway tie plate.

12. The railway component handling system as recited in claim 10, further comprising one or more sensors configured to transmit sensor data to the system controller, where the controlling the railway fastener installer to install the one or more railway fasteners through the one or more holes of the railway tie plate and into the railway tie is based at least in part on the sensor data.

13. The railway component handling system as recited in claim 10, where the system controller is further configured to, when the railway anchor manipulator is in the aligned position and without adjusting the alignment, control the railway anchor manipulator to cause:

the lowering to the deployed position;

the engaging of the one or more railway anchors attached to the rail with the one or more anchor tools via actuation of a floating actuator; and the adjusting of the one or more railway anchors.

14. The railway component handling system as recited in claim 13, further comprising one or more sensors configured to transmit sensor data to the system controller, where one or both of the engaging and the adjusting the one or more railway anchors is based at least in part on the sensor data.

15. A method comprising:

lowering a railway anchor manipulator to a deployed position at least partially by operation of one or more actuators, wherein:

the railway anchor manipulator movably couplable with a support structure of a railway workhead, the railway anchor manipulator comprising one or more anchor tools and is operable to squeeze one or more railway anchors; and the one or more actuators are operable to selectively raise or lower the railway anchor manipulator;

engaging one or more railway anchors attached to a rail with the one or more anchor tools;

adjusting the one or more railway anchors using the one or more anchor tools; and installing, with a railway fastener installer, one or more railway fasteners through one or more holes of a railway tie plate and into a railway tie, wherein the railway fastener installer comprises a hammer assembly and is movably couplable with the support structure, and wherein the railway fastener installer is slidably and pivotably couplable with the support structure.

16. A method comprising:

lowering a railway anchor manipulator to a deployed position at least partially by operation of one or more actuators, wherein:

the railway anchor manipulator movably couplable with a first leg and a second leg of a frame assembly of a support structure of a railway workhead so that the railway anchor manipulator is operable to lower to the deployed position in part by sliding along the first leg and the second leg of the frame assembly;

the railway anchor manipulator comprises one or more anchor tools and is operable to squeeze one or more railway anchors; and the one or more actuators are operable to selectively raise or lower the railway anchor manipulator;

engaging one or more railway anchors attached to a rail with the one or more anchor tools;

adjusting the one or more railway anchors using the one or more anchor tools; and installing, with a railway fastener installer, one or more railway fasteners through one or more holes of a railway tie plate and into a railway tie, wherein the railway fastener installer comprises a hammer assembly and is movably couplable with the support structure.

17. A method comprising:

lowering a railway anchor manipulator in a self-centering assembly to a deployed position at least partially by operation of one or more actuators, wherein:

the railway anchor manipulator movably couplable with a support structure of a railway workhead, the railway anchor manipulator comprising one or more anchor tools and operable to squeeze one or more railway anchors;

the one or more actuators are operable to selectively raise or lower the railway anchor manipulator; and the self-centering assembly comprises the one or more anchor tools and is movably coupled with a dual-beam support framework;

engaging one or more railway anchors attached to a rail with the one or more anchor tools;

adjusting the one or more railway anchors using the one or more anchor tools; and installing, with a railway fastener installer, one or more railway fasteners through one or more holes of a railway tie plate and into a railway tie, wherein the railway fastener installer comprises a hammer assembly and is movably couplable with the support structure.

18. A method comprising:

facilitating, by a system controller, alignment of a railway anchor manipulator and a railway fastener installer with respect to a railway tie so that the railway anchor manipulator and the railway fastener installer are disposed in an aligned position with respect to the railway tie;

lowering the railway anchor manipulator to a deployed position at least partially by operation of one or more actuators, wherein:

the railway anchor manipulator movably couplable with a support structure of a railway workhead, the railway anchor manipulator comprising one or more anchor tools and operable to squeeze one or more railway anchors; and the one or more actuators are operable to selectively raise or lower the railway anchor manipulator;

engaging one or more railway anchors attached to a rail with the one or more anchor tools;

adjusting the one or more railway anchors using the one or more anchor tools; and installing, with the railway fastener installer, one or more railway fasteners through one or more holes of a railway tie plate and into the railway tie, wherein the railway fastener installer comprises a hammer assembly and is movably couplable with the support structure.

* * * * *